US005250401A

United States Patent [19]

Okada et al.

[11] Patent Number: 5,250,401

[45] Date of Patent: Oct. 5, 1993

[54] PROCESSING COMPOSITION FOR SILVER HALIDE COLOR PHOTOGRAPHIC MATERIAL AND PROCESSING PROCESS INCLUDING THAT COMPOSITION

[75] Inventors: Hisashi Okada; Morio Yagihara; Tadashi Inaba; Hiroyuki Seki, all of Kanagawa, Japan

[73] Assignee: Fuji Photo Film Co., Ltd., Kanagawa, Japan

[21] Appl. No.: 737,876

[22] Filed: Jul. 30, 1991

[30] Foreign Application Priority Data

Jul. 30, 1990 [JP] Japan ..... 2-201846
Nov. 30, 1990 [JP] Japan ..... 2-330775

[51] Int. Cl.[5] ..... G03C 7/42

[52] U.S. Cl. ..... 430/393; 430/430; 430/460; 430/461

[58] Field of Search ..... 430/393, 430, 455, 460, 430/372, 428, 461

[56] References Cited

U.S. PATENT DOCUMENTS

| | | | |
|---|---|---|---|
| 4,446,225 | 5/1984 | Kishimoto et al. | 430/430 |
| 4,481,290 | 11/1984 | Kishimoto et al. | 430/430 |
| 4,695,529 | 9/1987 | Abe et al. | 430/393 |
| 4,845,017 | 7/1989 | Kishimoto et al. | 430/430 |
| 4,894,320 | 1/1990 | Ueda et al. | 430/393 |
| 4,908,300 | 3/1990 | Koboshi et al. | 430/430 |
| 4,939,073 | 7/1990 | Koboshi et al. | 430/393 |
| 4,963,474 | 10/1990 | Fujita et al. | 430/393 |
| 5,093,228 | 3/1992 | Nakamura | 430/393 |

*Primary Examiner*—Hoa Van Le
*Attorney, Agent, or Firm*—Sughrue, Mion, Zinn, Macpeak & Seas

[57] ABSTRACT

Disclosed is a method for processing a silver halide color photographic material, which comprises the steps of:

image-wise exposing a silver halide color photographic material, color developing the image-wise exposed silver halide photographic material, and processing the color developed silver halide photographic material, in the presence of a processing composition containing a metal chelating compound formed by a compound represented by following formula (I) and a salt of a metal belonging to group Ib, IIb, IIIb,IVb, Vb, VIb, VIIb, or VIII of the Periodic Table:

(I)

wherein Z represents a heterocyclic group; L represents a divalent linkage group; $R_{11}$ and $R_{12}$ each represents a hydrogen atom, an aliphatic group, an aromatic group, or a heterocyclic group; and n represents 0 or 1. Also disclosed is the processing composition used in the above method.

19 Claims, No Drawings

PROCESSING COMPOSITION FOR SILVER HALIDE COLOR PHOTOGRAPHIC MATERIAL AND PROCESSING PROCESS INCLUDING THAT COMPOSITION

FIELD OF THE INVENTION

The present invention relates to a composition for processing a silver halide color photographic material and a processing process including that composition. More particularly, the invention relates to a processing composition containing a novel beaching agent for use in a beach step after color development and to a process for processing a silver halide color photographic material using that bleaching agent.

BACKGROUND OF THE INVENTION

A silver halide color photographic material (hereinafter referred to as a color photographic material or a color photographic light-sensitive material) is processed, after imagewise exposure, by a color development step and a desilvering step.

In the color development step, light-exposed silver halide grains are reduced with a color developing agent to form silver. At the same time, the oxidation product of the color developing agent formed reacts with coupler(s) to form image-forming dye(s).

In the subsequent desilvering step, the developed silver formed in the color development step is oxidized to a silver salt with a bleaching agent having an oxidizing action (i.e., the bleach). The silver salt is then removed from the light-sensitive layers together with the unreacted silver halides by a fixing agent which forms soluble silver (i.e., the fix). The bleach and the fix are carried out separately in a bleach step and fix step or are carried out simultaneously in a bleach-fix or blix step. These processing steps are described in James, *The Theory of Photographic Process*, 4th edition, 1977.

In addition to the foregoing basic processing steps, various supplementary steps are added for the purpose of keeping the photographic and physical qualities of the dye images formed or maintaining the stability of processings. They include a wash step, a stabilization step, a hardening step, and a stop step.

The foregoing processing steps are generally carried out by an automatic processor. Recently, a small-sized automatic processor called "minilabo" are used in stores, and quick processing services for customers are increasing.

Accordingly, there has been a growing demand for quick processing steps, particularly relating to the bleach step.

Furthermore, since photographic processing has been practiced in various places with different requirements, waste liquids of the processing solutions be a significant problem.

For example, ethylenediaminetetraacetic acid ferric complex salts which have hitherto been used as a bleaching agent have the fundamental defect that their oxidizing power is weak. In spite of improvements such as the use of a bleach accelerator (e.g., the addition of the mercapto compound described in U.S. Pat. No. 1,138,842), the foregoing object of quick bleaching has not yet been attained. Also, in the case of using such bleach accelerators, the bleaching faculty deteriorates over the passage of time by the deterioration of the bleach accelerator. Consequently, the amount of the replenisher for the bleach solution can not be reduced.

Accordingly, the object of greatly reducing the amount of waste liquids has not been attained.

Bleaching agents capable of attaining quick bleaching include a ferricyanide, iron chloride, a bromate, etc. However, they can not be widely used since ferricyanides cause environmental problems, iron chloride causes a corrosion of metals, etc., and hence is inconvenient for handling, and bromates cause unstability of the liquid.

Accordingly, a bleaching agent which can be easily handled and can attain quick bleaching without causing discharge of waste liquid has been desired.

Recently, as a bleaching agent satisfying the foregoing need, a 1,3-diaminopropanetetraacetic acid ferric complex salt has been suggested.

However, bleaching agents have various problems. One of them is the problem of causing a bleach fog during bleaching. As a method of reducing the bleach fog, it has been suggested to add a buffer to a bleach solution as described, e.g., in JP-A-1-213657 (the term "JP-A" as used herein means an "unexamined published Japanese patent application"). However, the level of the improvement by that method is still unsatisfactory. In particular, since a highly active color developer is used in quick processing a color development for a time not longer than three minutes, severe bleach fog occurs.

Also, when a bleach solution containing the 1,3-diaminopropanetetraacetic acid ferric complex salt is used, an increase of stains during the storage of color images after processing occurs.

Also, for simply and quickly carrying out desilvering processing, a blix step comprising a simultaneous bleach step and fix step is desired. But a blix solution containing the foregoing 1,3-diaminopropanetetraacetic acid ferric complex salt is too poor in stability of the liquid for practical use.

Furthermore, in the case of a bleach solution containing a 1,3-diaminopropanetetraacetic acid ferric complex salt, the color of the magenta dye in the color images increases, changing the gradation thereof during the storage of the color images after processing.

Also, in the case of carrying out bleach processing for a far shorter period of time, when the bleach solution containing the 1,3-diaminopropanetetraacetic acid ferric complex salt is used, the cyan dye in the imaged portions becomes a leuco dye causing inferior recoloring.

Thus, a processing composition containing a novel bleaching agent in place of the foregoing bleaching agent and a process using such a composition have been desired in the art.

SUMMARY OF THE INVENTION

One object of this invention is to provide a processing composition which can be easily handled and does not cause an environmental problem by waste liquid and a processing process using that composition.

A second object of this invention is to provide a processing composition having a bleaching faculty with an excellent desilvering property and a processing process using that processing composition.

A third object of this invention is to provide a processing composition having a bleaching faculty giving less bleach fog and a processing process using that composition.

A fourth object of this invention is to provide a processing composition having a bleaching faculty giving less stains over the passage of time and a processing process using that composition.

A fifth object of this invention is to provide a processing composition having a bleaching faculty which is excellent in stability over the passage of time and a processing process using that composition.

A sixth object of this invention is to provide a processing composition having a bleaching faculty, which is excellent in its quick bleaching property, which does not give inferior recoloring, and which causes less change in gradation over the passage of time and a processing process using that composition.

It has now been discovered that the foregoing and other objects can be attained by the present invention as described hereinafter.

The present invention is a composition for processing a silver halide color photographic material, containing a metal chelating compound formed by a compound represented by the following formula (I) and a salt of a metal belonging to group Ib, IIb, IIIb, IVb, Vb, VIb, VIIb or VIII of the Periodic Table or containing the metal chelating compound and an organic acid, and a processing process using that processing composition;

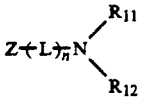

(I)

wherein Z represents a heterocyclic group; L represents a divalent linkage group; $R_{11}$ and $R_{12}$ each represents a hydrogen atom, an aliphatic group, an aromatic group, or a heterocyclic group; and n represents 0 or 1.

DETAILED DESCRIPTION OF THE INVENTION

The present invention comprises the steps of (i) imagewise exposing a silver halide color photographic material, (ii) color developing the color photographic material, and then (iii) processing the color photographic material with a processing composition containing at least the foregoing metal chelating compositions of this invention. Bleaching the developed silver is carried out very quickly with no severe bleach fog which occurs in the case of quick bleaching using conventional bleaching agents. This is an important effect in the case of processing with the processing composition of the present invention after color development for a short time of less than three minutes. Also, after processing, the storage stability of the images formed is good, which is preferable for handling.

When the processing composition contains an organic acid, inferior recoloring is not severe which is significant in the case of quickly carrying out bleach processing.

Furthermore, in the case of carrying out processing wherein the amount of the replenisher for the bleach solution is reduced, the effect of this invention becomes remarkable. The storage stability of the color images formed after processing is good, which is preferable for handling.

In formula (I), Z represents a heterocyclic group. The heterocyclic group shown by Z may be a 3- to 10-membered saturated or unsaturated heterocyclic ring containing at least one nitrogen, oxygen or sulfur atom. The heterocyclic group may be a single ring or may form a condensed ring with an aromatic ring or another heterocyclic ring. As the heterocyclic ring, a 5- or 6-membered aromatic heterocyclic ring is preferable, and examples thereof include thiophene, furan, pyrrole, imidazole, pyrazole, pyridine, pyrazine, pyrimidine, pyridazine, triazole, triazine, indole, indazole, purine, thiadiazole, oxadiazole, quinoline, phthalazine, naphthyridine, quinoxaline, quinazoline, cinnoline, pteridine, acridine, phenanthroline, phenazine, tetrazole, thiazole, and oxazole. Among these aromatic heterocyclic rings, pyrrole, imidazole, triazole, tetrazole, thiadiazole, oxadiazole, pyrazole, pyridine, pyrazine, pyrimidine, quinoxaline, thiazole, and oxazole are preferred and further, pyrrole, imidazole, triazole, tetrazole, pyridine, thiadiazole, oxadiazole, thiazole, and oxazole are more preferred.

The substitution position of

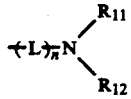

to the the heterocyclic ring may be any possible position on ring but the following substitution positions are preferable: the 2-, 3-, 4-, or 5-position, and more preferably the 2- or 5-position, to thiophene or furan; the position 1-, 2-, 3-, 4- or 5-position, and more preferably the 2- or 5-position, to pyrrole; the 1-, 2-, 3-, 4-, or 5-position, and more preferably the 2-, 4- or 5-position, to imidazole; the 1-, 3-, 4-, or 5-position, and more preferably the 1-, 3- or 5-position, to pyrazole; the 2-, 3-, 4-, 5-, or 6-position, and more preferably the 2- or 6-position, to pyridine; the 2-, 3-, 5-, or 6-position to pyrazine; the 2-, 4-, 5-, or 6-position, and more preferably the 2-, 4-, or 6-position, to pyrimidine; the 3-, 4-, 5-, or 6-position, and more preferably the 3- or 6-position, to pyridazine; the 1-, 4-, or 5-position to 1,2,3-triazole and the 1-, 3-, or 5-position to 1,2,4-triazole; the 2-, 4-, or 6-position to triazine; the 1-, 2-, 3-, 4-, 5-, 6-, or 7-position, and preferably the 2-, 3-, or 7-position, to indole; the 1-, 3-, 4-, 5-, 6-, or 7-position, and more preferably the 3- or 7-position, to indazole; the 2-, 6-, 7-, or 8-position, and more preferably the 2-, 6-, or 8-position, to purine; the 2- or 5-position to thiadiazole and oxadiazole; the 2-, 3-, 4-, 5-, 6-, 7-, or 8-position, and more preferably the 2- or 8-position, to quinoline; the 1-, 4-, 5-, 6-, 7-, or 8-position, and more preferably the 1- or 4-position, to phthalazine; the 2-, 3-, 4-, 5-, 6-, or 7-position, and more preferably the 2- or 7-position, to naphthyridine; the 2-, 3-, 5-, 6-, 7-, or 8-position, and more preferably the 2-, 3-, 5-, or 8-position, to quinoxaline; the 2-, 4-, 5-, 6-, 7-, or 8-position, and more preferably the 2-, 4-, or 8-position, to quinazoline; the 3-, 4-, 5-, 6-, 7-, or 8-position, and more preferably the 3- or 8-position, to cinnoline; the 2-, 4-, 6-, or 7-position to pteridine; the 1-, 2-, 3-, 4-, 5-, 6-, 7-, 8-, or 9-position, and more preferably the 4- or 5-position, to acridine; the 2-, 3-, 4-, 5-, 6-, 7-, 8-, or 9-position, and more preferably the 2- or 9-position, to phenanthroline (e.g., 1,10-phenanthroline); the 1-, 2-, 3-, 4-, 6-, 7-, 8-, or 9-position, and more preferably the 1-, 4-, 6-, or 9-position, to phenazine; the 5-position to tetrazole; and the 2-, 4-, or 5-position to thiazole and oxazole.

These heterocyclic rings may have one or more substituents such as an alkyl group, an aralkyl group, an alkenyl group, an alkinyl group, an alkoxy group, an aryl group, a substituted amino group, an acylamino group, a sulfonylamino group, a ureido group, a urethane group, an aryloxy group, a sulfamoyl group, a carbamoyl group, an alkylthio group, an arylthio group, a sulfonyl group, a sulfinyl group, a hydroxy group, a halogen atom, a cyano group, a sulfo group, a carboxy group, a phosphono group, an aryloxycarbonyl group, an acyl group, an alkoxycarbonyl group, an acyloxy group, a carbonamido group, a sulfonamido group, a nitro group, a hydroxamic acid group, a heterocyclic group, etc.

The preferred Z is shown by following formula (Za)

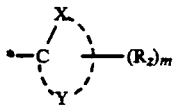

(Za)

wherein X represents a nitrogen atom, a sulfur atom or an oxygen atom, Y represents a non-metallic atom group to form a 5- or 6-membered heterocyclic aromatic ring, $R_z$ represents a substitutent, and m represents 0 or an integer of 1 to 4. The mark (*) means the bond to

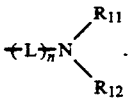

Preferred examples of the heterocyclic aromatic ring include

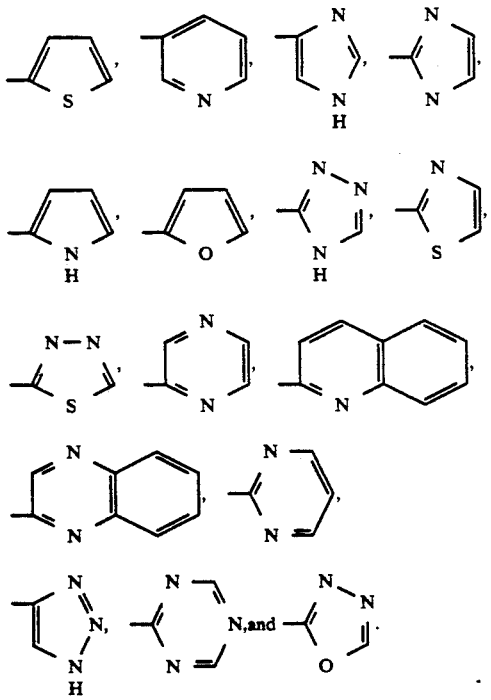

be substituted by a group of $R_z$ as described above. Preferred examples of $R_z$ include an alkyl group having 1 to 3 carbon atoms and a nitro group.

In formula (I), L represents a divalent linkage group. Examples of the preferred divalent linkage group include straight chain, branched, or cyclic alkylene groups (preferably having from 1 to 10 carbon atoms), alkenylene groups (preferably having from 1 to 10 carbon atoms), alkinylene groups (preferably having from 1 to 10 carbon atoms), arylene groups (preferably having from 6 to 10 carbon atoms, such as, e.g., phenylene and naphthalene), aralkylene groups (preferably having from 7 to 10 carbon atoms,

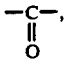

$-SO_2-$, and groups composed of a combination of —O—, —S—, —COO—,

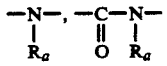

(wherein $R_a$ represents a hydrogen atom, an alkyl group, an aryl group, or a hydroxy group) or

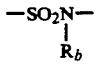

(wherein $R_b$ represents a hydrogen atom, an alkyl group, or an aryl group) and alkylene groups or arylene groups. Furthermore, if possible, a combination of the foregoing linkage groups may be used.

The preferred L is shown by following formula (L)

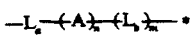

(L)

wherein $L_a$ and $L_b$ each represents a straight chain, branched, or cyclic alkylene group having from 1 to 10 carbon atoms, an alkenylene group having 2 to 10 carbon atoms, an alkinylene group having 2 to 10 carbon atoms, an arylene group having 6 to 10 carbon atoms,

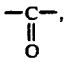

or $-SO_2-$; A represents —O—, —S—, —COO—,

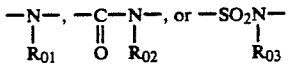

(wherein $R_{01}$, $R_{02}$, and $R_{03}$ each represents a hydrogen atom, an alkyl group having from 1 to 4 carbon atoms, an aryl group having from 6 to 10 carbon atoms, or a hydroxyl group); and m and n each independently represents 0 or 1. Also, the mark (*) means the bond to Z.

$L_a$ and $L_b$ each is preferably an alkylene group or an arylene group, and more preferably an alkylene group and m and n are preferably 0.

The divalent linkage group shown by L may have a substituent such as those described above as the substituents of Z.

Examples of the preferred L groups include:

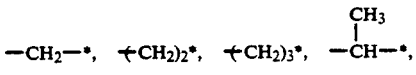

-continued

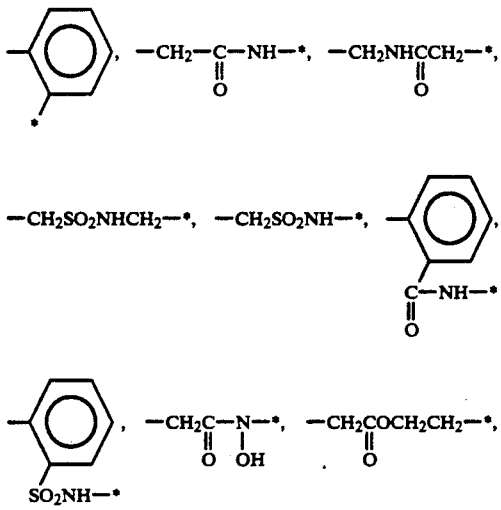

In formula (I), $R_{11}$ and $R_{12}$ each independently represents a hydrogen atom, an aliphatic group, an aromatic group, or a heterocyclic group.

The aliphatic group shown by $R_{11}$ and $R_{12}$ is a straight chain, branched, or cyclic group, and includes an alkyl, alkenyl, or alkinyl group preferably having up to 10 carbon atoms. As the aliphatic group, an alkyl group is preferred, and an alkyl group having from 1 to 4 carbon atoms is particularly preferred.

The aromatic group shown by $R_{11}$ and $R_{12}$ is a monocyclic or dicyclic aryl group. Examples thereof include a phenyl group and a naphthyl group, and a phenyl group is preferred.

As the heterocyclic group shown by $R_{11}$ and $R_{12}$, there are the aforesaid heterocyclic groups shown by Z.

The aliphatic group, the aromatic group, and the heterocyclic group shown by $R_{11}$ and $R_{12}$ each may have a substituent. Examples of the substituents are the substituents described above about Z.

Examples of the heterocyclic group as the substituent of the groups shown by $R_{11}$ and $R_{12}$ include the heterocyclic groups shown by Z.

Furthermore, $R_{11}$, $R_{12}$, and Z may combine, if possible, to form a ring.

$R_{11}$ and $R_{12}$ preferably represent $—L_1—OH$, $—L_1—COOM^l$, $—L_1—PO_3M^2M^3$, $—L_1—PO_3M^4$, or $—L_1—Za$ (wherein $L_1$ represents a divalent linkage group containing an alkylene group and/or an arylene group; $M^1$, $M^2$, $M^3$, and $M^4$ each represents a hydrogen atom or a cation such as an alkali metal (e.g., lithium, sodium, and potassium), ammonium, pyridinium, etc.; and $Z_a$ has the same meaning as Z). More preferably, $R_{11}$ and $R_{12}$ are $—L_1—COOM^1$ or $—L_1—Z_a$.

The divalent linkage groups containing an alkylene group and/or an arylene group shown by $L_1$ include an alkylene group having from 1 to 6 carbon atoms, an arylene group having from 6 to 10 carbon atoms, an aralkylene group having from 7 to 10 carbon atoms, a group composed of a combination of —O—, —S—, —COO—,

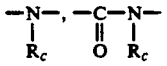

(wherein $R_c$ represents a hydrogen atom, an alkyl group, an aryl group, or a hydroxy group), or

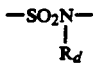

( (wherein $R_d$ represents a hydrogen atom, an alkyl group, or an aryl group) and an alkylene group and/or an arylene group. Furthermore, if possible, the divalent linkage group may be a combination of the foregoing linkage groups.

Furthermore, preferred $L_1$ can be represented by the following formula ($L_1$):

$$—L'_a—(A')_{m'}—(L'_b)_{n'}—** \qquad (L_1)$$

wherein $L'_a$ and $L'_b$ each represents an alkylene group or an arylene group; A' represents —O—, —S—, —COO—,

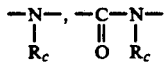

(wherein $R_c$ represents a hydrogen atom, an alkyl group, an aryl group, or a hydroxy group), or

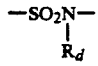

(wherein $R_d$ represents a hydrogen atom, an alkyl group, or an aryl group); and m' and n' each represents 0 or 1. Also, the mark (**) represents a bonding position to OH, $COOM^1$, $PO_3M^2M^3$, $SO_3M^4$, or Za, as those terms are defined above.

Also, these divalent linkage groups each may have substituents. Examples of the substituents are those described above as the substituents of Z.

Examples of preferred $L_1$ are as follows:

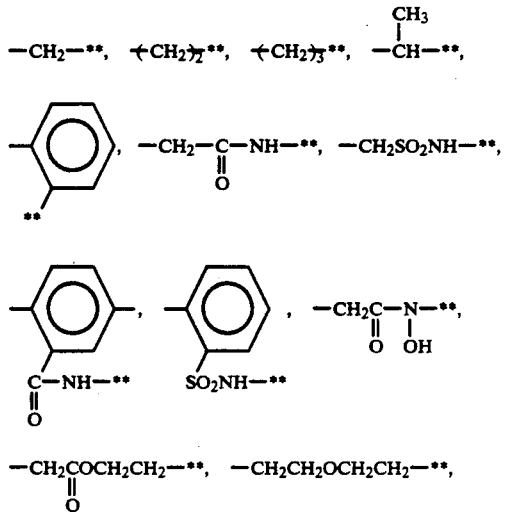

-continued $-CH_2CH_2SCH_2CH_2-^{}$, and $-CH_2CH_2NHCH_2CH_2-^{}$.

In the compounds according to formula (I), preferred compounds are those shown by following formula (II) or (III):

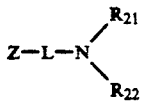

(II)

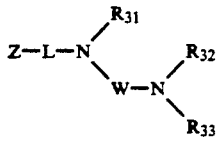

(III)

wherein $R_{21}$ and $R_{22}$ have the same meaning as $R_{11}$ and $R_{12}$, and are preferably $-L_1-OH$, $-L_1-COOM^1$, $-L_1-PO_3M^2M^3$, $-L_1-SO_3M^4$, or $-L_1-Z_a$; and Z and L are defined as in formula (I); $R_{31}$, $R_{32}$, and $R_{33}$ have the same meaning as $R_{11}$ and $R_{12}$ in formula (I); and $R_{31}$, $R_{32}$, $R_{33}$, and Z-L may be the same or different and it is preferred that at least one of them is $L_2$-$Z_b$ (wherein $L_2$ has the same meaning as L, $L_2$ and L may be the same or different; $Z_b$ has the same meaning as Z, and $Z_b$ and Z may be the same or different). It is more preferred that $R_{33}$ is $L_2-Z_b$ and that $R_{31}$ and $R_{32}$ are a hydrogen atom or $-L_1COOM^1$.

In formula (III), W represents a divalent linkage group bonding to

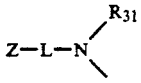

with an aliphatic group, an aromatic group, or a heterocyclic group.

W can be represented by following formula ($W_1$) or ($W_2$)

$$\text{-}(W^1-D)_s-W^2 \qquad (W_1)$$

wherein $W^1$ and $W_2$ each represents an alkylene group having from 2 to 8 carbon atoms, an arylene group having from 6 to 18 carbon atoms, or a cyclohexylene group; D represents —O—, —S—, or

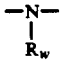

[wherein $R_w$ represents a hydrogen atom, a hydrocarbon group, $-L_A-COOM^5$, $-L_APO_3M^6M^7$, $-L_A-OH$, or $-L_A-SO_3M^8$ (wherein $L_A$ represents an alkylene group having from 1 to 8 carbon atoms or an arylene group having from 6 to 10 carbon atoms; and $M^5$, $M^6$, $M^7$, and $M^8$ each represents a hydrogen atom or a cation such as an alkali metal, ammonium, etc.)]; and s represents an integer of from 0 to 3.

$W^1$ and $W^2$ are preferably an alkylene group; D is preferably

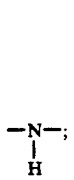

and s is preferably 0, 1, or 2.

$$-(L_B)_l-W^3-(L_C)_{l'} \qquad (W_2)$$

wherein $L_B$ and $L_C$ each represents an alkylene group having from 1 to 8 carbon atoms; $W^3$ represents an arylene group having from 6 to 18 carbon atoms, a cyclohexylene group, or a divalent heterocyclic group having a nitrogen atom in its ring; and l and l' each represents 0 or 1, excluding the instance in which l and l' are simultaneously 0.

The divalent linkage groups shown by W may have one or more substituents, and examples of the substituent are those described above as the substituents for Z.

Examples of W are illustrated below:

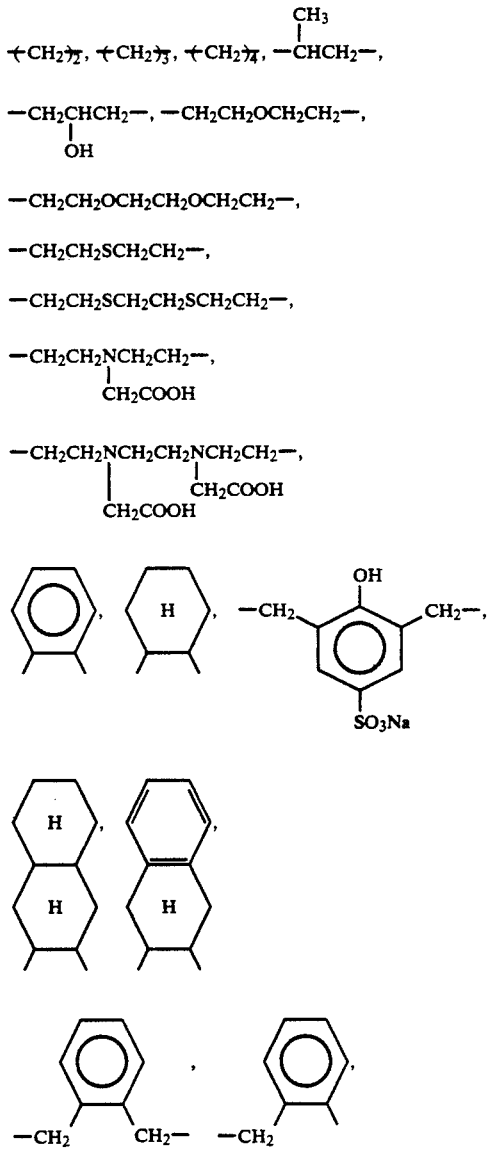

-continued
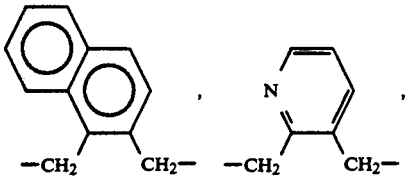
-continued
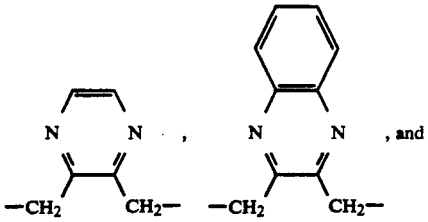
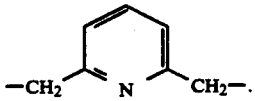
The following are examples of the compounds according to formula (I):
1.
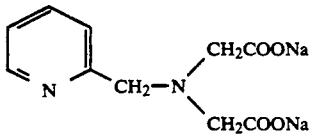
2.
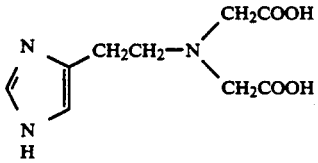
3.
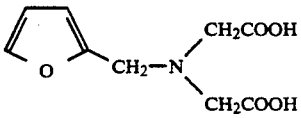
4.
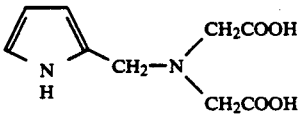
5.
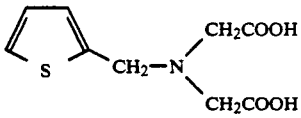
6.
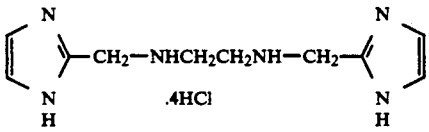
7.
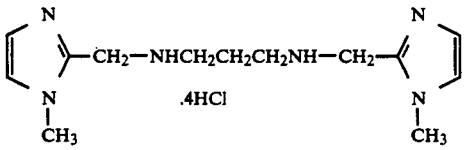
8.
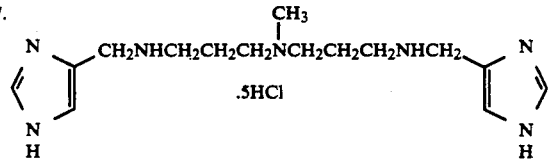
9.
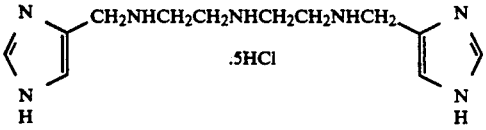
10.
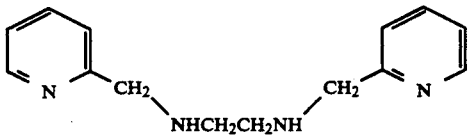
11.
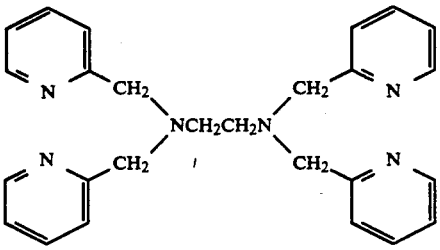
12.
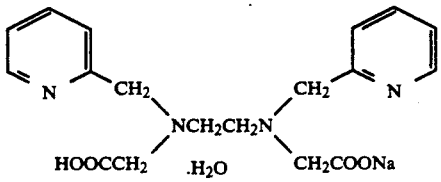

-continued
13.
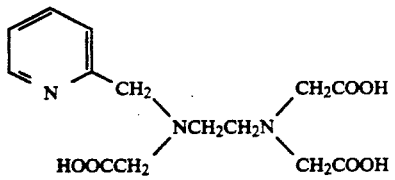
14.
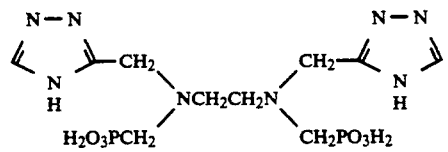
15.
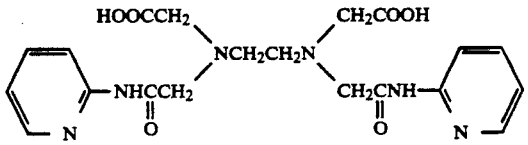
16.
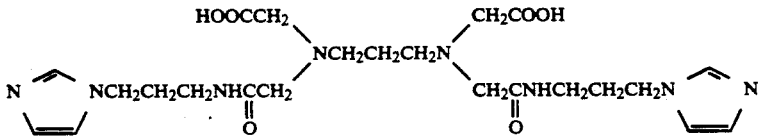
17.
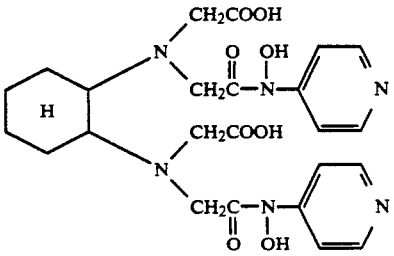
18.
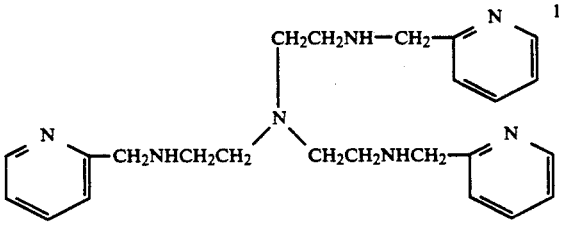
19.
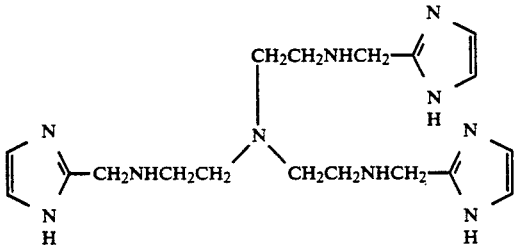
20.
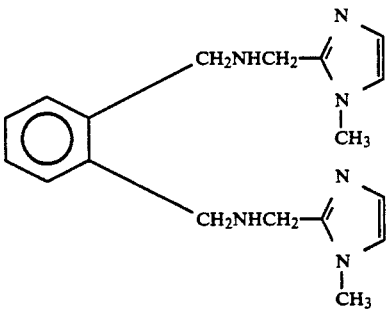
21.
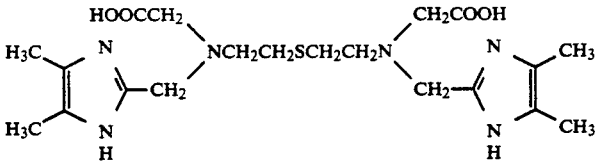
22.
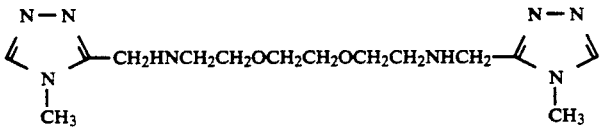
23.
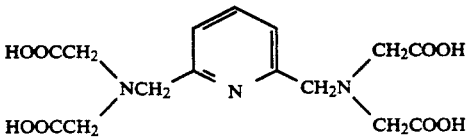
24.
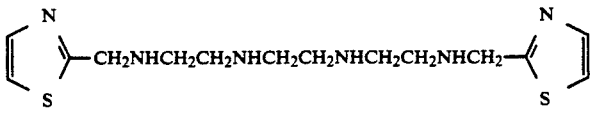

-continued
25.
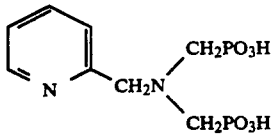
26.
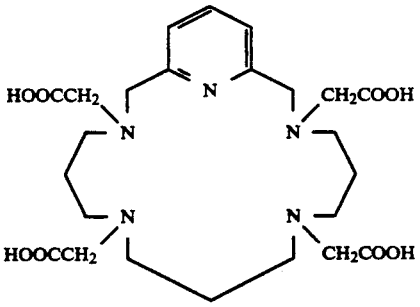
27.
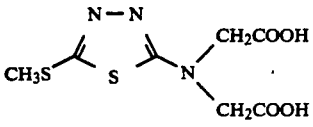
28.
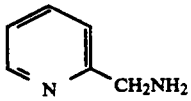
29.
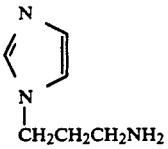
30.
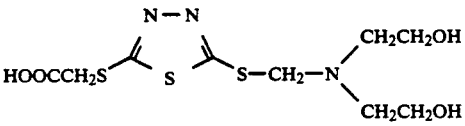
31.
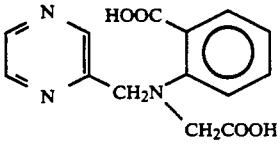
32.
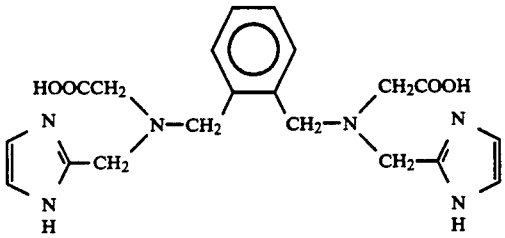
33.
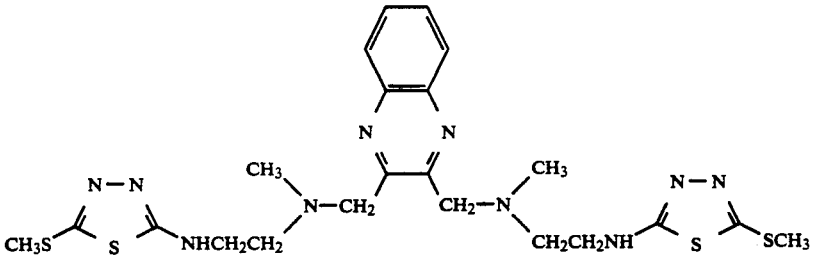
34.
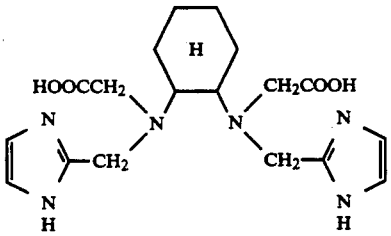
35.
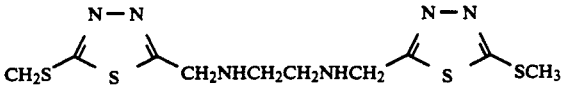

-continued
36.
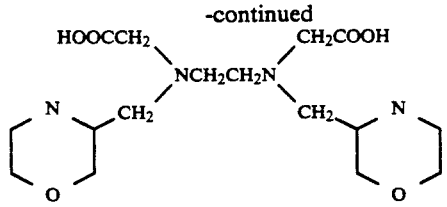
37.
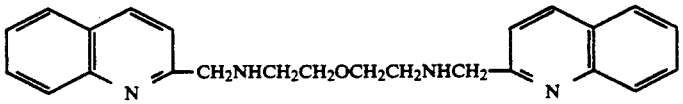
38.
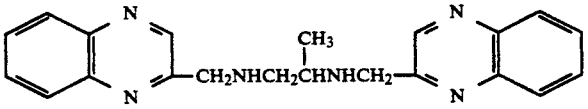
39.
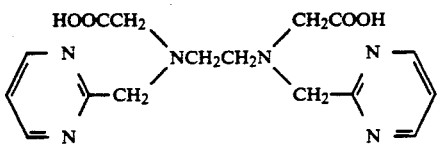
40.
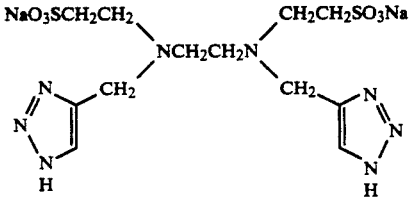
41.
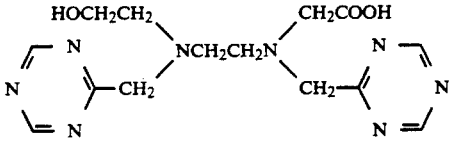
42.
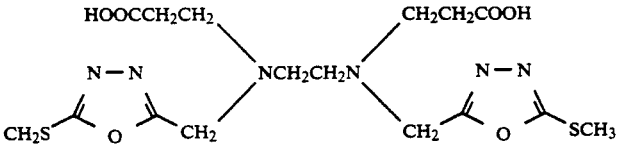
43.
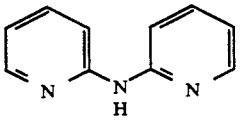
44.
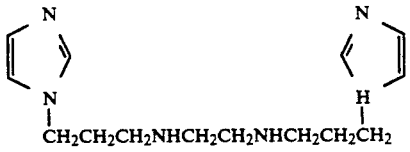
.4HCl
45.
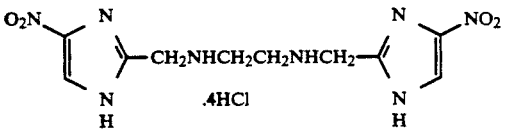
.4HCl
46.
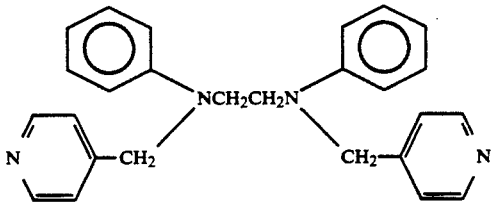
47.
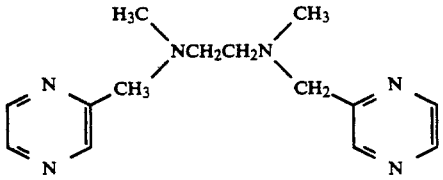
48.
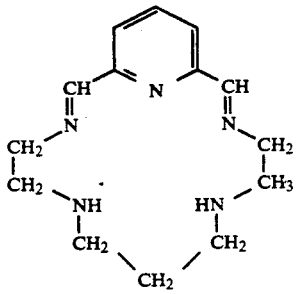

-continued
49.
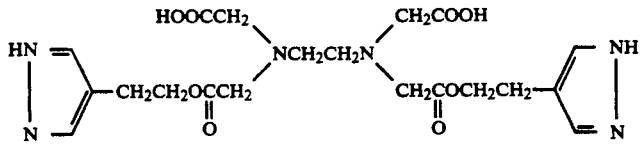
50.
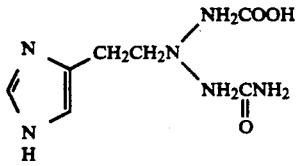
51.
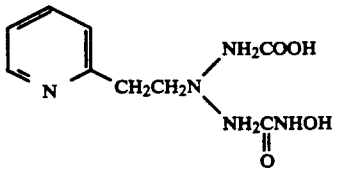
52.
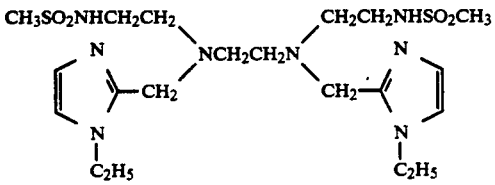
53.
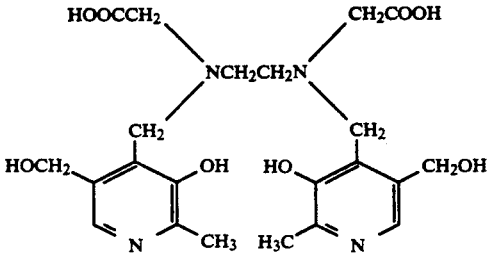
54.
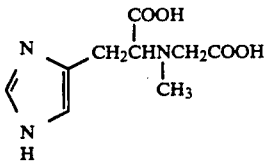
55.
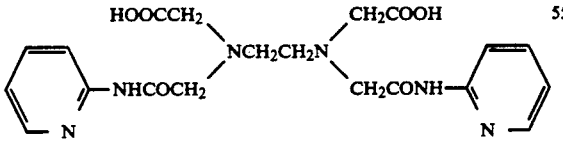
56.
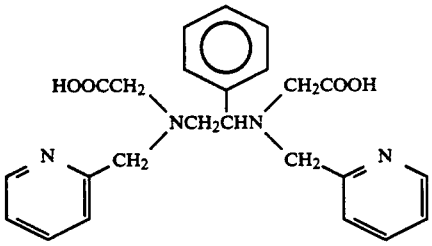
57.
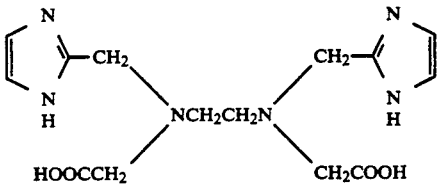
58.
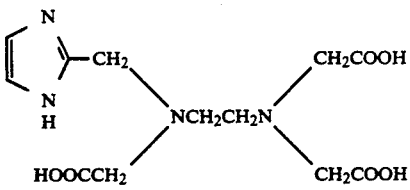
59.
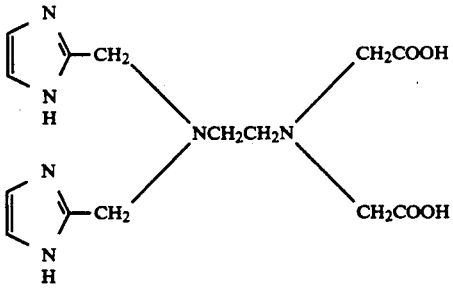
60.
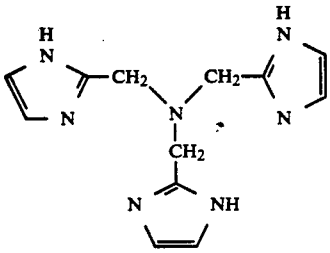
61.
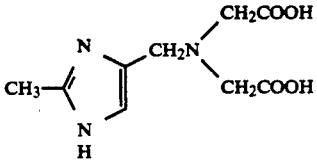

-continued

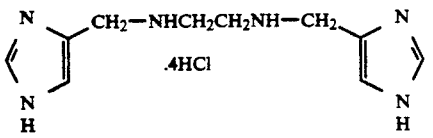

62.

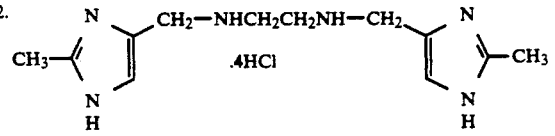

63.

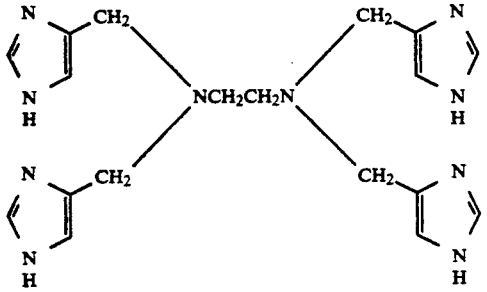

64.

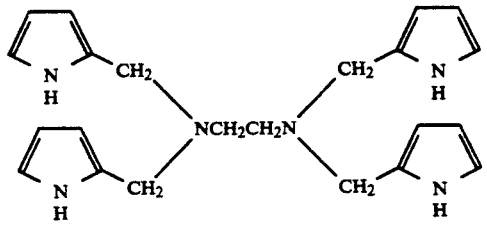

65.

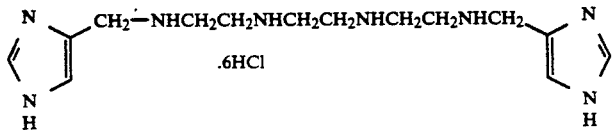

66.

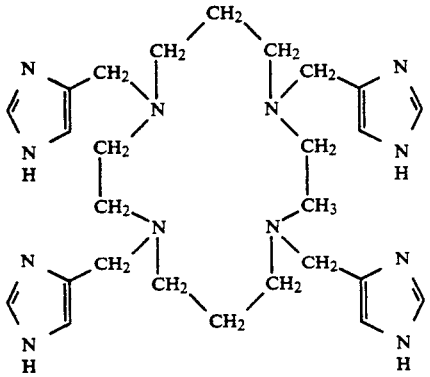

67.

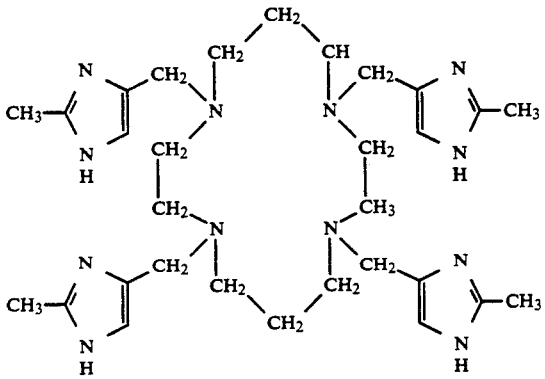

68.

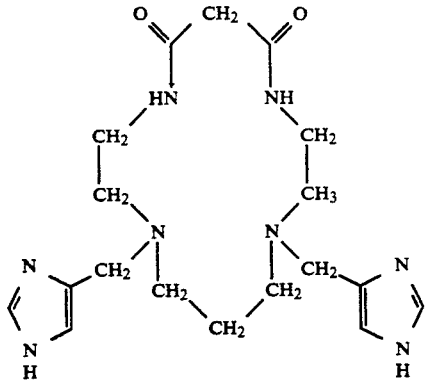

69.

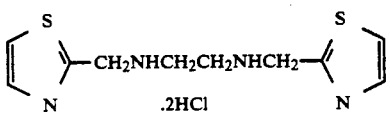

70.

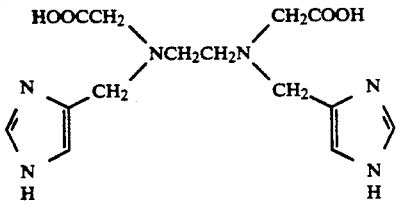

71.

The compounds shown by formula (I) can be synthesized by referring to the description of Kagehira Ueno, *Chelate Kagaku* (*Chemistry*), Vol. 5, Chapter 1 (published by Nankodo K. K., 1975), etc.

For example, the compounds of the present invention can be obtained by hydrogenation reaction of a heterocyclic compound having a carbonyl group and an amine compound in the presence of a catalyst such as active carbon-carried palladium, platinum, cobalt, and Raney nickel. The compounds of the present invention can be also be obtained by alkylation reaction of an amino group-containing heterocyclic compound using an alkylating agent. The alkylation reaction is preferably conducted in the presence of a base such as an alkali and a tertiary amine (e.g., triethylamine) in an amount of 1 to 10 mols, preferably 1 to 4 mols, per mol of the alkylating agent.

Both the hydrogenation reaction and the alkylation reaction are generally conducted in a solvent. Any solvents can be used as long as it does not adversely influence on the reaction, and water and alcohols such as lower alcohols (e.g., methanol) are preferably used for the purpose.

Typical synthesis systems of the compounds shown by formula (I) are illustrated by the following synthesis examples.

SYNTHESIS EXAMPLE 1

Synthesis of Compound 5

In 40 ml of water was dissolved 20.0 g (0.177 mol) of 2-(aminomethyl)thiophene, and the solution was stirred at 50° C. Then, after adding thereto phenolphthalein as an indicator, 50 ml of an aqueous solution of 45.0 g (0.386 mol) of sodium chloroacetate and 20 ml of 15.5 g (0.386 mol) of sodium hydroxide were added dropwise to the solution in such a manner that the solution maintained red color. After finishing the addition of the aqueous solutions, the mixture was further stirred for 2 hours, and after ice-cooling the mixture, 39.1 g (0.386 mol) of concentrated hydrochloric acid was added thereto. Solids thus deposited were recovered by filtration and recrystallized from water to provide 21.0 g (0.0916 mol) of desired Compound 5. The yield was 52%, and melting point thereof was from 183° C. to 185° C. (decompd.).

SYNTHESIS EXAMPLE 2

Synthesis of Compound 6

In 100 ml of ethanol were dissolved 10.0 g (0.104 mol) of imidazole-2-carboxyaldehyde and 2.98 g (0.0496 mol) of ethylenediamine and the hydrogenation was carried out at room temperature (10% Pd-C 1.0 g, $H_2$ 2 atms.). Then, after filtering away the catalyst, the solvent was distilled off under reduced pressure to about a half, and 52.7 g of concentrated hydrochloric acid was added thereto. Solids thus deposited were recovered by filtration and recrystallized from a mixed solvent of water, ethanol, and acetonitrile to provide 5.6 g (0.0426 mol) of desired Compound 6. The yield was 41%, and the melting point thereof was 255° C. to 57° C. (decompd.).

SYNTHESIS EXAMPLE 3

Synthesis of Compound 9

The compound was synthesized according to the method described in *Inorganic Chemistry*, 17, 2192(1978).

In 50 ml of ethanol were dissolved 1.9 g (0.020 mol) of imidazole-4-carboxyaldehyde and 1.3 g (0.010 mol) of diethylenetriamine and the hydrogenation was carried out at room temperature (10% Pd-C 0.5 g, $H_2$ 2 atms.). The catalyst was filtered away, and after the reaction, a hydrogen chloride gas was blown into the reaction mixture. Solids thus deposited were recovered by filtration and recrystallized from a mixed solvent of water and ethanol to provide 1.92 g (0.00431 mol) of desired Compound 9. The yield was 43%, and the melting point thereof was 231° C. to 232° C. (decompd.).

SYNTHESIS EXAMPLE 4

Synthesis of Compound 10

In 180 ml of ethanol was dissolved 36.0 g (0.15 mol) of bis(2-pyridinal)ethylenediimine synthesized according to the description of *Journal of the American Chemical Society*, 78, 1137 (1956), and the hydrogenation was carried out at room temperature (10% Pd-C, $H_2$ 3 atms.). After filtering away the catalyst, the solvent was distilled off under reduced pressure to about a half thereof, and then 80 g (0.790 mol) of concentrated hydrochloric acid was added thereto. Solids thus deposited were recovered by filtration and recrystallized from a mixed solvent of water and ethanol to provide 39.0 g (0.101 mol) of desired Compound 10. The yield was 67%, and the melting point thereof was 208° C. to 209° C. (decompd.).

SYNTHESIS EXAMPLE 5

Synthesis of Compound 12

The compound was synthesized according to the method described in *Journal of the American Chemical Society*, 87, 2385 (1965).

To 28.5 g (0.074 mol) of Compound 10 synthesized in Synthesis Example 4 was added 7.61 g (0.74 mol) of 50% sulfuric acid, and the mixture was cooled to 10° C. Then, after adding dropwise 13 ml (0.184 mol) of an aqueous 36% formaldehyde solution to the mixture at the same temperature, a 30% aqueous solution containing 7.61 g (0.148 mol) of sodium cyanide was gradually added thereto such that the reaction temperature became 5° C. to 10° C. After reacting for 24 hours at room temperature, the reaction mixture was concentrated under reduced pressure and after extracting with ethanol, ethanol was distilled off from the extract under reduced pressure to provide a viscous yellow liquid. After refluxing the yellow liquid together with concentrated hydrochloric acid for 10 hours, an excessive amount of sodium hydroxide was added thereto. The reaction mixture was concentrated under reduced pressure, ethanol was added to the concentrate, sodium chloride deposited was filtered away, ethanol was distilled off from the filtrate under reduced pressure. The concentrate thus formed was recrystallized from a mixed solvent of water and ethanol to provide 6.0 g (0.0151 mol) of desired compound 12. The yield was 22%.

SYNTHESIS EXAMPLE 6

Synthesis of Compound 55

In 50 ml of acetonitrile was suspended 10.3 g (0.0407 mol) of the acid anhydride of ethylenediaminetetraacetic acid (the synthesis method thereof was described in French Patent 1,548,888). While the suspension was stirred at room temperature, 40 ml of an acetonitrile solution containing 7.66 g (0.0814 mol) of 2-aminipyridine was added dropwise to the suspension. After the mixture was stirred for 2 hours at room temperature, solids deposited were recovered by filtration and recrystallized from water to provide 11.2 g (0.0269 mol) of desired Compound 55. The yield was 66%, and the melting point thereof was 215° C. to 216.5° C.

SYNTHESIS EXAMPLE 7

In 100 ml of water were suspended 3.96 g (0.036 mol) of 2-methyl-4-formyl imidazole, 3.57 g (0.030 mol) of iminodiacetic acid, and 1 g of 10% Pd-C. The suspension was pressed by hydrogen. After carrying out the reaction for 5 hours at room temperature, the catalyst was filtrated away with a zeolite, the filtrate was concentrated, and methanol was added thereto. Solids deposited were recovered by filtration and recrystallized from methanol to provide 4.27 g (0.0174 mol) of the dihydrate of desired Compound 61. The yield was 58%, and the melting point was 160.5° C. to 161.5° C.

SYNTHESIS EXAMPLE 8

Synthesis of Compound 62

In 400 ml of methanol were dissolved 19.3 g (0.20 mol) of imidazole-4-carboxyaldehyde and 6.0 g (0.10 mol) of ethylenediamine. By the same technique as in Synthesis Example 2, 17.1 g (0.0425 mol) of the dihydrate of desired Compound 62 was obtained. The yield was 43%, and the melting point thereof was 248° C. to 249° C. (decompd.).

SYNTHESIS EXAMPLE 9

Synthesis of Compound 63

In 400 ml of methanol were dissolved 23.1 g (0.210 mol) of 2-methyl-4-formylimidazole and 6.0 g (1.1 mol) of ethylenediamine. By the same technique as in Synthesis Example 2, 14.0 g (0.0355 mol) of desired Compound 63 was obtained. The yield was 36%, and the melting point was 244° C. to 246° C. (decompd.).

SYNTHESIS EXAMPLE 10

Synthesis of Compound 64

In 1 liter of methanol were suspended 42.3 g (0.44 mol) of imidazole-4-carboxyaldehyde, 6.0 g (0.10 mol) of ethylenediamine, and 1 g of 10% Pd-C. By following the same technique as in Synthesis Example 7, 28.0 g (0.0737 mol) of desired Compound 64 was obtained. The yield was 74%, and the melting point thereof was 102° C. to 104° C.

SYNTHESIS EXAMPLE 11

Synthesis of Compound 65

In 500 ml of methanol were suspended 50 g (0.526 mol) of pyrrole-2-carboxyaldehyde, 7.5 g (0.125 mol) of ethylenediamine, and 1 g of 10% Pd-C. By following the same technique as in Synthesis Example 7, 8.5 g (0.0226 mol) of desired Compound 65 was obtained. The yield was 18%, and the melting point thereof was 143° C. to 144° C.

SYNTHESIS EXAMPLE 12

Synthesis of Compound 70

In 50 ml of methanol were dissolved 5.3 g (0.0468 mol) of 2-formylthiazole and 1.3 g (0.0216 mol) of ethylenediamine. By following the same technique as in Synthesis Example 2, 1.2 g ($3.67\times10^{-3}$ mol) of desired Compound 70 was obtained. The yield was 17%, and the melting point thereof was 209° C. to 211° C. (decompd.).

SYNTHESIS EXAMPLE 13

Synthesis of Compound 19

In 200 ml of methanol was dissolved 14.7 g (0.153 mol) of imidazole-2-carboxyaldehyde and 6.78 g (0.0464 mol) of tris(2-aminoethyl)amine. By following the same technique as in Synthesis Example 2, 15.3 g (0.0232 mol) of the hexa-hydrochloridedihydrate of desired Compound 19 was obtained. The yield was 50% and the melting point thereof was 107° C. to 109° C.

SYNTHESIS EXAMPLE 14

Synthesis of Compound 71

In 100 ml of water were suspended 8.8 g (0.050 mol) of N,N'-diacetic acid ethylenediamine, 11.5 g (0.12 mol) of imidazole-4-carboxyaldehyde, and 1 g of 10% Pd-C. By following the same technique as in Synthesis Example 7, 7.4 g (0.022 mol) of desired Compound 71 was obtained. The yield was 44%, and the melting point thereof was 207° C. to 208° C. (decompd.).

The metal of the metal salt of the metal chelating compound of this invention is selected from the metals belonging to groups Ib, IIb, IIIb, IVb, Vb, VIb, VIIb, and VIII of the Periodic Table. Among these metals, Fe(III), Mn(III), Co(III), Rh(II), Rh(III), Au(II), Au(III), Cu(II), and Ce(IV) are preferred, Fe(III), Mn(III), and Ce(IV) are more preferred, and Fe(III) is particularly preferred.

The metal chelating compound of this invention be formed by reacting the compound shown by formula (I) described above and the foregoing metal salt such as ferric sulfate, ferric chloride, ferric nitrate, ammonium ferric sulfate, ferric phosphate, etc., in a solution and it may be used in situ. Alternatively, the metal chelating compound formed may be isolated and used.

The compound shown by formula (I) is present in a molar ratio of at least 1.0 to the metal ion. The ratio is preferably larger when the stability of the metal chelating compound is low. Usually the compound is present in a range of from 1 to 30 per mol of metal ion.

Examples of the metal chelating compound for use in this invention are shown below, but the invention is not limited to them.

1C

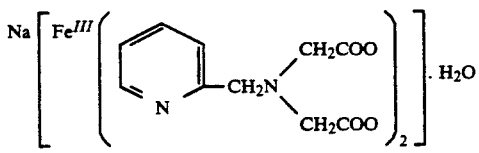

-continued

2C

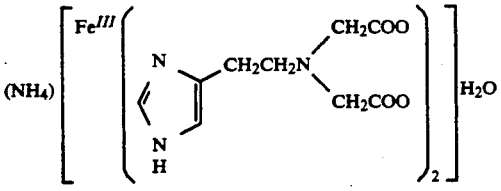

6C

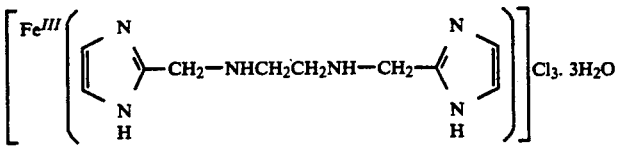

9C

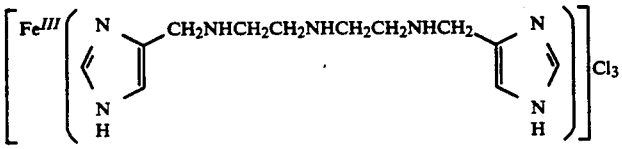

10C

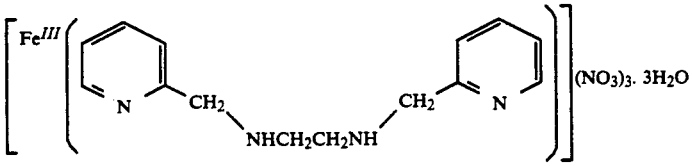

12C

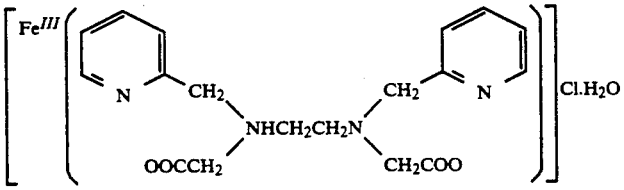

55C

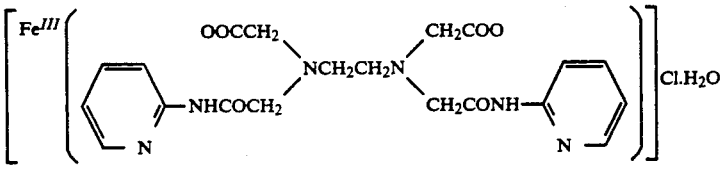

57C

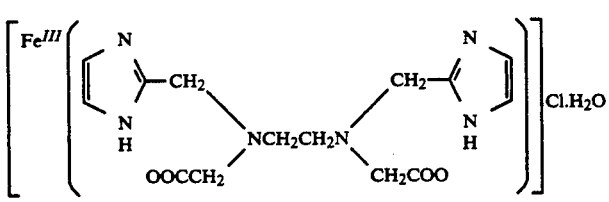

The metal chelating compound for use in this invention may be incorporated in a fix solution or an intermediate bath (e.g., a bleach acceleration bath or a control bath) between a color development step, and a desilvering step, in a small amount thereof. By incorporating the metal chelating compound into a processing solution in an amount of from 0.05 to 1 mol per liter of the processing solution, the compound is effective as a bleaching agent for a bleach solution or a blix solution.

A processing solution having a bleaching faculty (i.e., including a bleach solution and a blix solution) in a preferred embodiment is now explained.

It is effective to incorporate the metal chelating compound as a bleaching agent in a processing solution having a bleaching faculty in an amount of from 0.05 to 1 mol per liter of the processing solution as described above. It is more preferred that the content of the metal chelating compound is from 0.1 to 0.5 mol per liter of the processing solution.

In another embodiment of the present invention, it is preferable that the processing solution having bleaching faculty contains an organic acid in addition to the foregoing metal chelating compound.

Preferred examples of the organic acid for use in this invention are monobasic acids such as formic acid, acetic acid, propionic acid, glycolic acid, mono chloroacetic acid, monobromoacetic acid, monochloropropionic acid, lactic acid, pyruvic acid, acrylic acid, butyric acid, isobutyric acid, pivalic acid, aminobutyric acid, valeric acid, isovaleric acid, benzoic acid, monosubstituted benzoic acid (e.g., chlorobenzoic acid and hydroxybenzoic acid), nicotinic acid, etc.; amino acid series compounds such as asparagine, aspartic acid, alanine, arginine, ethionine, glycine, glutamine, cysteine, serine, methionine, leucine, etc.; dibasic acids such as oxalic acid, malonic acid, succinic acid, glutaric acid, tartaric acid, malic acid, oxaloacetic acid, phthalic acid, isophthalic acid, terephthalic acid, etc.; tribasic acids such as citric acid, etc.; sulfonic acids; sulfinic acids; imides; and aromatic sulfonamides although the organic acids for use in this invention are not limited to these compounds.

In the present invention, the organic acids having pKa of from 1.5 to 6.5 are preferable, and organic acids having a carboxy group and having pKa of from 2.0 to 5.5 are more preferable. Among these organic acids, monobasic acids are particularly preferable, and in particular, acetic acid and/or glycolic acid is most preferable.

In the present invention, the amount of organic acid is properly at least 0.05 mol per liter of the processing solution having a bleaching faculty or the replenisher therefor, preferably from 0.1 to 3.0 mols/liter, and more preferably from 0.3 to 2.0 mols/liter.

Also, these organic acids may be used singly or in a mixture thereof. Also, in place of the organic acid, the corresponding organic acid salt and an inorganic acid may be simultaneously used.

When the metal chelating compound for use in this invention is used as a bleaching agent for a processing solution having a bleaching faculty, other bleaching agents may be used together with the metal chelating compound. Such bleaching agents include Fe(III), Co(III), and Mn(III) chelate series bleaching agents of the compounds mentioned below, peroxodisulfates, hydrogen peroxide, bromates, etc.

The compounds forming the foregoing chelate series bleaching agents include ethylenediaminetetraacetic acid, disodium ethylenediaminetetraacetate, diammonium ethylenediaminetetraacetate, tetra(trimethylammonium) ethylenediaminetetraacetate, tetrapotassium ethylenediaminetetraacetate, tetrasodium ethylenediaminetetraacetate, trisodium ethylenediaminetetraacetate, diethylenetriaminepentaacetic acid, pentasodium diethylenetriaminepentaacetate, ethylenediamine-N-(β-oxyethyl)-N,N',N'-triacetic acid, trisodium ethylenediamine-N-(β-oxyethyl)-N,N',N'-triacetate, triammonium ethylenediamine-N-(β-oxyethyl)-N,N',N'-triacetate, 1,2-diaminopropanetetraacetic acid, disodium 1,2-diaminopropanetetraacetate, 1,3-diaminopropanetetraacetic acid, diammonium 1,3-diaminopropanetetraacetate, nitrilotriacetic acid, trisodium nitrilotriacetate, cyclohexanediaminetetraacetic acid, disodium cyclohexanediaminetetraacetate, iminodiacetic acid, dihydroxyethylglycine, ethyl ether diaminetetraacetic acid, glycol ether diaminetetraacetic acid, ethylenediaminetetrapropionic acid, phenylenediaminetetraacetic acid, 1,3-diaminopropanol-N,N,N',N'-tetramethylenephosphonic acid, ethylenediamine-N,N,N',N'-tetramethylenephosphonic acid, 1,3-propylenediamine-N,N,N',N'-tetramethylenephosphonic acid, etc., although the additional bleaching agents are not limited to these compounds.

The processing solutions having a bleaching faculty containing the metal chelating compound or the metal chelating compound and the organic acid according to the present invention further preferably contain a halide such as a chloride, a bromide, an iodide, etc., as a rehalogenating agent for accelerating the oxidation of silver. Instead of the halide, an organic ligand forming a sparingly soluble silver salt may be added to the processing solution.

The halide is added as an alkali metal salt, an ammonium salt, or an salt of guanidine, amine, etc. Examples of the halide include sodium bromide, ammonium bromide, potassium chloride, and guanidine hydrochloride. Ammonium bromide is preferable.

The amount of the rehalogenating agent for use in the bleach solution is from 0.1 to 2.0 mols/liter, and preferably from 0.3 to 1.7 mols/liter.

The blix solution, containing the metal chelating compound or the metal chelating compound and the organic acid according to this invention, further contains a fixing agent (described below) and, if necessary, can contain the foregoing rehalogenating agent. When the rehalogenating agent is used in the blix solution, the amount thereof is from 0.001 to 2.0 mol/liter, and preferably from 0.001 to 1.0 mol/liter.

The bleach solution or the blix solution for use in this invention further contains, if necessary, a bleach accelerator, a corrosion inhibitor for inhibiting corrosion of the process tank, a buffer for maintaining a desired pH of the solution, an optical whitening agent, a defoaming agent, etc.

Examples of the bleach accelerator include the compounds having a mercapto group or a disulfide group described in U.S. Pat. Nos. 3,893,858 and 1,138,842, German Patent 1,290,812, JP-A-53-95630, and Research Disclosure, No. 17129 (1978), thiazolidine derivatives described in JP-A-50-140129, thiourea derivatives described in U.S. Pat. No. 3,706,561, polyethylene oxides described in German Patent 2,748,430, polyamine compounds described in JP-B-45-8836 (the term "JP-B" as used herein means an "examined Japanese patent application"), and imidazole compounds described in JP-A-49-40493. Among these compounds, the mercapto compounds described in U.S. Pat. No. 1,138,842 are preferred.

Also, as the corrosion inhibitor, nitrates are preferably used, such as ammonium nitrate, potassium nitrate, etc. The addition amount thereof is preferably from 0.01 to 2.0 mol/liter, and more preferably from 0.05 to 0.5 mol/liter.

The pH of the bleach solution or the blix solution of this invention is from 2.0 to 8.0, and preferably from 3.0 to 7.5. When a bleach or blix is performed immediately after color development, it is better to use a processing solution at pH of not higher than 7.0, and preferably not higher than 6.4, to inhibit occurrence of bleach fog. Also, if the pH thereof is lower than 2.0, the metal chelating compound in this invention becomes unstable. Accordingly, the pH thereof is preferably from 2.0 to 6.4.

For keeping the pH of the processing solution having a bleaching faculty to the foregoing range, the above-described organic acid and an alkali agent (e.g., aqueous ammonia, potassium hydroxide, sodium hydroxide, imidazole, monoethanolamine, and diethanolamine) may be used together. Among these alkali agents, aqueous ammonia is preferable.

At the time of processing, it is preferable to apply aeration to the processing solution having a bleaching faculty to oxidize iron(II) complex salt formed, whereby the bleaching agent is regenerated and the photographic performance can be kept very stable.

The bleach step and/or the blix step is carried out at a temperature in the range of from 30° C. to 60° C., and preferably from 35° C. to 50° C.

In the case of processing color photographic materials for use in cameras, the processing time of the bleach step and/or the blix step is in the range of from 10 seconds to 7 minutes, preferably from 10 seconds to 2 minutes, and more preferably from 10 seconds to 30 seconds. Also, in the case of processing printing color photographic papers, the time is in the range of from 5 seconds to 70 seconds, preferably from 5 seconds to 60 seconds, and more preferably from 10 seconds to 45 seconds.

In these preferred processing conditions, good results, without an increase of stains, are obtained quickly.

For a fix solution or the blix solution, a fixing agent is used. As the fixing agent, there are thiosulfates, thiocyanates, thioethers, amines, mercapto compounds, thions, thioureas, iodides, etc.

Examples thereof include ammonium thiosulfate, sodium thiosulfate, potassium thiosulfate, guanidine thiosulfate, potassium thiocyanate, dihydroxyethyl thioether, 3,6-dithia-1,8-octandiol, and imidazole. Among these compounds, thiosulfates, in particular, ammonium thiosulfate are preferred for carrying out quick fixing.

Furthermore, by using two or more kinds of fixing agents, faster fixing can be carried out. For example, it is preferred to use ammonium thiosulfate together with ammonium thiocyanate, imidazole, thiourea, thioether, etc. In this case, the amount of the secondary fixing agent is preferably in the range of from 0.01 to 100 mol % to ammonium thiosulfate.

The amount of the fixing agent is from 0.2 to 3.0 mols, and preferably from 0.5 to 2.0 mols per liter of the fix solution or the blix solution. The pH of the fix solution depends upon the kind of fixing agent, but is generally from 3.0 to 9.0, and in particular when using a thiosulfate, the pH range of from 6.5 to 8.0 is preferable for obtaining a stable fixing faculty.

The fix solution and/or the blix solution can contain a preservative for increasing the stability of the solution over the passage of time.

In the case of a fix solution or a blix solution containing a thiosulfate as a fixing agent, a sulfite and/or hydroxylamine, hydrazine, or a bisulfite addition product of aldehyde (e.g., a bisulfite addition product of acetaldehyde, particularly preferably the bisulfite addition product of an aromatic aldehyde described in JP-A-1-298935) is effective as a preservative. Also, ; the sulfinic acid compounds described in JP-A-62-143048 are preferable preservatives.

Also, for keeping the pH of the fix solution and/or the blix solution at a constant value, a buffer is preferably added to the solution. Examples of the buffer include phosphates; imidazoles such as imidazole, 1-methyl-imidazole, 2-methyl-imidazole, 1-ethylimidazole, etc.; triethanolamine, N-allylmorpholine, and N-benzoylpyperazine.

Furthermore, by adding a chelating agent to the fix solution, iron ions carried from the bleach solution can be blocked to improve the stability of the solution.

Examples of the preferred chelating agent which is used for that purpose include 1-hydroxyethylidene-1,1-diphosphonic acid, ethylenediamine-N,N,N',N'-tetramethylenesulfonic acid, nitrilotrimethylenephosphonic acid, ethylenediaminetetraacetic acid, diethylenetriaminepentaacetic acid, cyclohexanediaminetetraacetic acid, and 1,2-propanediaminetetraacetic acid.

The fix step is carried out in a temperature within the range of from 30° C. to 60° C., and preferably from 35° C. to 50° C.

The time for the fix processing step is from 15 seconds to 2 minutes, and preferably from 25 seconds to 100 seconds, for a color photographic material for use in cameras, and from 8 seconds to 80 seconds, and preferably from 10 seconds to 45 seconds, for printing color photographic papers.

The desilvering step in this invention is carried out by the proper combination of a bleach step, a fix step, and a blix step. Typical examples of the combination are as follows:

(1) Bleach - fix,
(2) Bleach - blix,
(3) Bleach - blix - fix,
(4) Bleach - wash - fix,
(5) Blix,
(6) Fix - blix.

For processing color photographic materials for use in cameras, combinations (1), (2), (3), and (4) are preferred, and combinations (1), (2), and (3) are more preferred. For printing color photographic paper, combination (5) is preferred.

The process of the present invention can be also applied to desilvering processing, employing, for example, a stop bath, a wash bath, etc., after color development processing.

In the desilvering processing step of this invention, such as bleach processing, blix processing, and fix processing, it is preferable for obtaining the effect of this invention to stir the solution as strongly as possible.

Practical methods for strengthening stirring the solution include a process of striking the emulsion layer surface of a photographic light-sensitive material with jet streams of a processing solution described in JP-A-62-183460 and JP-A-62-183461, a process of increasing the stirring effect using a rotation means described in JP-A-62-183461, a process of improving the stirring effect by moving a photographic light-sensitive material while contacting the surface of the emulsion layer thereof with a wipe blade disposed in a solution to cause the disturbance of the stream of the processing solution on the surface of the emulsion layer, and a process of increasing the circulating amount of the whole processing solution.

Such stirring improvement means is effective for the bleach solution, the blix solution and the fix solution. It is believed that improvement of stirring hastens the supply of the bleaching agent and the fixing agent into the silver halide emulsion layers, which results in an increased desilvering speed.

Also, the foregoing stirring improvement means is effective in the case of using a bleach accelerator and by this means, the bleach accelerating effect can be remarkably increased and the fix obstructing action of the bleach accelerator can be removed.

It is preferable to use the foregoing strong stirring means for the color developer, wash water, and/or stabilization solution.

It is preferable that the processing process of the present invention is practiced with an automatic processor. The transporting method in such an automatic processor is described in JP-A-60-191257, JP-A-60-191258, and JP-A-60-191259. Also, for carrying out quick processing, it is preferable in an automatic processor, that the crossover between the processing tanks is shortened. An automatic processor wherein the crossover time is 5 seconds or shorter is described in JP-A-1-319038.

In the case of carrying out continuous processing using an automatic processor by the processing process of the present invention, it is preferable to supply each replenisher according to the amount of the photographic light-sensitive materials processed to replace the wasted processing components with processing the photographic light-sensitive materials and also to prevent the accumulation of undesirable components dissolved from the photographic light-sensitive materials in the processing solution.

Also, each processing step is carried out using two or more processing tanks. In this case, it is preferable to employ a countercurrent system of introducing the replenisher from the post-bath tank to the pre-bath tank. In particular, in a wash step or a stabilization step, a cascade system of from 2 to 4 stages is preferably employed.

The amount of the replenisher is preferably as small as possible, provided that the change of the composition in each processing solution does not have a bad influence on photographic performance or does not stain other processing solutions.

The amount of the replenisher for the color developer is from 100 ml to 3000 ml, and preferable from 100 ml to 2200 ml, per square meter of the photographic light-sensitive material in the case of a color photographic light-sensitive material for use in cameras and is from 20 ml to 500 ml, and preferably from 30 ml to 350 ml, per square meter of the photographic light-sensitive material in the case of printing color photographic paper.

The amount of the replenisher for the bleach solution is from 10 ml to 1000 ml, and preferably from 50 ml to 550 ml, per square meter of the photographic light-sensitive material in the case of a color photographic light-sensitive material for use in cameras. It is from 20 ml to 500 ml, and preferably from 50 ml to 300 ml, per square meter of the photographic light-sensitive material in the case of a printing color photographic paper.

The amount of the replenisher for the blix solution is from 200 ml to 3000 ml, and preferably from 250 ml to 1300 ml, per square meter of the photographic light-sensitive material in the case of a color photographic light-sensitive material for use in cameras and is from 20 ml to 300 ml, and preferably from 50 ml to 200 ml, per square meter of a printing color photographic paper. In this case, the replenisher for the blix solution may be replenished as one part liquid, may be replenished separately as a bleaching composition and a fixing composition, or the replenisher for the blix solution is prepared by mixing the overflow liquids from a bleach bath and/or a fix bath.

The amount of the replenisher for the fix solution is from 300 ml to 3000 ml, and preferably from 300 to 1200 ml, per square meter of the photographic light-sensitive material in the case of a color photographic material for use in cameras and is from 20 ml to 300 ml, and preferably from 50 ml to 200 ml, per square meter of the photographic light-sensitive material in the case of a printing color photographic paper.

The amount of the replenisher for wash water or a stabilization solution is from 1 to 50 times, preferably from 2 to 30 times, and more preferably from 2 to 15 times, the amount carried from the pre-bath per unit area.

For further reducing the amount of foregoing replenishers for environmental protection, it is also preferred to use a combination of various regeneration methods. Regeneration may be carried out while circulating each processing solution in an automatic processor. Or after recovering the processing solution from the processing bath, one may apply a proper regeneration treatment to the solution, and the processing solution thus generated may be supplied again to the processing tank as a replenisher.

The regeneration of a developer can be practiced by an ion-exchange treatment with an anion exchange resin, the removal of accumulations by an electrodialysis treatment, etc., and/or the addition of chemicals called regenerating agents. The regeneration ratio is preferably at least 50%, and more preferably at least 70%. As the anion exchange resin, a commercially available product can be used, and the high selective ion exchanger described in JP-A-63-11005 is preferably used.

The metal chelating bleaching agent in the bleach solution and/or the blix solution is changed to a reduced state by bleach processing. When the metal chelate in the reduced state accumulates, not only is the bleaching faculty lowered but also, as the case may be, the image-forming dyes become leuco dyes, which results in reduction of image density. Accordingly, it is preferable that the bleach solution and/or the blix solution employ a continuous regeneration method in cooperation with processing. Practically, it is preferable that air is blown into the bleach solution and/or the blix solution by means of an air pump to reoxidize or aerate the metal chelate in a reduced state with oxygen. Furthermore, regeneration can be also practiced by adding an oxidizing agent such as hydrogen peroxide, a persulfate, a bromate, etc.

Regeneration of the fix solution or the blix solution is carried out by electrolytically reducing accumulated silver ions. Also, it is preferred for maintaining the fixing faculty to remove the accumulated halogen ions with an anion exchange resin.

For reducing the amount of wash water, an ion exchange or an ultrafiltration is used, and the use of the ultrafiltration is particularly preferred.

The color developer used in this invention contains an aromatic primary amine color developing agent. Preferred examples thereof include p-phenylenediamine derivatives, specific examples of which are illustrated below, although the invention is not limited to them:

| | |
|---|---|
| D-1 | N,N-Diethyl-p-phenylenediamine |
| D-2 | 4-Amino-N,N-diethyl-3-methylaniline, |
| D-3 | 4-Amino-N-(β-hydroxyethyl)-N-methylaniline, |
| D-4 | 4-Amino-N-ethyl-N-(β-hydroxyethyl)-aniline, |
| D-5 | 4-Amino-N-ethyl-N-(β-hydroxyethyl)-3-methylaniline, |
| D-6 | 4-Amino-N-ethyl-N-(3-hydroxypropyl)-3-methylaniline, |
| D-7 | 4-Amino-N-ethyl-N-(4-hydroxybutyl)-3-methylaniline, |

-continued

| | |
|---|---|
| D-8 | 4-Amino-N-ethyl-N-(β-methanesulfonamidoethyl)methylaniline, |
| D-9 | 4-Amino-N,N-diethyl-3-(β-hydroxyethyl)-aniline, |
| D-10 | 4-Amino-3-ethyl-N-(β-methoxyethyl)-3-methylaniline, |
| D-11 | 4-Amino-N-(β-ethoxyethyl)-N-ethyl-3-methylaniline, |
| D-12 | 4-Amino-N-(3-carbamoylpropyl-N-n-propyl-3-methylaniline, |
| D-13 | N-Amino-N-(4-carbamoylbutyl-N-n-propyl-3-methylaniline, |
| D-14 | N-(4-Amino-3-methylphenyl)-3-hydroxypyrrolidine, |
| D-15 | N-(4-Amino-3-methylphenyl)-3-(hydroxymethyl)pyrrolidine, |
| D-16 | N-(4-Amino-3-methylphenyl)-3-pyrrolidinocarboxamide, and |
| D-17 | 4-Amino-N-ethyl-N-(β-hydroxyethyl)-3-methoxyaniline. |

Among the aforesaid p-phenylenediamine derivatives, compounds D-5, D-6, D-7, D-8, D-12, and D-17 are particularly preferred. Also, these p-phenylenediamine derivatives may be in the form of salts thereof with sulfuric acid, hydrochloric acid, sulfurous acid, naphthalenesulfonic acid, p-toluenesulfonic acid, etc.

The amount of the aromatic primary amine color developing agent is preferably from about 0.0002 mol to 0.2 mol, and more preferably from 0.001 to 0.1 mol, per liter of the color developer.

Also, the color developer can, if necessary, contain a sulfite such as sodium sulfite, potassium sulfite, sodium bisulfite, potassium bisulfite, sodium metasulfite, potassium sulfite, etc., or a carbonylsulfite addition product as a preservative.

As a compound for directly preserving the foregoing aromatic primary amine color developing agent, various hydroxylamines such as the compounds described in JP-A-63-5341 and JP-A-63-106655, are preferred. Among these compounds, compounds having a sulfo group or a carboxy group are more preferred. It is also preferred to add the hydroxamic acids described in JP-A-63-43138, the hydrazines and the hydrazides described in JP-A-63-146041, the phenols described in JP-A-63-44657 and JP-A-63-58443, the α-hydroxyketones and α-aminoketones described in JP-A-63-44656, and/or the various saccharide described in JP-A-63-36244.

Also, it is preferred to use, together with the foregoing compounds, the monoamines described in JP-A-63-4235, JP-A-63-24254, JP-A-63-21647, JP-A-63-146040, JP-A-63-27841, and JP-A-63-25654, the diamines described in JP-A-63-30845, JP-A-63-14640, and JP-A-63-43139, the polyamines described in JP-A-63-21647, JP-A-63-26655, and JP-A-63-44655, the nitroxyradicals described in JP-A-63-53551, the alcohols described in JP-A-63-43140 and JP-A-63-53549, the oximes described in JP-A-63-56654, or the tertiary amines described in JP-A-63-239447.

The color developer may contain, if necessary, the metals described in JP-A-57-44148 and JP-A-57-53749, the salicylic acids described in JP-A-59-180588, the alkanolamines described in JP-A-54-3532, the polyethyleneimines described in JP-A-56-94349, or the aromatic polyhydroxy compounds described in U.S. Pat. No. 3,746,544. In particular, the addition of the aromatic polyhydroxy compounds described above is preferred.

The addition amount of the preservative is from 0.005 to 0.2 mol, and preferably from 0.01 to 0.05 mol, per liter of the color developer.

The color developer used in this invention may have a pH range of from 9.0 to 12.0, and preferably from 9.5 to 11.5.

The color developer can further contain other known developer components.

For maintaining the aforesaid pH range, it is preferred to use various buffers. Examples of the buffer include sodium carbonate, potassium carbonate, sodium bicarbonate, potassium bicarbonate, tertiary sodium phosphate, tertiary potassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate). However, the invention is not limited to these compounds.

The addition amount of the buffer to the color developer is preferably at least 0.1 mol/liter, and particularly preferably from 0.1 to 0.4 mol/liter.

Moreover, the color developer can further contain various kinds of chelating agents as precipitation inhibitors for calcium and magnesium or for improving the stability of the color developer.

As the chelating agent, organic acid compounds are preferred. They include for example, aminopolycarboxylic acids, organic phosphonic acids, and phosphonocarboxylic acids. Specific examples thereof are nitrilotriacetic acid, diethylenetriaminepentaacetic acid, ethylenediaminetetraacetic acid, N,N,N-trimethylenephosphonic acid, ethylenediamine-N,N,N',N'-tetramethylenephosphonic acid, trans-cyclohexanediaminetetraacetic acid, 1,2-diaminopropanetetraacetic acid, hydroxyethyliminodiacetic acid, glycol ether diaminetetraacetic acid, ethylenediamine o-hydroxyphenylacetic acid, 2-phosphonobutane-1,2,4-tricarboxylic acid, 1-hydroxyethylidene-1,1-diphosphonic acid, and N,N'-bis(2-hydroxybenzyl)ethylenediamine-N,N'-diacetic acid.

If necessary, two or more of these chelating agents may be used.

The addition amount of the chelating agent is one sufficient for blocking the metal ions in the color developer, for example, from 0.001 to 0.05 mol, and preferably from 0.003 to 0.02 mol, per liter of the color developer.

The color developer can contain, if necessary, a development accelerator.

Examples of the development accelerator include the thioether compounds described in JP-B-37-16088, JP-B-37-5987, JP-A-38-7826, JP-A-44-12380, JP-A-45-9019, and U.S. Pat. No. 3,818,247, the p-phenylenediamine series compounds described in JP-A-52-49829 and JP-A-50-15554, the quaternary ammonium salts described in JP-A-50-137726, JP-B-44-30074, JP-A-56-156826, and JP-A-52-43429, the amine series compounds described in U.S. Pat. Nos. 2,494,903, 3,128,182, 4,230,796, 3,253,919, 2,482,546, 2,596,926, and 3,582,346, and JP-B-41-11431, the polyalkylene oxides described in JP-B-37-16088, JP-B-42-25201, JP-B-41-11431, and JP-B-42-23883, U.S. Pat. Nos. 3,128,183 and 3,532,501, and imidazoles such as 2-methylimidazole, imidazole, etc.

Also, the addition of 1-phenyl-3-pyrazolidones as an auxiliary developing agent is preferred for carrying out a quick development. The auxiliary developing agent include, for example, following compounds:

AD-1

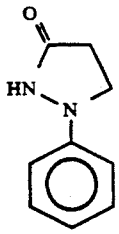

AD-2

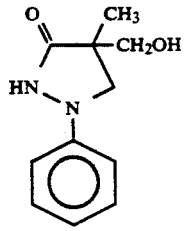

AD-3

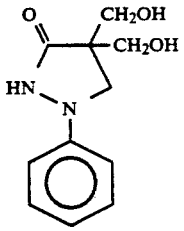

AD-4

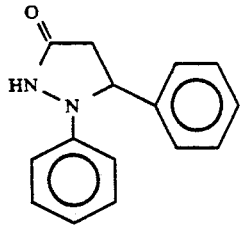

AD-5

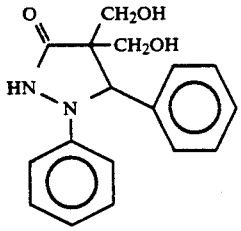

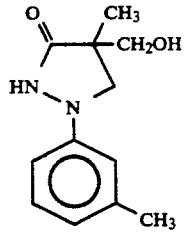

The addition amount of the auxiliary developing agent is from 0.0005 mol to 0.03 mol, and preferably from 0.001 to 0.01 mol, per mol of the color developer.

Furthermore, the color developer used in this invention can further contain, if necessary, an optional antifoggant. The antifoggants may be alkali metal halides such as sodium chloride, potassium bromide, potassium iodide, etc., or organic antifoggants.

Examples of the organic antifoggant include nitrogen-containing heterocyclic compounds such as benzotriazole, 6-nitrobenzimidazole, 5-nitroindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolizine, adenine, etc.

The color developer for use in this invention may further contain an optical whitening agent. As the optical whitening agent, 4,4'-diamino-2,2'-disulfostilbene series compounds are preferred. The addition amount thereof is from 0 to 5 g/liter, and preferably from 0.1 g to 4 g/liter.

Also, if necessary, the color developer may contain various kinds of surface active agents such as alkylsulfonic acids, arylsulfonic acids, aliphatic carboxylic acids, aromatic carboxylic acids, etc.

In this invention, the processing temperature with the color developer is from 20° C. to 55° C., and preferably from 30° C. to 55° C. The processing time is from 20 seconds to 5 minutes, preferably from 30 seconds to 3 minutes and 20 seconds, and more preferably from 1 minute to 2 minutes and 30 seconds.

The processing process of the present invention can be also used for color reversal processing. The black and white developer used in this case is a so-called black and white first developer which is used for ordinary known reversal processing of a color photographic light-sensitive material. Various additives which are well known for use with a black and white developer for processing black and white silver halide photographic material can be used for black and white first developer for color reversal photographic material.

Typical additives include a developing agent such as 1-phenyl-3-pyrazolidone, Metol, and hydroquinone; a preservative such as sulfites; an accelerator composed of an alkali such as sodium hydroxide, sodium carbonate, potassium carbonate, etc.; an inorganic or organic inhibitor such as potassium bromide, 2-methylbenzimidazole, methyl benzthiazole, etc.; a water softener such as polyphosphates; and a development inhibitor composed of a slight amount of an iodide or a mercapto compound.

The processing composition of the present invention fundamentally composed of the foregoing color development step and the subsequent desilvering step. It is preferred to employ a wash step and/or a stabilization step after the desilvering step.

Wash water used for the wash step can contain various kinds of surface active agents for preventing the occurrence of water drop unevenness when the color photographic materials are dried. The surface active agents include polyethylene glycol type nonionic surface active agents, polyhydric alcohol type nonionic surface active agents, alkylbenzenesulfonate type anionic surface active agents, higher alcohol sulfuric acid ester type anionic surface active agents, alkylnaphthalenesulfonate type anionic surface active agents, amine salt type cationic surface active agents, quarternary ammonium salt type cationic surface active agents, amino acid type amphoteric surface active agents, and betaine type amphoteric surface active agents.

However, since ionic surface active agents combine, as the case may be, with various ions entering with processing to form insoluble materials, a nonionic surface active agent is preferred and an alkylphenolethylene oxide addition product is particularly preferable. As the alkylphenol, octylphenol, nonylphenol, dodecylphenol and dinonylphenol are particularly preferred. The addition mol number of ethyleneoxide is particularly preferably from 8 to 14 moles. Furthermore, it is also preferred to use a silicone series surface active agent having a high defoaming effect.

Also, wash water can contain various anti-bacterial agents or antifungal agents for preventing the growth fungi in the photographic light-sensitive materials after processing and the growth of fur.

These antibacterial agents and antifungal agents include the thiazolylbenzimidazole series compounds as described in JP-A-57-157244 and JP-A-58-105145, the isothiazolone series compounds as described in JP-A-54-27424 and JP-A-57-8542, chlorophenol series compounds such as trichlorophenol, etc., bromophenol series compounds, organotin or organozinc compounds, thiocyanic or isothiocyanic acid compounds, acid amide series compounds, diazine or triazine series compounds, thiourea series compounds, benzotriazolealkylguanidine series compounds, quaternary ammonium salts such as benzammonium chloride, etc., antibiotics such as penicillin, etc., and the antifungal agents described in *Journal of Antibacterial and Antifungal Agents*, Vol. 11, No. 5, 207–223 (1983).

Also, the sterilizers described in JP-A-48-83820 can be used.

It is preferred that the wash water contains various chelating agents.

Examples of the preferred chelating agent include aminopolycarboxylic acids such as ethylenediaminetetraacetic acid, diethylenetriaminepentaacetic acid, etc.; organic phosphonic acids such as 1-hydroxyethylidene-1,1-diphosphonic acid, ethylenediamine-N,N,N',N'-tetramethylenephosphonic acid, etc.; and the hydrolyzed product of the maleic anhydride polymers described in European Patent 345172A1.

It is preferable that the above-described preservatives, which can be used for the fix solution or the blix solution, are incorporated in the wash water.

The stabilization solution which is used for the stabilization step is one for stabilizing dye images. For example, a liquid containing an organic acid and a buffer faculty of a pH from 3 to 6 or a liquid containing an aldehyde (e.g., formaldehyde and glutaraldehyde) can be used.

The stabilization solution can contain all the compounds which can be added to wash water and also contain, if necessary, ammonium compounds such as ammonium chloride, ammonium sulfite, etc.; compounds of a metal such as Bi, Al, etc.; optical whitening agents; the N-methylol compounds described in JP-A-2-153350, JP-A-2-153348, and U.S. Pat. No. 4,859,574; various kinds of stabilizers, hardening agents, and the alkanolamines described in U.S. Pat. No. 4,786,583, etc.

Also, in the wash step or the stabilization step, a multistage countercurrent is preferably used and the number of stages is preferably from 2 to 4 stages.

The amount of the replenisher is from 1 to 50 times, preferably from 2 to 30 times, and more preferably from 2 to 15 times, the amount carried from the pre-bath per unit area.

The water for the wash step or the stabilization step may be city water. But deionized water having Ca and Mg concentrations of less than 5 mg/liter with ion exchange resins and water sterilized with a halogen or an ultraviolet sterilizing lamp are preferably used.

Also, as water for replacing evaporated water, city water may be used. But preferred is the deionized water or sterilized water which is preferably used for the wash step or the stabilization step.

In this invention, it is preferred to offset the loss of the concentration of not only in the bleach solution or the blix solution but also in other processing solutions due to evaporation by supplying a proper amount of water, treated water, or each replenisher for each processing solution.

Introducing the overflow liquid from the wash step or the stabilization step to the prebath having a fixing faculty is preferably done for reducing the amount of waste liquids.

The color photographic light-sensitive material which is suitably processed by the process of this invention comprises a support having thereon at least one blue-sensitive emulsion layer, at least one green-sensitive emulsion layer, and at least one red-sensitive emulsion layer. There is no particular restriction on the number of the silver halide emulsion layers and insensitive layers, or the order of the emulsion layers.

A typical example thereof is a silver halide color photographic material having on a support a light-sensitive emulsion layer composed of several silver halide emulsion layers each having substantially same color sensitivity but having a different light-sensitivity. Each light-sensitive emulsion layer is a unit light-sensitive emulsion layer having a color sensitivity for blue light, green light, or red light. In a multilayer silver halide color photographic material, a red-sensitive emulsion layer, a green-sensitive emulsion layer, and a blue-sensitive emulsion layer are generally disposed on a support in this order from the support side. However, according to the purpose, another disposition order of the emulsion layers may be employed. Also possible is a layer disposition order in which an emulsion layer having a different color sensitivity is placed between emulsion layers having the same color sensitivity.

Also, as an interlayer between the foregoing silver halide emulsion layers, and as the uppermost layer and the lowermost layer, insensitive layers such as an interlayer, a protective layer, a subbing layer, etc., may be formed.

The foregoing layers may contain a coupler, a DIR compound, etc., as described in JP-A-61-43748, JP-A-59-113438, JP-A-59-113440, JP-A-61-20037, and JP-A-61-20038 and further may contain a color mixing inhibitor, an ultraviolet absorbent, a stain inhibitor, etc., which are commonly used.

As the multiple silver halide emulsion layers constituting each unit light-sensitive layer having the same color sensitivity, a two-layer constitution of a high-sensitive emulsion layer and a low-sensitive emulsion layer as described in West German Patent 1,121,470 and British Patent 923,045 is preferable. Usually, it is preferred that the emulsion layers are disposed in the order of subsequently lower sensitivity to the support side. Between the silver halide emulsion layers may formed an insensitive layer. Also, a low-sensitive emulsion layer may be disposed at the side far from the support and a high-sensitive emulsion layer may be disposed at the side near the support as described in JP-A-57-112751, JP-A-62-200350, JP-A-62-206541, and JP-A-62-206543.

For example, there are disposed from farthest side of the support a low-sensitive blue sensitive layer (BL), a high-sensitive blue-sensitive layer (BH), a high-sensitive green-sensitive layer (GH), a low-sensitive green-sensitive layer (GL), a high-sensitive red-sensitive layer (RH), and a low-sensitive red-sensitive layer (RL), and also the order of BH/BL/GL/GH/RH/RL, and the order of BH/BL/GH/GL/RL/RH.

A layer disposition of the order of a blue-sensitive layer/GH/RH/GL/RL from the farthest side of the support as described in JP-B-55-34932 (the term "JP-B" as used herein means an "examined Japanese patent publication") can be employed. Furthermore, a layer disposition of the order of a blue-sensitive layer/GL/RL/GH/RH from the farthest side of the support as described in JP-A-56-25738 and JP-A-62-63936 can be employed.

Also, there is a disposition of three emulsion layers composed of an upper highest light-sensitive silver halide emulsion layer, an intermediate-sensitive silver halide emulsion layer and a lower less sensitive silver halide emulsion layer disposed from the support side as described in JP-B-49-15495. Even in the case of three emulsion layers each having a different light-sensitivity, a light-sensitive layer unit having the same color sensitivity may be composed of the order of an intermediate-sensitive emulsion layer/a high-sensitive emulsion layer/a low-sensitive emulsion layer from the farthest side of the support as described in JP-A-59-202464.

As described above, various layer structures and dispositions can be selected according to the purpose of the particular color photographic light-sensitive material.

Any layer dispositions can be used in the color photographic light-sensitive materials being processed by the process of this invention. But in this invention, the dry layer thickness of all the layers, excluding the support of the color photographic material, the subbing layer and the back layer for the support, is preferably not thicker than 20.0 μm, and more preferably no thicker than 18.0 μm, in the case of a color photographic material for use in cameras and is preferably not thicker than 16.0 μm, and more preferably not thicker than 13.0 μm, in the case of printing color photographic paper for achieving the objects of this invention.

The foregoing layer thickness is determined by the color developing agent carried in these layers of the color photographic light-sensitive material during processing and after processing because the color developing agent remaining therein has a large influence on the bleach fog and also on the stains formed during the storage of color images after processing. In particular, the formation of bleach fog and stains is larger in the increase of magenta color which is considered to be caused by a green-sensitive emulsion layer than other increase of cyan color and yellow color.

In addition, it is desirable that the lower limit value in the definition of the layer thickness is selected so as not to reduce greatly the performance of the color photographic material. The lower limit of the dry layer thickness of all the layers, excluding the support of the color photographic material and the subbing layer and the back layer of the support, is about 12.0 μm in the case of a color photographic material for use in cameras and is about 7.0 μm in the case of a printing color photographic paper. In the case of the color photographic material for use in cameras, a layer (which may be several layers) is usually disposed between the light-sensitive emulsion layer nearest the support and the subbing layer on the support, and the lower limit of the dry thickness of the layer(s) is about 1.0 μm.

Also, the reduction of the layer thickness may be applied to any light-sensitive layers or light-insensitive layers.

The layer thickness of the multilayer color photographic light-sensitive material being processed in this invention is measured by the following method.

A color photographic material being measured is stored for 7 days under the conditions of 25° C. and 50% RH after the production of the light-sensitive material. First, the whole thickness of the light-sensitive material is measured, then after removing the coated layers on the support, the remaining thickness is measured. The difference between the two measurements is defined as the layer thickness of the whole coated layer of the light-sensitive material excluding the support.

The thickness can be measured by using, for example, a film thickness measuring device with a contact type piezo electron conversion element (K-402B Stand., trade name, manufactured by Anritsu Electric Co., Ltd.). In addition, the coated layers on the support can be removed using an aqueous solution of sodium hypochloride.

The sectional photograph of the foregoing light-sensitive material is photographed using a scanning electron microscope (the magnification is preferably 3,000 magnification or higher), the thickness of the whole layers on the support and the thickness of each layer are actually measured, and the thickness of each layer can be calculated by comparing these values with the measured value (the absolute value of the actually measured thickness) of the thickness of the whole layers by the foregoing film thickness measuring device.

The swelling ratio $[(A-B)/B\times 100$, wherein A is an equilibrium swelled layer thickness in water of 25° C. and B is the dry thickness of the whole layers at 25° C., 5%RH] of the color photographic light-sensitive material being processed in this invention is preferably from 50 to 200%, and more preferably from 70 to 150%.

If the swelling ratio is outside the foregoing range, the amount of the remaining color developing agent becomes large and such a swelling ratio has a bad influence on the properties of the layers, such as the photographic image quality (such as the photographic performance, the desilvering property, etc.) and the layer strength.

Furthermore, when 90% of the maximum swelled layer thickness of a color photographic light-sensitive material in a color developer (at 30° C., for 3 minutes and 15 sec.) is defined as the saturated swelled layer thickness, and the time for reaching ½ of the value is defined as swelling rate $T_{\frac{1}{2}}$. The swelling rate $T_{\frac{1}{2}}$ in the light-sensitive material being processed in this invention is preferably 15 seconds or lower, and more preferably 9 seconds or lower.

The silver halide contained in the photographic emulsions of the color photographic light-sensitive material being processed in this invention may have any silver halide composition. For example, the silver halide may be silver chloride, silver bromide, silver chlorobromide, silver iodobromide, silver iodochloride, or silver iodochlorobromide.

In the case of a color photographic material for use in cameras and a color reversal photographic material (e.g., a color negative photographic film, a color reversal photographic film, and a color reversal photographic paper), silver iodobromide, silver iodochloride, or silver iodochlorobromide containing from 0.1 to 30 mol % silver iodide is preferred. In the case of a direct positive color photographic material, silver bromide or silver chlorobromide is preferred, and also silver chloride is preferred for quick processing. In the case of a color photographic paper, silver chloride or silver chlorobromide is preferred and in particular, silver chlorobromide containing at least 80 mol %, more preferably at least 95 mol %, and most preferably at least 98 mol %.

The silver halide grains in the photographic silver halide emulsion for use in this invention may have a regular crystal form such as cubic, octahedral, tetradecahedral, etc., an irregular crystal form such as spherical, tabular, etc., or a crystal form having a crystal defect such as a twin plane, etc., or a composite form of these.

The silver halide grains may be fine grains having not larger than about 0.2 microns or may be large grains having up to about 10 microns as the diameter of the projected area. The silver halide emulsion for use in this invention may be a polydisperse emulsion or a monodisperse emulsion.

The silver halide photographic emulsion which can be used in this invention can be prepared using the methods described in *Research Disclosure* (RD), No. 17643, (December, 1978), pages 22 to 23, ibid., No. 307105 (November, 1989), pages 863–865 "Emulsion Preparation and Types", ibid., No. 18716 (November, 1979), page 648, P. Glafkides, *Chemie et Phisique Photographique*, published by Paul Montel, 1967, G. F. Duffin, *Photographic Emulsion Chemistry*, published by Focal Press, 1966, V. L. Zelikman et al, *Making and Coating Photographic Emulsion*, published by Focal Press, 1964, etc.

The monodisperse emulsions described in U.S. Pat. Nos. 3,574,628 and 3,655,394 and British Patent 1,413,748 can be also preferably used.

Also, in this invention, tabular silver halide grains having an aspect ratio of at least about 5 can be used. The tabular silver halide grains can be easily prepared by the methods described in Gutoff, *Photographic Science and Engineering*, Vol. 14, 248–257 (1970), U.S. Pat. Nos. 4,434,226, 4,414,310, 1,433,048, and 4,439,520, and British Patent 2,112,157.

The crystal structure may have a uniform halogen composition throughout the whole grain or may have a different halogen composition between the inside and the surface layer thereof. It may have a layer structure, or it may have a structure having a silver halide having a different composition epitaxially junctioned thereto or another compound than silver halide, such as silver rhodanide, zinc oxide, etc., junctioned thereto. Also, a mixture of silver halide grains having various crystal forms may be used.

A silver halide emulsion is usually physically ripened, chemically ripened, and spectrally sensitized.

Additives being used in these steps are described in *Research Disclosure*, No. 17643 (RD 17643), ibid., No. 18716, and ibid., No. 307105 and the corresponding passages are identified in the following table.

Also, other photographic additives which can be used in the invention are described in the foregoing three publications and related passages are shown in the same table.

| Additive | RD 17643 | RD 18716 | RD 307105 |
|---|---|---|---|
| 1. Chemical Sensitizer | p. 23 | p. 648, right column (RC) | p. 866 |

-continued

| Additive | RD 17643 | RD 18716 | RD 307105 |
|---|---|---|---|
| 2. Sensitizing Increasing Agent | — | p. 648, right column (RC) | — |
| 3. Spectral Sensitizer, Supersensitizer | pp. 23–24 | p. 648, RC to p. 649, RC | pp. 866–868 |
| 4. Optical Whitening Agent | p. 24 | p. 647, RC | p. 868 |
| 5. Antifoggant, Stabilizer | pp. 24–25 | p. 649, RC | pp. 868–870 |
| 6. Light Absorber, Filter Dye, Ultra violet Absorber | pp. 25–26 | p. 649, RC to P. 650, left column (LC) | p. 873 |
| 7. Stain Inhibitor | p. 25, RC | p. 650, LC to RC | p. 872 |
| 8. Dye Image Stabilizer | p. 25 | p. 650, LC | p. 872 |
| 9. Hardening Agent | p. 26 | p. 651, LC | pp. 874–875 |
| 10. Binder | p. 26 | p. 651, LC | pp. 873–874 |
| 11. Plasticizer, Lubricant | p. 27 | P. 650, RC | p. 876 |
| 12. Coating Aid, Surface Active Agent | pp. 26–27 | p. 650, RC | pp. 875–876 |
| 13. Antistatic Agent | p. 27 | p. 650, RC | pp. 876–877 |
| 14. Matting Agent | — | — | pp. 878–879 |

In this invention, various color couplers can be used and examples thereof are described in the patents described in *Research Disclosure*, No. 17643, VII-C to G and ibid., No. 307105, VII-C to G described above.

Preferred examples of the yellow coupler are described in U.S. Pat. Nos. 3,933,501, 4,022,620, 4,326,024, 4,401,752, and 4,248,961, JP-B-58-10739, British Patents 1,425,020 and 1,476,760, U.S. Pat. Nos. 3,973,968, 4,314,023, and 4,511,649, European Patent 249,473A, etc.

As the magenta coupler, the 5-pyrazolone series couplers and pyrazoloazole series couplers are preferred and preferred examples thereof are described in European Patent 73,636, U.S. Pat. Nos. 4,310,619, 4,351,897, 3,061,432, 3,725,064, 4,500,630, 4,540,654, and 4,556,630, *Research Disclosure*, No. 24220 (June, 1984), ibid., No. 24230 (June, 1984), JP-A-60-33552, JP-A-60-43659, JP-A-61-72238, JP-A-60-35730, JP-A-55-118034, JP-A-60-185951, and WO(PCT) 88/04795. The effect of this invention on bleach fog and stains is particularly remarkable with pyrazoloazole series couplers.

The cyan coupler include phenolic and naphtholic couplers and preferred examples thereof are described .in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, and 4,327,173, West German Patent Publication (unexamined) 3,329,729, European Patents 121 365A and 249,453A, U.S. Pat. Nos. 3,446,622, 4,333,999, 4,753,871, 4,451,559, 4,427,767, 4,690,889, 4,254,212, and 4,296,199, JP-A-61-42658.

As colored couplers for correcting unnecessary absorptions of colored dyes, the couplers described in *Research Disclosure*, No. 17643, VII-G, JP-B-57-39413, U.S. Pat. Nos. 4,163,670, 4,004,929, and 4,138,258, and British Patent 1,146,368 are preferred.

Also, the use of couplers for correcting unnecessary absorption of colored dyes by the fluorescent dyes released at coupling described in U.S. Pat. No. 4,774,181 and the couplers having a dye precursor group capable of forming a dye by reacting with a color developing agent as a releasable group described in U.S. Pat. No. 4,777,120 are preferable.

As a coupler forming a colored dye having a proper diffusibility, the couplers described in U.S. Pat. No.

4,366,237, British Patent 2,125,570, European Patent 96,570, and West German Patent Publication (unexamined) 3,234,533 are preferably used.

A polymerized dye-forming coupler can be also used in this invention. Typical examples of such a coupler are described in U.S. Pat. Nos. 3,451,820, 4,080,211, 4,367,282, 4,409,320, and 4,576,910, and British Patent 2,102,173.

Couplers releasing a photographically useful residue upon coupling can be also preferably used in this invention.

Preferred DIR couplers releasing a development inhibitor include the couplers described in the patents cited in foregoing *Research Disclosure*, No. 17643, Paragraph VII-F, JP-A-57-151944, JP-A-57-154234, JP-A-60-184248, and JP-A-63-37346, U.S. Pat. Nos. 4,248,962 and 4,782,012.

Preferred couplers which imagewise release a nucleating agent or a development accelerator at development, are the couplers described in British Patents 2,097,140 and 2,131,188, JP-A-59-157638 and JP-A-59-170840.

Other couplers which can be used for the color photographic light-sensitive materials being processed in this invention, are competing couplers described in U.S. Patent 4,130,427, poly-equivalent couplers described in U.S. Pat. Nos. 4,283,472, 4,338,393, and 4,310,618; DIR redox compound-releasing couplers, DIR coupler-releasing couplers, DIR coupler-releasing redox compounds, and DIR redox-releasing redox compounds described in JP-A-60-185950 and JP-A-62-24252, the couplers releasing a recoloring dye after being released described in European Patent No. 173,302A, bleach accelerator-releasing couplers described in *Research Disclosure*, No. 11449, ibid., No. 24241, and JP-A-61-201247, ligand-releasing couplers described in U.S. Pat. No. 4,553,477, couplers releasing a leuco dye described in JP-A-63-75747, and couplers releasing a fluorescent dye described in U.S. Pat. No. 4,774,181.

The couplers for use in this invention can be introduced into the color photographic light-sensitive materials by various known dispersion methods.

For example, an oil in-water dispersion method can be used and examples of a high-boiling solvent which is used in the foregoing dispersion method are described in U.S. Patent 2,322,027. Examples of high-boiling organic solvents having a boiling point of 175° C. or higher at normal pressure are phthalic acid esters [dibutyl phthalate, dicyclohexyl phthalate, di-2-ethylhexyl phthalate, decyl phthalate, bis(2,4-di-t-amylphenyl) phthalate, bis(2,4-di-t-amylphenyl) isophthalate, bis(1,1-diethylpropyl) phthalate, etc.]; phosphoric acid esters or phosphonic acid esters (triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate, di-2-ethylhexylphenyl phosphonate, etc.); benzoic acid esters (2-ethylhexyl benzoate, dodecyl benzoate, 2-ethylhexyl-p-hydroxy benzoate, etc.); amides (N,N-diethyldodecanamide, N,N-diethyllaurylamide, N-tetradecylpyrrolidone, etc.); alcohols and phenols (isostearyl alcohol, 2,4-di-tert-amylphenol, etc.); aliphatic carboxylic acid esters [bis(2-ethylhexyl) sebacate, dioctyl azerate, glycerol tributyrate, isostearyl lactate, trioctyl citrate, etc.); aniline derivatives (N,N-dibutyl-2-butoxy-5-tert-octylaniline, etc.); and hydrocarbons (paraffin, dodecylbenzene, diisopropylnaphthalene, etc.).

Also, as an auxiliary solvent, organic solvents having a boiling point of at least about 30° C., and preferably from 50° C. to about 160° C. can be used. Typical examples of them include ethyl acetate, butyl acetate, ethyl propionate, methyl ethyl ketone, cyclohexanone, 2-ethoxyethyl acetate, and dimethylformamide.

Also, a latex dispersion method can be employed for introducing the couplers into silver halide emulsions, and examples of the steps and the effect of the latex dispersion method and latexes for impregnation are described in U.S. Pat. No. 4,199,363, West German Patent Applications (OLS) 2,541,274 and 2,541,230.

Also, these couplers permeate a roadable latex polymer (described, e.g., in U.S. Pat. No. 4,203,716) in the presence or absence of the foregoing high-boiling organic solvent. The couplers can be dissolved in a polymer insoluble in water and soluble in an organic solvent, and they can be dispersed by emulsification in an aqueous hydrophilic colloid solution.

As such a polymer, the homopolymers or copolymers described in WO 88/00723 are preferably used. In particular, the use of acrylamide series polymers is preferred for color image stabilization, etc.

The proper supports which can be used in this invention are described, e.g., in *Research Disclosure*, No. 17643 and ibid., No. 18716, page 647, right column to page 648, left column.

The process of the present invention can be applied to various color photographic light-sensitive materials. Typical examples thereof are general cine color negative photographic films, color reversal photographic films for slide or television, color photographic papers, direct positive color photographic papers, color positive photographic films, and color reversal photographic papers. Color reversal photographic films may be of the so-called coupler-in-emulsion type or of the so-called coupler-in-developer type.

The following examples are intended to illustrate the present invention in more detail, but not to limit it in any way.

EXAMPLE 1

A multilayer color photographic material (Sample 101) having the layers of the compositions shown below on a cellulose triacetate film support having a subbing layer was prepared.

Compositions of the layer

The coated amount is shown by a g/m² unit shown by the amount of silver on a silver halide emulsion and colloidal silver, shown by a g/m² unit on couplers, additives and gelatin, and also shown by mol numbers per mol of the silver halide in the same layer on a sensitizing dye.

| | |
|---|---|
| Layer 1: Antihalation layer | |
| Black Colloidal Silver | 0.02 as silver |
| Gelatin | 2.20 |
| UV-1 | 0.11 |
| UV-2 | 0.20 |
| Cpd-1 | $4.0 \times 10^{-2}$ |
| Cpd-2 | $1.9 \times 10^{-2}$ |
| Solv-1 | 0.30 |
| Solv-2 | $1.2 \times 10^{-2}$ |
| Layer 2: Interlayer | |
| Fine Grain Silver Iodobromide (AgI 1.0 mol %, sphere-corresponding diameter 0.07 μm) | 0.15 |
| Gelatin | 1.00 |

-continued

| | |
|---|---|
| ExC-4 | $6.0 \times 10^{-2}$ |
| Cpd-3 | $2.0 \times 10^{-2}$ |
| layer 3: 1st Red-sensitive Emulsion Layer | |
| Silver Iodobromide Emulsion (AgI 5.0 mol %, surface high AgI type, sphere-corresponding diameter 0.9 μm, variation coeff. of sphere-corresponding diameters 21%, tabular grains, aspect ratio 7.5) | 0.42 as silver |
| Silver Iodobromide Emulsion (AgI 4.0 mol %, inside high AgI type, sphere-corresponding diameter 0.4 μm, variation coeff. of sphere-corresponding diameters 18%, tetradecahedral grains) | 0.40 as silver |
| Gelatin | 1.90 |
| ExS-1 | $4.5 \times 10^{-4}$ mol |
| ExS-2 | $1.5 \times 10^{-4}$ mol |
| ExS-3 | $4.0 \times 10^{-5}$ mol |
| ExC-1 | 0.65 |
| ExC-3 | $1.0 \times 10^{-2}$ |
| ExC-4 | $2.3 \times 10^{-2}$ |
| Solv-1 | 0.32 |
| Layer 4: 2nd Red-sensitive Emulsion Layer | |
| Silver Iodobromide emulsion (AgI 8.5 mol %, surface high AgI type, sphere-corresponding diameter 1.0 μm, variation coeff. of sphere-corresponding diameters 25%, tabular grains, aspect ratio 3.0) | 0.85 as silver |
| Gelatin | 0.91 |
| ExS-1 | $3.0 \times 10^{-4}$ mol |
| ExS-2 | $1.0 \times 10^{-4}$ mol |
| ExS-3 | $3.0 \times 10^{-5}$ mol |
| ExC-1 | 0.13 |
| ExC-2 | $6.2 \times 10^{-2}$ |
| ExC-4 | $4.0 \times 10^{-2}$ |
| Solv-1 | 0.10 |
| Layer 5: 3rd Red-sensitive Emulsion Layer | |
| Silver Iodobromide emulsion (AgI 11.3 mol %, inside high AgI type, sphere-corresponding diameter 1.4 μm, variation coeff. of sphere-corresponding diameters 28%, tabular grains, aspect ratio 6.0) | 1.50 as silver |
| Gelatin | 1.20 |
| ExS-1 | $2.0 \times 10^{-4}$ mol |
| ExS-2 | $6.0 \times 10^{-5}$ mol |
| ExS-3 | $2.0 \times 10^{-5}$ mol |
| ExC-2 | $8.5 \times 10^{-2}$ |
| ExC-5 | $7.3 \times 10^{-2}$ |
| Solv-1 | 0.12 |
| Solv-2 | 0.12 |
| Layer 6: Interlayer | |
| Gelatin | 1.00 |
| Cpd-4 | $8.0 \times 10^{-2}$ |
| Solv-1 | $8.0 \times 10^{-2}$ |
| Layer 7: 1st Green-Sensitive Emulsion Layer | |
| Silver Iodobromide emulsion (AgI 5.0 mol %, surface high AgI type, sphere-corresponding diameter 0.9 μm, variation coeff. of sphere-corresponding diameters 21%, tabular grains, aspect ratio 7.0) | 0.28 |
| Silver Iodobromide emulsion (AgI 4.0 mol %, inside high AgI type, sphere-corresponding diameter 0.4 μm, variation coeff. of sphere-corresponding diameters 18%, tetradecahedral grains) | 0.16 as silver |
| Gelatin | 1.20 |
| ExS-4 | $5.0 \times 10^{-4}$ mol |
| ExS-5 | $2.0 \times 10^{-4}$ mol |
| ExS-6 | $1.0 \times 10^{-4}$ mol |
| ExM-1 | 0.50 |
| ExM-2 | 0.10 |
| ExM-5 | $3.5 \times 10^{-2}$ |
| Solv-1 | 0.20 |
| Solv-3 | $3.0 \times 10^{-2}$ |
| Layer 8: 2nd Green-Sensitive Emulsion Layer | |
| Silver Iodobromide emulsion (AgI 8.5 mol %, inside high AgI type, sphere-corresponding diameter 1.0 μm, variation coeff. of sphere-corresponding diameters 25%, tabular grains, aspect ratio 3.0) | 0.57 as silver |
| Gelatin | 0.45 |
| ExS-4 | $3.5 \times 10^{-4}$ mol |
| ExS-5 | $1.4 \times 10^{-4}$ mol |
| ExS-6 | $7.0 \times 10^{-5}$ mol |
| ExM-1 | 0.12 |
| ExM-2 | $7.1 \times 10^{-3}$ |
| ExM-3 | $3.5 \times 10^{-2}$ |
| Solv-1 | 0.15 |
| Solv-3 | $1.0 \times 10^{-2}$ |
| Layer 9: Interlayer | |
| Gelatin | 0.50 |
| Solv-1 | $2.0 \times 10^{-2}$ |
| Layer 10: 3rd Green-Sensitive Emulsion Layer | |
| Silver Iodobromide emulsion (AgI 11.3 mol %, inside high AgI type, sphere-corresponding diameter 1.4 μm, variation coeff. of sphere-corresponding diameters 28%, tabular grains, aspect ratio 6.0) | 1.30 as silver |
| Gelatin | 1.20 |
| ExS-4 | $2.0 \times 10^{-4}$ mol |
| ExS-5 | $8.0 \times 10^{-5}$ mol |
| ExS-6 | $8.0 \times 10^{-5}$ mol |
| ExM-4 | $4.5 \times 10^{-2}$ |
| ExM-6 | $3.0 \times 10^{-2}$ |
| ExC-2 | $4.5 \times 10^{-3}$ |
| Cpd-5 | $1.0 \times 10^{-2}$ |
| Solv-3 | 0.25 |
| Layer 11: Yellow Filter Layer | |
| Gelatin | 0.50 |
| Cpd-6 | $5.2 \times 10^{-2}$ |
| Solv-1 | 0.12 |
| Layer 12: Interlayer | |
| Gelatin | 0.45 |
| Cpd-3 | 0.10 |
| Layer 13: 1st Blue-Sensitive Layer | |
| Silver Iodobromide emulsion (AgI 2 mol %, uniform AgI type, sphere-corresponding diameter 0.55 μm, variation coeff. of sphere-corresponding diameters 25%, tabular grains, aspect ratio 7.0) | 0.20 as silver |
| Gelatin | 1.00 |
| ExS-7 | $3.0 \times 10^{-4}$ mol |
| ExY-1 | 0.60 |
| ExY-2 | $2.3 \times 10^{-2}$ |
| Solv-1 | 0.15 |
| Layer 14: 2nd Blue-Sensitive Emulsion Layer | |
| Silver Iodobromide emulsion (AgI 19.0 mol %, inside high AgI type, sphere-corresponding diameter 1.0 μm, variation coeff. of sphere-corresponding diameters 16%, octahedral grains) | 0.19 as silver |
| Gelatin | 0.35 |
| ExS-7 | $2.0 \times 10^{-4}$ mol |
| ExY-1 | 0.22 |
| Solv-1 | $7.0 \times 10^{-2}$ |
| Layer 15: Interlayer | |
| Fine Grain Silver Iodobromide (AgI 2 mol %, uniform AgI type, sphere-corresponding diameter 0.12 μm) | 0.20 as silver |
| Gelatin | 0.36 |
| layer 16: 3rd Blue-Sensitive Emulsion Layer | |
| Silver Iodobromide emulsion (AgI 14.0 mol %, inside high AgI type, sphere-corresponding diameter 1.7 μm, variation coeff. of sphere-corresponding diameters 28%, tabular grains, aspect ratio 5.0) | 1.55 as silver |
| Gelatin | 1.00 |
| ExS-8 | $1.5 \times 10^{-4}$ mol |
| ExY-1 | 0.21 |
| Solv-1 | $7.0 \times 10^{-2}$ |
| layer 17: 1st Protective Layer | |

-continued

| | |
|---|---|
| Gelatin | 1.80 |
| UV-1 | 0.13 |
| UV-2 | 0.21 |
| Solv-1 | $1.0 \times 10^{-2}$ |
| Solv-2 | $1.0 \times 10^{-2}$ |
| layer 18: 2nd Protective Layer | |
| Fine Grain Silver Chloride (sphere-corresponding diameter 0.07 μm) | 0.36 as silver |
| Gelatin | 0.70 |
| B-1 (diameter: 1.5 μm) | $2.0 \times 10^{-2}$ |
| B-2 (diameter: 1.5 μm) | 0.15 |
| B-3 | $3.0 \times 10^{-2}$ |
| W-1 | $2.0 \times 10^{-2}$ |
| H-1 | 0.35 |

-continued

| | |
|---|---|
| Cpd-7 | 1.00 |

The sample further contained 1,2-benzisothiazolin-3-one (200 ppm is gelatin), n-butyl-p-hydroxybenzate (about 1,000 ppm in gelatin), and 2-phenoxy ethanol (about 10,000 ppm in gelatin). Moreover, the sample contained B-4, B-5, W-2, W-3, F-1, F-2, F-3, F-4, F-5, F-6, F-7, F-8, F-9, F-10, F-11, F-12, F-13, an iron salt, a lead salt, a gold salt, a platinum salt, an iridium salt, and a rhodium salt.

The compounds used for preparing the foregoing sample were as follows:

UV-1

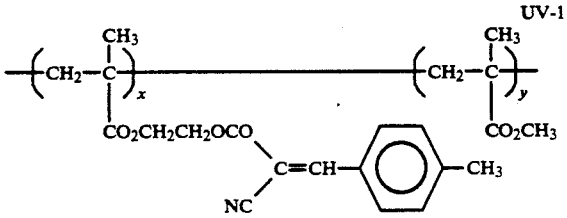

x/y = 7/3 (by weight)

UV-2

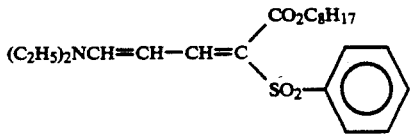

ExC-1

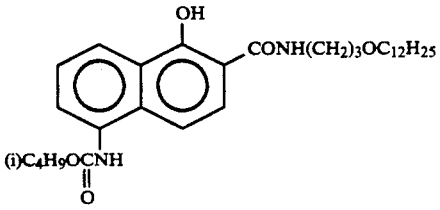

ExC-2

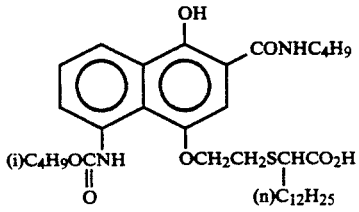

ExC-3

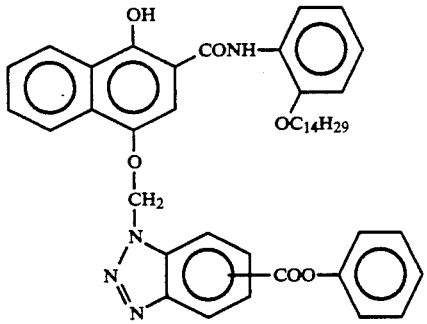

ExC-4

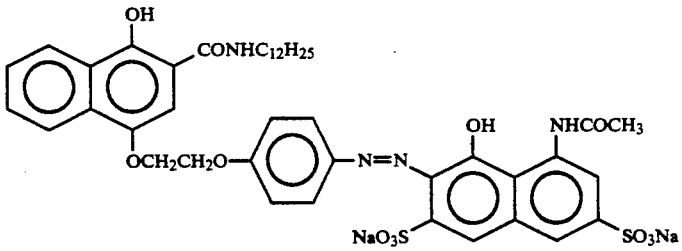

ExC-5

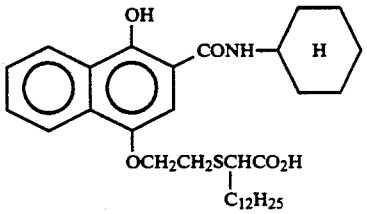

-continued
ExM-1
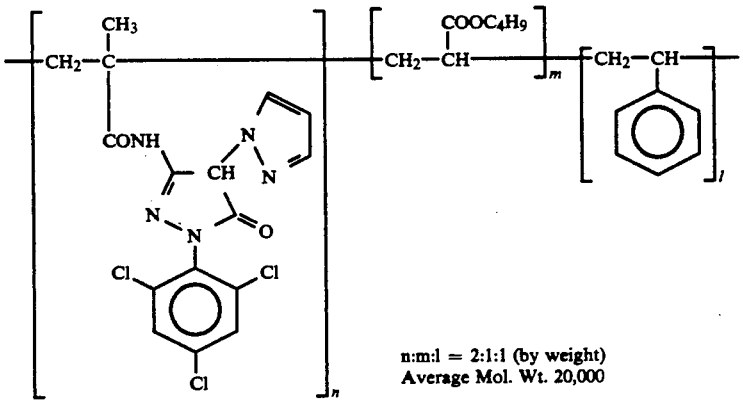
ExM-2
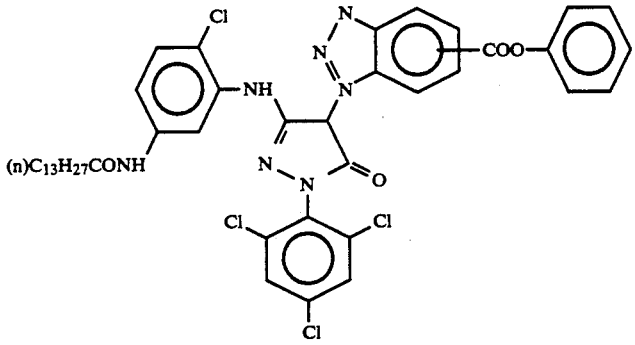
ExM-3
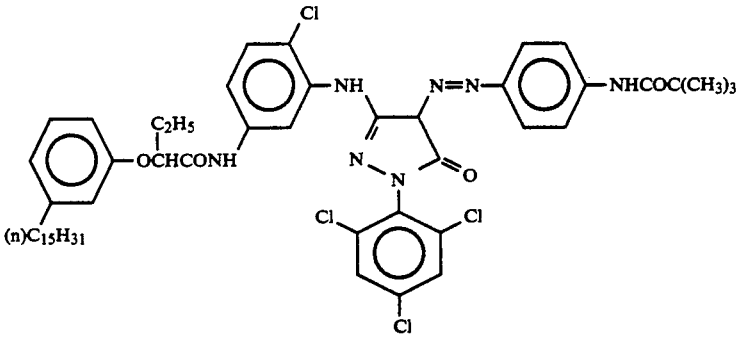
ExM-4
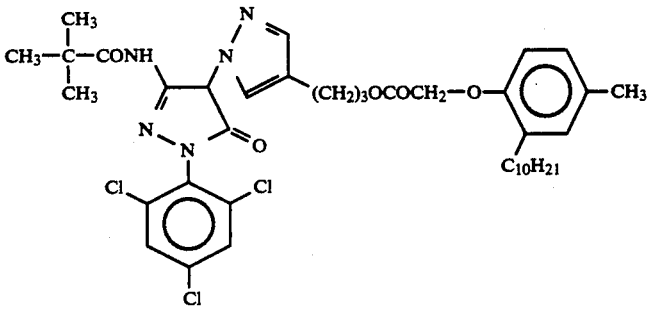

-continued
ExM-5
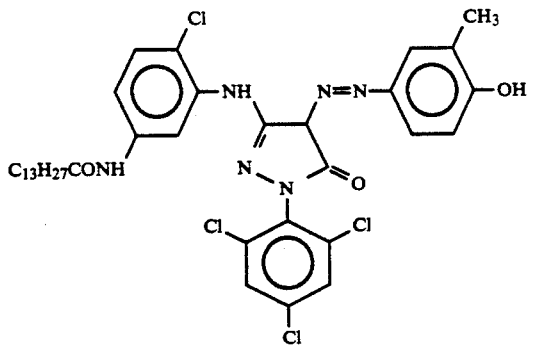
ExM-6
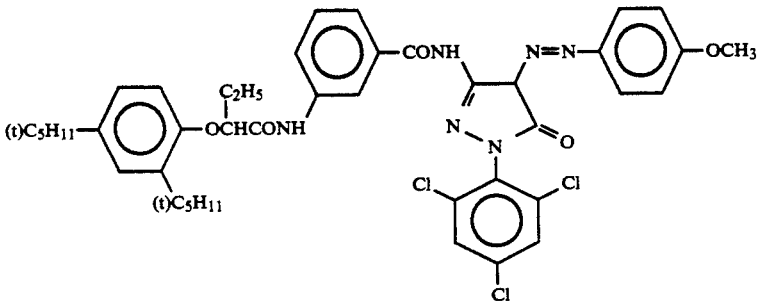
ExY-1
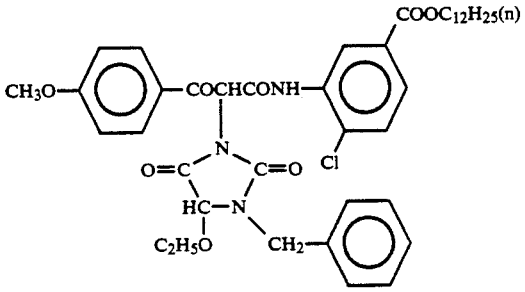
ExY-2
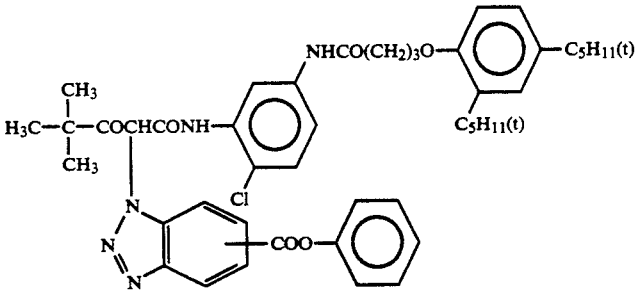
Cpd-1
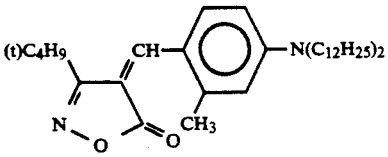
Cpd-2
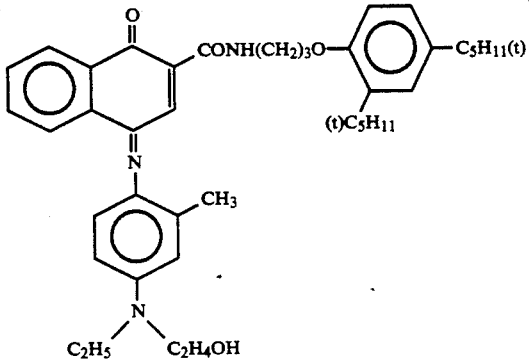

-continued
Cpd-3
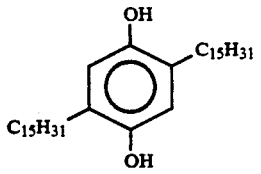
Cpd-4
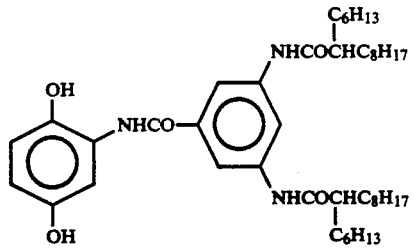
Cpd-5
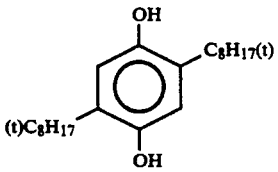
Cpd-6
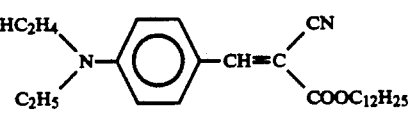
Cpd-7
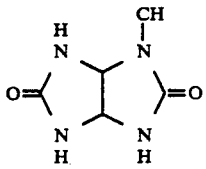
Solv-1
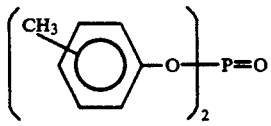
Solv-2
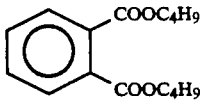
Solv-3
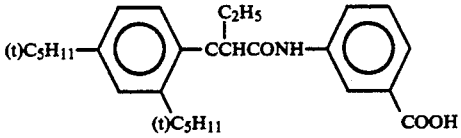
ExS-1
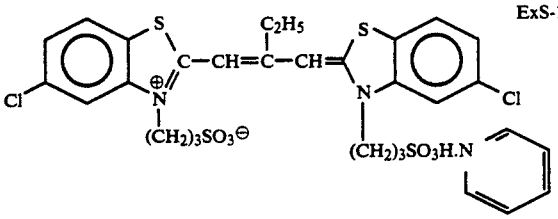
ExS-2
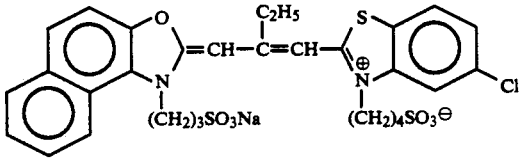
ExS-3
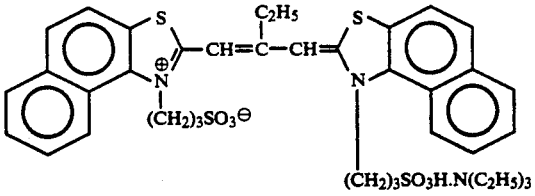
ExS-4
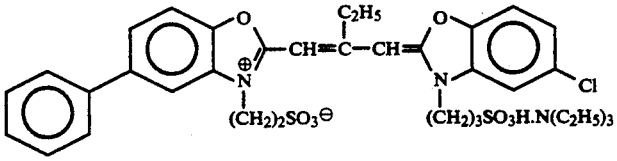
ExS-5
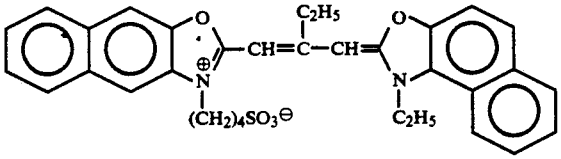

-continued
ExS-6
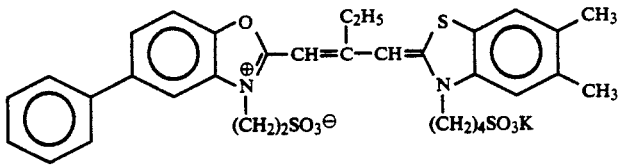
ExS-7
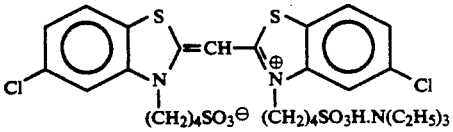
ExS-8
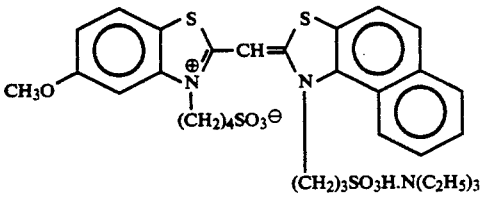
B-1
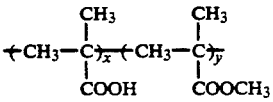
x/y = 10/90
B-2
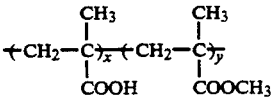
x/y = 40/60
B-3
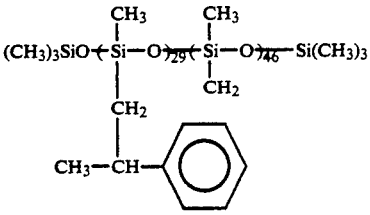
B-4
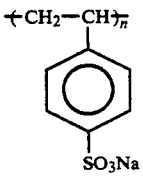
n = 100~3,000
B-5
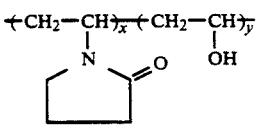
x/y = 70/30
W-1
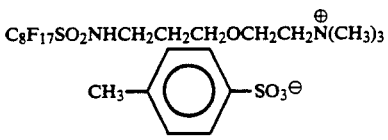
W-2
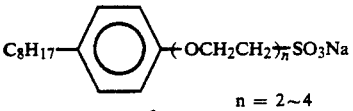
n = 2~4
W-3
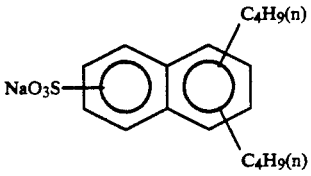
H-1
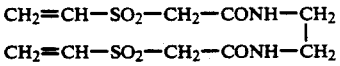
F-1'
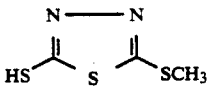
F-2'
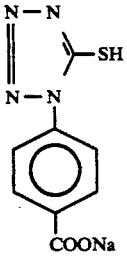
F-3'
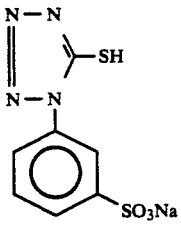
F-4'
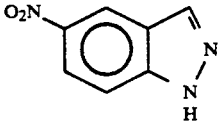
F-5
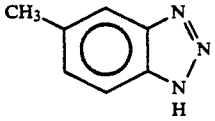

-continued

F-6

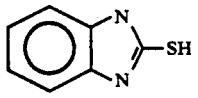

F-7

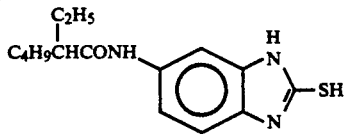

F-8

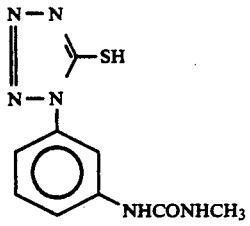

F-9

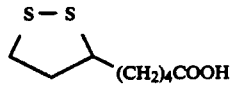

F-10

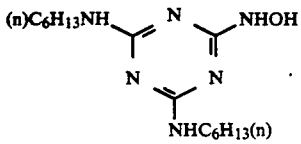

F-11

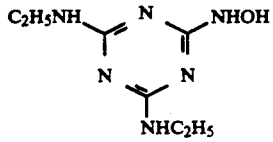

F-12

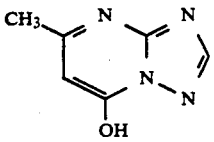

F-13

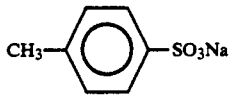

Sample 101, prepared above, was exposed to white light having a color temperature of 4800° K. through an optical wedge and then processed by the following processing steps.

For processing, a cine-type automatic processor was used, and processing was continued until the accumulated amount of each replenisher to each processing tank became 2.5 times the tank volume.

The processing faculty shown below was the result of processing carried out in this case. Also, a sub tank for the aeration of the bleach solution was attached to the bleach bath tank and operated while passing air of about 200 ml/min.

Then, processing steps are shown below were performed.

| Processing Steps | | | | |
|---|---|---|---|---|
| Step | Processing Time | Processing Temperature | Amount of Replenisher* | Tank Liquid |
| Color development | 3 min. 15 sec. | 38.0° C. | 23 ml | 15 liters |
| Bleach | 50 sec. | 38.0° C. | 5 ml | 5 liters |
| Blix | 50 sec. | 38.0° C. | — | 5 liters |
| Fix | 50 sec. | 38.0° C. | 16 ml | 5 liters |
| Wash (1) | 30 sec. | 38.0° C. | — | 3 liters |
| Wash (2) | 20 sec. | 38.0° C. | 34 ml | 3 liters |
| Stabilization | 20 sec. | 38.0° C. | 20 ml | 3 liters |
| Drying | 1 min. | ° C. | | |

*Amount per 35 mm × 1 meter.

The wash step was carried out by a counter-current system from wash (2) to wash (1), and overflow liquid of wash water was all introduced into the fix bath. The replenishment to the blix bath was carried out as follows. The upper portion of the bleach tank of the automatic processor was connected to the bottom of the blix tank by a pipe, and the upper portion of the fix tank was connected to the bottom of the blix tank by a pipe, whereby all of the overflow liquids formed by supplying the replenishers to the bleach tank and the fix tank are introduced into the blix bath. In addition, the carried amount of the color developer into the bleach step, the amdount of the bleach solution carried into the blix step, the amount ofthe blix solution carried into the fix step, and the amount of the fix solution carried into the wash step, were 2.5 ml, 2.0 ml, 2.0 ml, and 2.0 ml, respectively, per 35 mm×1 meter of the light-sensitive material.

Also, each crossover time was 5 seconds, and the time was included in the processing time of the prestep.

The composition of each processing solution is shown below.

| | Tank Liquid (g) | Replenisher (g) |
|---|---|---|
| Color Developer | | |
| Diethylenetriamine-pentaacetic Acid | 2.0 | 2.2 |
| 1-Hydroxyethylidene-1,1-diphosphonic Acid | 3.3 | 3.3 |
| Sodium Sulfite | 3.9 | 5.2 |
| Potassium Carbonate | 37.5 | 39.0 |
| Potassium Bromide | 1.4 | 0.4 |
| Potassium Iodide | 1.3 mg | — |
| Hydroxylamine Sulfate | 2.4 | 3.3 |
| 2-Methyl-4-[N-ethyl-N-(β-hydroxyethylamino]aniline sulfate | 4.5 | 6.1 |
| Water to make | 1.0 liter | 1.0 liter |
| pH | 10.05 10.15 | |
| Bleach Solution | | |
| Compound of Table 1 | 0.383 mol | 0.547 mol |
| Ferric Nitrate.$9H_2O$ | 0.365 mol | 0.521 mol |
| Ammonium Bromide | 84.0 | 120.0 |
| Ammonium Nitrate | 17.5 | 25.0 |
| Hydroxyacetic Acid | 63.0 | 90.0 |
| Acetic Acid | 33.2 | 47.4 |
| Water to make | 1.0 liter | 1.0 liter |

-continued

| | Tank Liquid (g) | Replenisher (g) |
|---|---|---|
| pH (adjusted with aqueous ammonia) | 3.60 | 2.80 |

A 15:85 mixture of the foregoing bleach tank liquid and the foregoing fix tank liquid.

| | Tank Liquid (g) | Replenisher (g) |
|---|---|---|
| Fix Solution | | |
| Ammonium sulfite | 19.0 | 57.0 |
| Aqueous Ammonium Thiosulfate solution (700 g/l) | 280 ml | 840 ml |
| Imidazole | 28.5 | 85.5 |
| Ethylenediaminetetra-acetic Acid | 12.5 | 37.5 |
| Water to make | 1.0 liter | 1.0 liter |
| pH (adjusted with aqueous ammonia and acetic acid) | 7.40 | 7.45 |
| Wash Water | Tank liquid = replenisher | |

Tap water was passed through a mixed bed column filled with an H-type strong acidic cation exchange resin (Amberlite IR-120B, trade name, made by Rohm and Haas) and an OH-type strong basic anion exchange resin (Amberlite IRA-400, trade name, made by Rohm and Haas Co.) to reduce the concentration of calcium and magnesium below 3 mg/liter. Then 20 mg/liter of sodium dichloroisocyanurate and 150 mg/liter of sodium sulfate were added thereto. The pH range of wash water was from 6.5 to 7.5.

| Stabilizing solution Tank liquid = replenisher | (unit g) |
|---|---|
| Formalin (37%) | 2.0 ml |
| Polyoxyehtylene-p-monononylphenyl ether (mean molecular degree 10) | 0.3 |
| Ethylenediaminetetraacetic Acid Disodium Salt | 0.05 |
| Water to make | 1.0 liter |
| pH | 5.0 to 8.0 |

On the light-sensitive material thus processed, the amount of residual silver in the highest density portion was measured by a fluorescent X-ray analysis method. The result is shown in Table 1 below. Also, the green (G) density of the Dmin portion was measured and the difference (bleach fog) from the Dmin portion of the sample processed by the standard bleach solution of the following composition having no bleach fog in place of the bleach solution of the automatic processor is shown in Table 1.

| Standard Bleach Solution | |
|---|---|
| Ethylenediaminetetraacetic Acid Ferric Sodium Trihydrate | 100 g |
| Ethylenediaminetetraacetic Acid Disodium Salt | 10 g |
| Ammonium Bromide | 100 g |
| Ammonium Nitrate | 30 g |
| Aqueous Ammonia (27%) | 6.5 ml |
| Water to make | 1.0 liter |
| pH | 6.0 |

Then, the sample thus processed was stored for 4 weeks at 60° C. and 70% RH and the increase of the G density of the Dmin portion was determined. The result obtained is also shown in Table 1 below.

TABLE 1

| No. | Compound | Amount of Remaining Silver (μg/cm²) | Bleach Fogg ΔDmin(G) | Increase of Stains with the passage of Time ΔDmin(G) | Remarks |
|---|---|---|---|---|---|
| 101 | Comparison Compound A | 14.1 | 0.00 | 0.30 | Comparison |
| 102 | Comparison Compound B | 0.8 | 0.09 | 0.15 | " |
| 103 | Comparison Compound C | 27.5 | 0.03 | 0.25 | " |
| 104 | Comparison Compound D | 16.2 | 0.01 | 0.38 | " |
| 105 | Present Compound 1 | 2.1 | 0.01 | 0.02 | Invention |
| 106 | Present Compound 2 | 1.5 | 0.01 | 0.02 | " |
| 107 | Present Compound 6 | 0.5 | 0.00 | 0.03 | " |
| 108 | Present Compound 9 | 0.8 | 0.01 | 0.02 | " |
| 109 | Present Compound 10 | 1.4 | 0.00 | 0.02 | " |
| 110 | Present Compound 12 | 1.2 | 0.01 | 0.03 | " |
| 111 | Present Compound 43 | 2.8 | 0.03 | 0.05 | " |
| 112 | Present Compound 55 | 1.0 | 0.00 | 0.01 | " |
| 113 | Present Compound 57 | 0.9 | 0.00 | 0.01 | " |
| 114 | Present Compound 71 | 0.5 | 0.00 | 0.01 | " |

Comparison Compound A: Ethylenediaminetetraacetic Acid
Comparison Compound B: 1,3-Diaminopropanetetraacetic Acid
Comparison Compound C: Nitrilotriacetic Acid
Comparison Compound D: Cyclohexanediaminetetraacetic Acid From the results shown in Table 1, it can be seen that the processing solution having a bleaching faculty containing the metal chelating compound according to this invention can reduce the amount of remaining silver (as compared to the processing solution containing the comparison compound) and scarcely gives bleach fog and the increase of stains after processing, i.e., shows an excellent performance.

EXAMPLE 2

A multilayer color photographic light-sensitive material (Sample 201) was prepared by multilayer-coating each having the following composition on a cellulose triacetate film support having a subbing layer.

Compositions of the layers

The numeral for each component shows the coated amount shown by a g/m$^2$ unit, wherein the coated amount for a silver halide emulsion and colloidal silver is the value calculated as silver and for a sensitizing dye is the value shown by mol unit to mol of the silver halide in the same layer.

| | |
|---|---|
| Layer 1: Antihalation layer | |
| Black Colloidal Silver | 0.18 as silver |
| Gelatin | 1.40 |
| Layer 2: Interlayer | |
| 2,5-Di-t-pentadecylhydroquinone | 0.18 |
| EX-1 | 0.070 |
| EX-3 | 0.020 |
| EX-12 | $2.0 \times 10^{-3}$ |
| U-1 | 0.060 |
| U-2 | 0.080 |
| U-3 | 0.10 |
| HBS-1 | 0.10 |
| HBS-2 | 0.020 |
| Gelatin | 1.04 |
| Layer 3: 1st Red-Sensitive Emulsion Layer | |
| Emulsion A | 0.25 as silver |
| Emulsion B | 0.25 as silver |
| Sensitizing Dye I | $6.9 \times 10^{-5}$ |
| Sensitizing Dye II | $1.8 \times 10^{-5}$ |
| Sensitizing Dye III | $3.1 \times 10^{-4}$ |
| EX-2 | 0.34 |
| EX-10 | 0.020 |
| U-1 | 0.070 |
| U-2 | 0.050 |
| U-3 | 0.070 |
| HBS-1 | 0.060 |
| Gelatin | 0.87 |
| Layer 4: 2nd Red-Sensitive Emulsion Layer | |
| Emulsion C | 1.00 as silver |
| Sensitizing Dye I | $5.1 \times 10^{-5}$ |
| Sensitizing Dye II | $1.4 \times 10^{-5}$ |
| Sensitizing Dye III | $2.3 \times 10^{-4}$ |
| EX-2 | 0.40 |
| EX-3 | 0.050 |
| EX-10 | 0.015 |
| U-1 | 0.070 |
| U-2 | 0.050 |
| U-3 | 0.070 |
| Gelatin | 1.30 |
| Layer 5: 3rd Red-Sensitive Emulsion Layer | |
| Emulsion D | 1.60 as silver |
| Sensitizing Dye I | $5.4 \times 10^{-5}$ |
| Sensitizing Dye II | $1.4 \times 10^{-5}$ |
| Sensitizing Dye III | $2.4 \times 10^{-4}$ |
| EX-2 | 0.097 |
| EX-3 | 0.010 |
| EX-4 | 0.080 |
| HBS-1 | 0.22 |
| HBS-2 | 0.10 |
| Gelatin | 1.63 |
| Layer 6: Interlayer | |
| EX-5 | 0.040 |
| HBS-1 | 0.020 |

-continued

| | |
|---|---|
| Gelatin | 0.80 |
| Layer 7: 1st Green-Sensitive Emulsion Layer | |
| Emulsion A | 0.15 as silver |
| Emulsion B | 0.15 as silver |
| Sensitizing Dye IV | $3.0 \times 10^{-5}$ |
| Sensitizing Dye V | $1.0 \times 10^{-4}$ |
| Sensitizing Dye VI | $3.8 \times 10^{-4}$ |
| EX-1 | 0.021 |
| EX-6 | 0.26 |
| EX-7 | 0.030 |
| EX-8 | 0.025 |
| HBS-1 | 0.10 |
| HBS-3 | 0.010 |
| Gelatin | 0.63 |
| Layer 8: 2nd Green-Sensitive Emulsion Layer | |
| Emulsion C | 0.45 as silver |
| Sensitizing Dye IV | $2.1 \times 10^{-5}$ |
| Sensitizing Dye V | $7.0 \times 10^{-5}$ |
| Sensitizing Dye VI | $2.6 \times 10^{-4}$ |
| EX-6 | 0.094 |
| EX-7 | 0.026 |
| EX-8 | 0.018 |
| HBS-1 | 0.16 |
| HBS-3 | $8.0 \times 10^{-3}$ |
| Gelatin | 0.50 |
| Layer 9: 3rd Green-Sensitive Emulsion Layer | |
| Emulsion E | 1.20 as silver |
| Sensitizing IV | $3.5 \times 10^{-5}$ |
| Sensitizing V | $8.0 \times 10^{-5}$ |
| Sensitizing VI | $3.0 \times 10^{-4}$ |
| EX-1 | 0.025 |
| EX-11 | 0.10 |
| EX-13 | 0.015 |
| HBS-1 | 0.25 |
| HBS-2 | 0.10 |
| Gelatin | 1.54 |
| Layer 10: Yellow Filter Layer | |
| Yellow Colloidal Silver | 0.050 as silver |
| EX-5 | 0.080 |
| HBS-1 | 0.030 |
| Gelatin | 0.95 |
| Layer 11: 1st Blue-Sensitive Emulsion Layer | |
| Emulsion A | 0.080 as silver |
| Emulsion B | 0.070 as silver |
| Emulsion F | 0.070 as silver |
| Sensitizing VII | $3.5 \times 10^{-4}$ |
| EX-8 | 0.042 |
| EX-9 | 0.72 |
| HBS-1 | 0.28 |
| Gelatin | 1.10 |
| Layer 12: 2nd Blue-Sensitive Emulsion Layer | |
| Emulsion G | 0.45 as silver |
| Sensitizing Dye VII | $2.1 \times 10^{-4}$ |
| EX-9 | 0.15 |
| EX-10 | $7.0 \times 10^{-3}$ |
| HBS-1 | 0.050 |
| Gelatin | 0.78 |
| Layer 13: 3rd Blue-Sensitive Emulsion Layer | |
| Emulsion H | 0.77 as silver |
| Sensitizing Dye VII | $2.2 \times 10^{-4}$ |
| EX-9 | 0.20 |
| HBS-1 | 0.070 |
| Gelatin | 0.69 |
| Layer 14: 1st Protective Layer | |
| Emulsion I | 0.20 as silver |
| U-4 | 0.11 |
| U-5 | 0.17 |
| HBS-1 | $5.0 \times 10^{-2}$ |
| Gelatin | 1.00 |
| Layer 15: 2nd Protective Layer | |
| H-1 | 0.40 |
| B-1 (diameter: 1.7 μm) | $5.0 \times 10^{-2}$ |
| B-2 (diameter: 1.7 μm) | 0.10 |
| B-3 | 0.10 |
| S-1 | 0.20 |
| Gelatin | 1.20 |

Furthermore the sample contained compounds W-1 W-2, W-3, B-4, B-5, F-1, F-2, F-3, F-4, F-5, F-6, F-7, F-8, F-9, F-10, F-11, F-13, and F-13 and also an iron salt, a lead salt, a gold salt, a platinum salt, an iridium salt, and a rhodium salt for improving the storage stability, the processing property, the pressure resistance, the antifungal and antibacterial property, the antistatic property, and the coating property.

The silver halide emulsions used in this ample are shown in the following table.

| | Mean AgI Content (%) | Mean Grain Size (μm) | Variation Coefficient of the Grain Sizes (%) | Aspect Ratio | Silver Weight Ratio (AgI Content %) |
|---|---|---|---|---|---|
| Emulsion | | | | | |
| A | 4.0 | 0.45 | 27 | 1 | Core/Shell = 1/3 (13/1), Double Layer Structure Grains |
| B | 8.9 | 0.70 | 14 | 1 | Core/Shell = 3/7 (25/2), Double Layer Structure Grains |
| C | 10 | 0.75 | 30 | 2 | Core/Shell = 1/2 (24/3), Double Layer Structure Grains |
| D | 16 | 1.05 | 35 | 2 | Core/Shell = 4/6 (40/0), Double Layer Structure Grains |
| E | 10 | 1.05 | 35 | 3 | Core/Shell = 1/2 (24/3), Double Layer Structure Grains |
| F | 4.0 | 0.25 | 28 | 1 | Core/Shell = 1/3 (13/1), Double Layer Structure Grains |
| G | 14.0 | 0.75 | 25 | 2 | Core/Shell = 1/2 (42/0), Double Layer Structure Grains |
| H | 14.5 | 1.30 | 25 | 3 | Core/Shell = 37/63 (34/3), Double Layer Structure Grains |
| I | 1 | 0.07 | 15 | 1 | Uniform Grains |

Additional compounds used for the above-described sample are shown below. The additives H-1, B-1 to B-5, W-1 to W-3, and F-1 to F-13 were the same as those used in Example 1.

EX-1

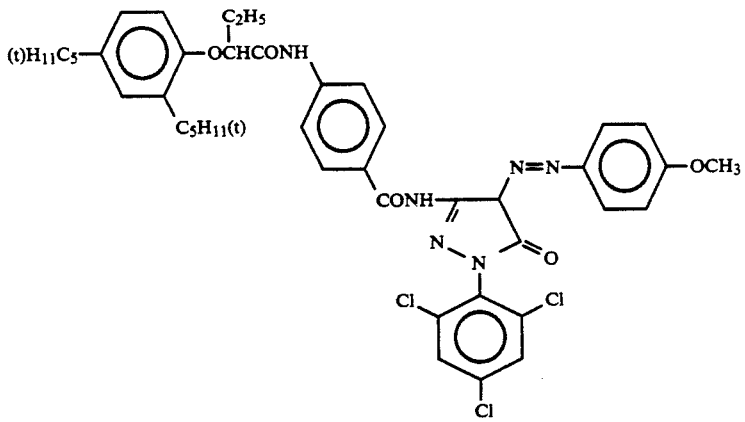

EX-2

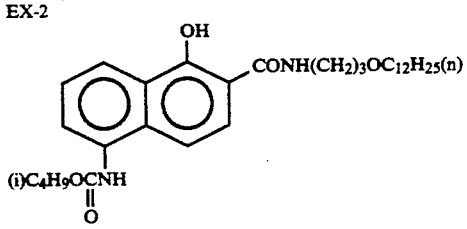

EX-3

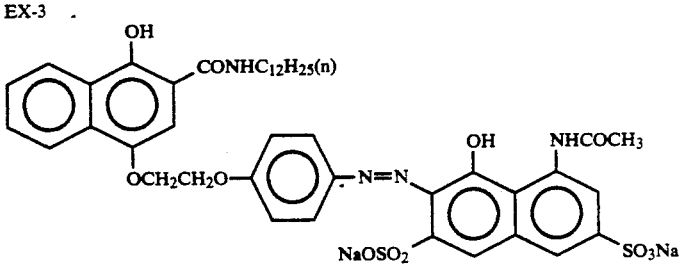

-continued
EX-4
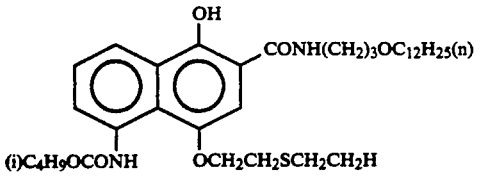
EX-5
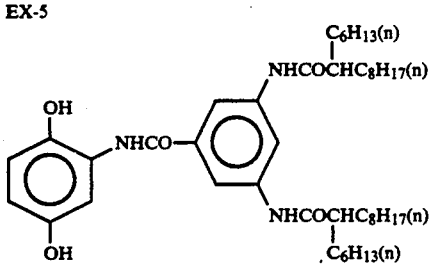
EX-6
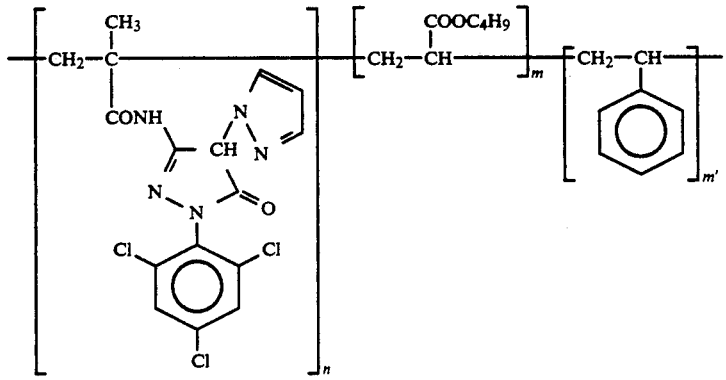
n = 50
m = 25
m' = 25
mol. wt. about 20,000
EX-7
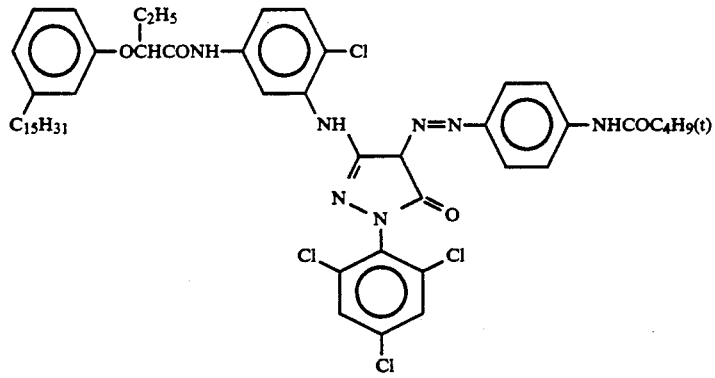
EX-8
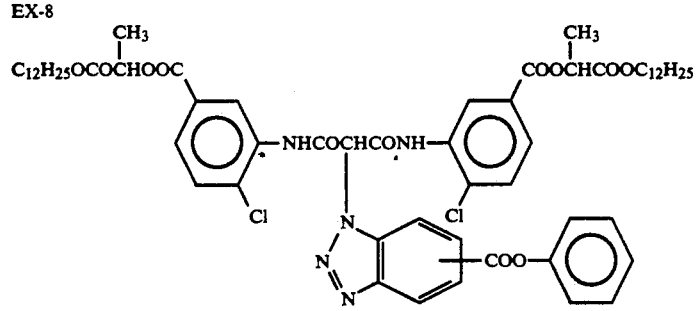

-continued
EX-9
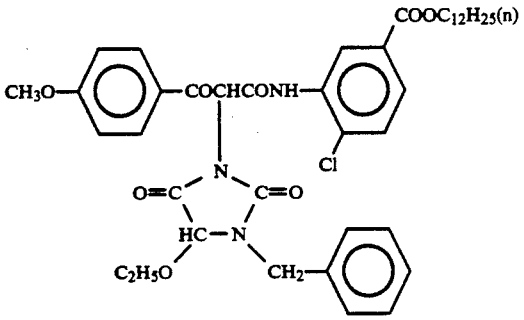
EX-10
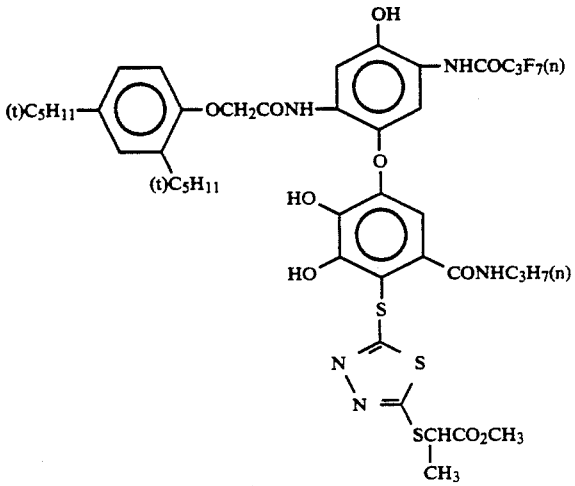
EX-11
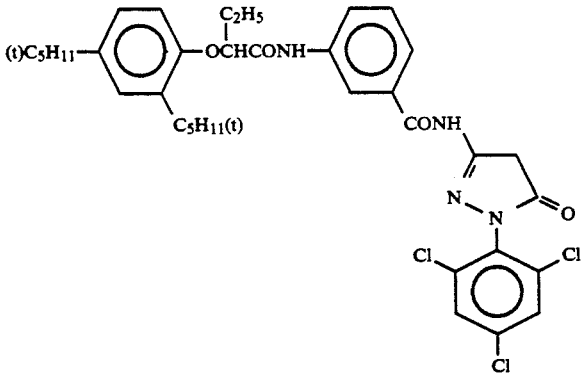
EX-12
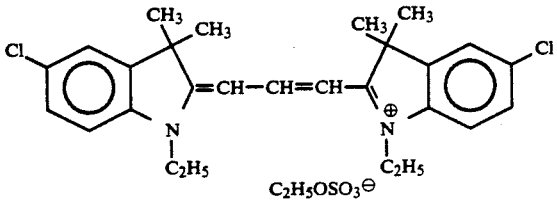
EX-13

-continued
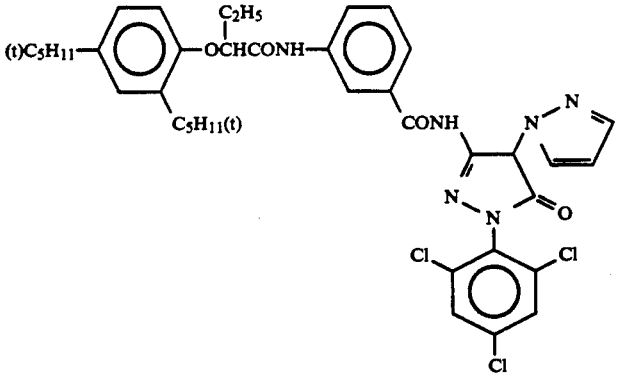
U-1
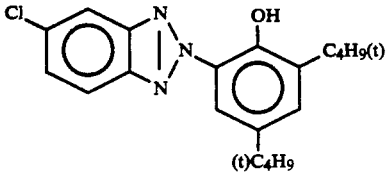
U-2
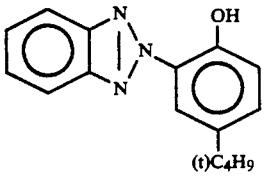
U-3
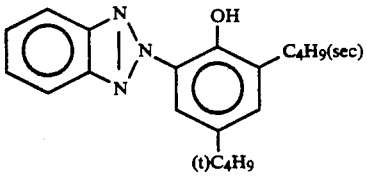
U-4
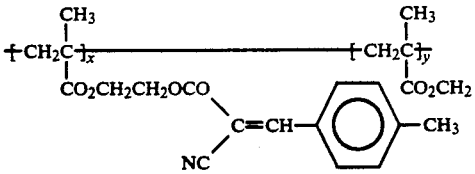
x:y = 70:30 (wt %)
UV-5
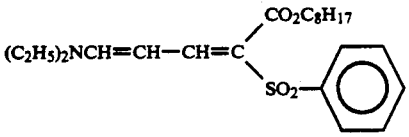
HBS-1 Tricresyl Phosphate
HBS-2 Di-n-butyl Phthalate
HBS-3
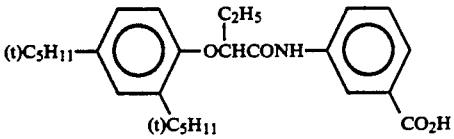

-continued
Sensitizing Dye I:
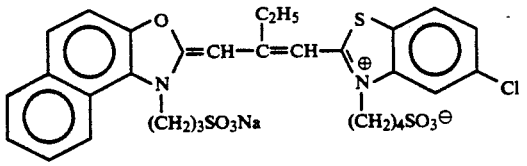
Sensitizing Dye II:
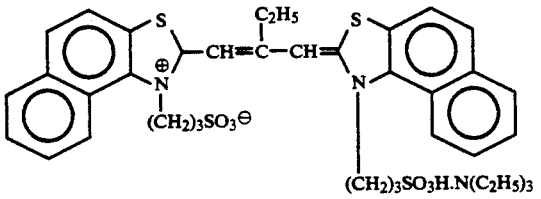
Sensitizing Dye III:
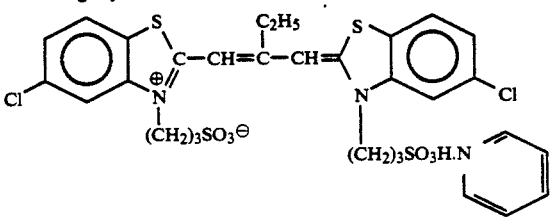
Sensitizing Dye IV:
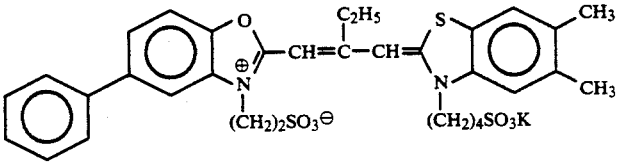
Sensitizing Dye V:
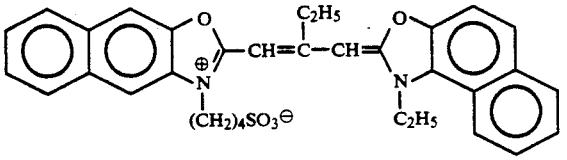
Sensitizing Dye VI:
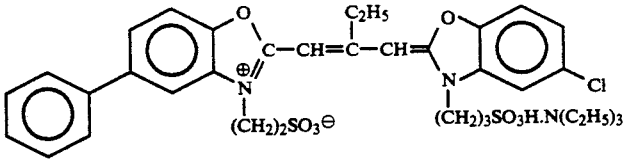
Sensitizing Dye VII:
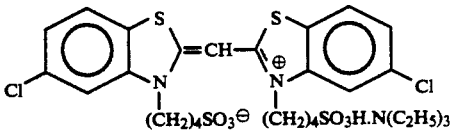
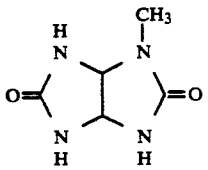
S-1
Sample 102 prepared in this manner was imagewise exposed to white light having a color temperature of The processing steps employed were as follows.

| Step | Processing Steps: Processing Time | Processing Temperature | Amount of Replenisher* | Tank Liquid (liter) |
|---|---|---|---|---|
| Color development | 1 min. | 45° C. | 10 ml | 2 |
| Bleach (1) | 40 sec. | 43° C. | 5 ml | 1 |
| Bleach (2) | 20 sec. | " | — | |
| Fix | 40 sec. | " | 30 ml | 1 |
| Wash | 20 sec. | " | 30 ml | 1 |
| Drying | 40 sec. | 70°C. | | |

*Amount per 35 mm × 1 meter of the lightsensitive material processed.

The composition of each processing solution was follows.

| | Tank Liquid | Replenisher |
|---|---|---|
| Color developer | | |
| Diethylenetriamine-pentaacetic Acid | 2.2 g | 2.2 g |
| 1-Hydroxyethylidene-1,1-diphosphonic Acid | 3.0 g | 3.2 g |
| Soidum Sulfite | 4.1 g | 4.9 g |
| Potassium Carbonate | 38 g | 40 g |
| Potassium Iodide | 1.3 mg | — |
| Hydroxylamine Sulfate | 2.4 g | 3.3 g |
| 2-Methyl-4-[N-ethyl-N-β-amino]aniline Sulfate | 13.8 g | 17.0 g |
| 2-methylimidazole | 820 mg | 820 mg |
| 5-Nitrobenzimidazole | 30 mg | 31 mg |
| 1-Phenyl-4-methyl-hydroxy-methyl-3-pyrazolidone | 50 mg | 50 mg |
| Water to make | 1 liter | 1 liter |
| pH (25° C.) | 10.30 | 10.15 |
| Bleach Solution | | |
| Metal Chelating Compound described in Table 2 | 0.35 mol | 0.50 mol |
| Ammonium Bromide | 80 g | 114 g |
| Ammonium Nitrate | 15 g | 21.4 g |
| Acetic Acid (90%) | 42 g | 60 g |
| Water to make | 1 liter | 1 liter |
| pH | 4.5 | 4.5 |
| Fix Solution | | |
| Tank liquid = replenisher | | |
| Ammonium Thiosulfate (70%) | | 280 ml |
| Ethylenediaminetetraacetic Acid | | 10 g |
| Ammonium Sulfite | | 80 g |

-continued

| | Tank Liquid | Replenisher |
|---|---|---|
| Water to make | | 1 liter |
| pH | | 7.80 |

On the sample processed, the same measurements as in Example 1 were carried out, and the amount of remaining silver, bleach fog, and stains formed with the passage of time are shown in Table 2.

TABLE 2

| No. | Metal Chelating Compound | Time (sec) | Amount of Remaining Silver (μg/cm²) | Bleach Fog ΔDmin(G) | Increase of Stains with the passage of Time ΔDmin(G) | Remarks |
|---|---|---|---|---|---|---|
| 201 | Comparison | 40 | 17.2 | 0.01 | 0.82 | Comparison |
| | Compound E | 20 | 41.5 | 0.01 | 0.95 | " |
| 202 | Comparison | 40 | 1.1 | 0.28 | 0.30 | " |
| | Compound F | 20 | 6.2 | 0.17 | 0.35 | " |
| 203 | Comparison | 40 | 33.5 | 0.06 | 0.51 | " |
| | Compound G | 20 | 45.6 | 0.04 | 0.55 | " |
| 204 | Compound 1C | 40 | 2.1 | 0.02 | 0.03 | Invention |
| | | 20 | 2.3 | 0.021 | 0.03 | " |
| 205 | Compound 2C | 40 | 1.6 | 0.02 | 0.04 | " |
| | | 20 | 1.8 | 2.01 | 0.04 | " |
| 206 | Compound 6C | 40 | 0.7 | 0.00 | 0.04 | " |
| | | 20 | 0.9 | 0.00 | 0.04 | " |
| 207 | Compound 9C | 40 | 2.0 | 0.00 | 0.05 | " |
| | | 20 | 2.3 | 0.00 | 0.06 | " |
| 208 | Compound 12C | 40 | 2.1 | 0.01 | 0.06 | " |
| | | 20 | 2.3 | 0.01 | 0.08 | " |
| 209 | Compound 55C | 40 | 1.8 | 0.01 | 0.03 | " |
| | | 15 | 2.2 | 0.00 | 0.04 | " |
| 210 | Compound 57C | 40 | 1.6 | 0.01 | 0.03 | " |
| | | 15 | 2.0 | 0.00 | 0.04 | " |

The comparison compounds shown in Table 2 above were as follows.

Comparison Compound E:

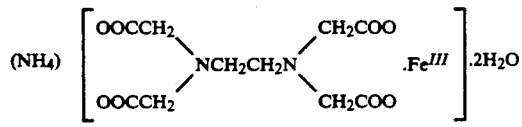

Comparison Compound F:

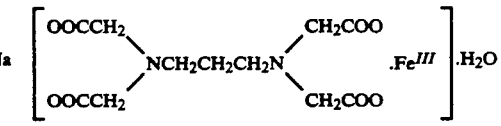

Comparison Compound G:

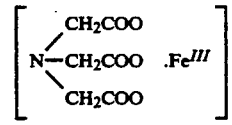

From Table 2, it can be seen that the bleach solution containing the metal chelating compound of this invention as the bleaching agent has an excellent performance in that the bleach solution has a sufficient bleaching faculty even in a short bleaching time as compared to the comparison bleach solution. Also, the formation of bleach fog and the increase of stains over the passage of time are less in the case of the bleach solution in this invention.

EXAMPLE 3

Both sides of a paper support were laminated with polyethylene. The surface of the polyethylenelaminated paper support was subjected to a corona discharge treatment, and a gelatin undercoat layer containing sodium dodecylbenzenesulfonate was then provided thereon. Subsequently, various photographic constituent layers were coated thereon to prepare a multi-layer color photographic paper having the layer structure described below. For blue-, green- and red-sensitive emulsion layers in the multi-layer color photographic paper, the following Emulsions A', B' and C' were used, respectively.

| | |
|---|---|
| Emulsion A': | silver dhlorobromide emulsion cube, a 3:7 (by Ag molar ratio) mixture of larger-size emulsion Al having a mean grain size of 0.88 μm and smaller-size emulsion A2 having a mean grain size of 0.70 μm, coefficient of variation in grain size distribution being 0.08 and 0.10, respectively; 0.3 mol % of AgBr being localized on a part of the surface of grain in each emulsion |
| Emulsion B': | Silver chlorobromide emulsion cube, a 1:3 (by Ag molar ratio) mixture of larger-size emulsion B1 having a mean grain size of 0.55 μm and smaller-size emulsion B2 having a mean grain size of 0.39 μm; coefficient of variation in grain size distribution being 0.10 and 0.08, respectively; 0.8 mol % of AgBr being localized on a part of the surface of the grain in each emulsion) |
| Emulsion C': | Silver chlorobromide emulsion (cube, a 1:4 (by Ag molar ratio) mixture of larger-size of 0.58 μm and smaller-size emulsion C2 having a mean grain size of 0.45 μm; coefficient of variation in grain size distribution being 0.09 and 0.11, respectively; 0.6 mol % of AgBr being localized on a part of the surface of the grain in each emulsion) |

Coating solutions were prepared in the following manner.

Preparation of coating solution for first layer 19.1 g of yellow coupler (ExY), 4.4 g of dye image stabilized (Cpd-1') and 0.7 g of dye image stabilizer (Cpd-7') were dissolved in 27.2 cc of ethyl acetate, 4.1 g of solvent (Solv-3') and 4.1 g of solvent (Solv-7'). The resulting solution was emulsified and dispersed in 185 cc of a 10% aqueous gelatin solution containing 8 cc of 10% dodecylbenzenesulfonate to prepare an emulsified dispersion A. Separately, a silver chlorobromide emulsion A' as described above was prepared. The emulsion A' contained the following blue-sensitive sensitizing dyes A and B added thereto ($2.0\times10^{-4}$ mol of each of these two dyes being added to the larger-size emulsion and $2.5\times10^{-4}$ mol of each of these two dyes being added to the smaller-size emulsion, each amount being per mol of silver). The chemical ripening of the emulsion was carried out by adding a sulfur sensitizing dye and a gold sensitizing dye. The above emulsified dispersion A and the silver chlorobromide emulsion A' were mixed and dissolved. A coating solution for the first layer was prepared so as to give the following composition.

Coating solutions for the second layer to the seventh layer were prepared in a similar manner as in the preparation of the coating solution for the first layer. Sodium salt of 1-oxy-3,5-dichloro-s-triazine was used as the hardening agent for gelatin in each layer. Cpd-10' and Cpd-11' as described below were added to each layer in such an amount as to give the total amounts of 25.0 mg/m$^2$ and 50.0 mg/m$^2$, respectively.

Emulsions A', B' and C' used in the first, third and fifth layer, respectively, were spectrally sensitized using the following sensitizing dyes.

Sensitizing dye A for blue-sensitive emulsion Layer (1st layer)

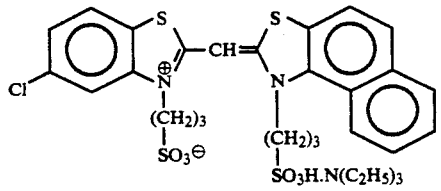

Sensitizing dye B for blue-sensitive emulsion Layer (1st layer)

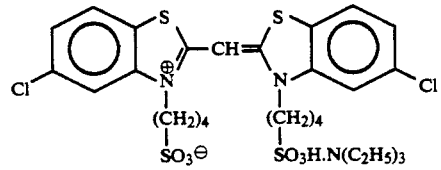

($2.0\times10^{-4}$ mol of each of these dyes were added to the larger-size emulsion A1, and $2.5\times10^{-4}$ mol of each of these dyes being added to the smaller-size emulsion A2, each amount being per mol of silver halide)

Sensitizing dye C for green-sensitive emulsion layer (3rd layer)

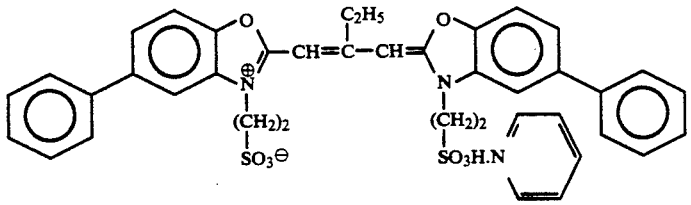

($4.0\times10^{-4}$ mol being were added to larger-size emulsion B1, and $5.6\times10^{-4}$ mol were added to smaller-size emulsion B2, each amount being per mol of silver halide)

Sensitizing dye D for green-sensitive emulsion layer (3rd layer)

-continued

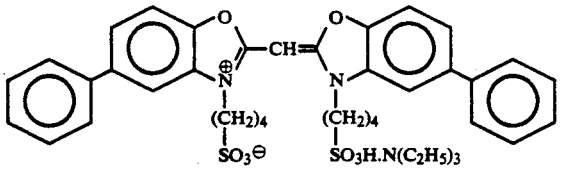

($7.0\times10^{-5}$ mol being added to larger-size emulsion B1, and $1.0\times10^{-5}$ mol being added to smaller-size emulsion B2, each amount being per mol of silver halide)

Sensitizing dye E for red-sensitive emulsion layer (5th layer)

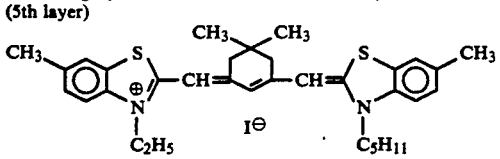

($0.9\times10^{-4}$ mol were added to larger-size emulsion C1, and $1.1\times10^{-4}$ mol were added to smaller-size emulsion C2, each amount being per mol of silver halide)

$2.6\times10^{-3}$ mol of the following compound per mol of silver halide was added to the red-sensitive emulsion layer (5th layer).

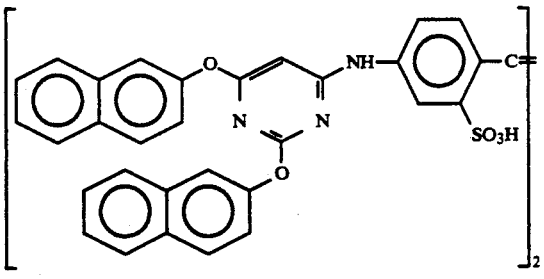

$8.5\times10^{-5}$ mol, $7.7\times10^{-4}$ mol and $2.5\times10^{-4}$ mol of 1-(5-methylureidophenyl)-5-mercaptotetrazole were added to the blue sensitive emulsion layer, the green-sensitive emulsion layer and the red-sensitive emulsion layer, respectively, each amount being per mol of silver halide.

$1\times10^{-4}$ mol and $2\times10^{-4}$ mol of 4-hydroxy-6-methyl-1,3,3a,7-tetrazaindene were also added to the blue-sensitive emulsion layer and the green-sensitive emulsion layer, respectively, each amount being per mol of silver halide.

Further, the following dyes (parenthesized numerals represent coating weights) were added to each emulsion layer to prevent irradiation.

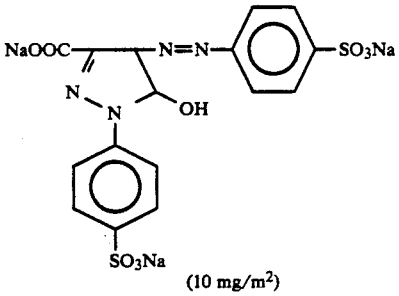

(10 mg/m²)

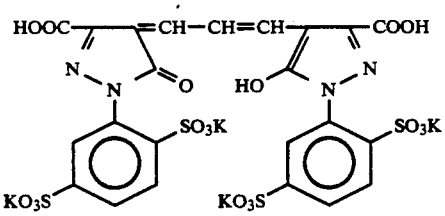

(10 mg/m²)

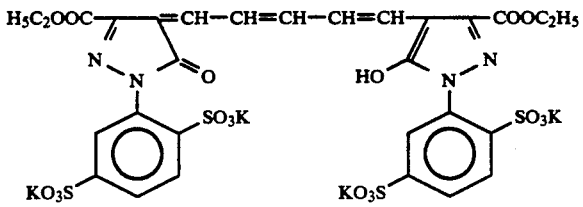

(40 mg/m²)

and

-continued

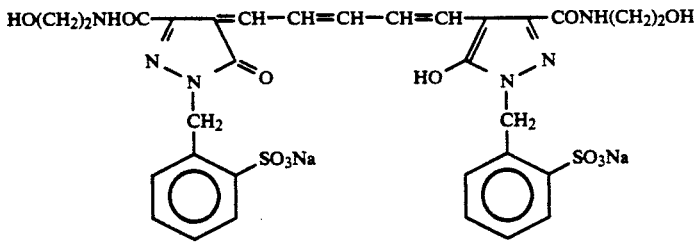

(20 mg/m²)

Layer Structure

Each layer had the following composition. Numerals represent coating weights (g/m²). The amounts of silver halide emulsions are represented by coating weight in terms of silver.

Support

Polyethylene-laminated paper (polyethylene on the first layer side contained white pigment ($TiO_2$) and bluish dye (ultramarine))

| | |
|---|---|
| First layer (blue-sensitive emulsion layer) | |
| Emulsion A' | 0.30 |
| Gelatin | 1.86 |
| Yellow coupler (ExY) | 0.82 |
| Dye image stabilized (Cpd-1') | 0.19 |
| Solvent (Solv-3') | 0.18 |
| Solvent (Solv-7') | 0.18 |
| Dye image stabilizer (Cpd-7') | 0.06 |
| Second layer (color mixing inhibiting layer) | |
| Gelatin | 0.99 |
| Color mixing inhibitor (Cpd-5') | 0.08 |
| Solvent (Solv-1') | 0.16 |
| Solvent (Solv-4') | 0.08 |
| Third layer (green-sensitive emulsion layer) | |
| Emulsion B' | 0.12 |
| Gelatin | 1.24 |
| Magenta coupler (ExM) | 0.23 |
| Dye image stabilizer (Cpd-2') | 0.03 |
| Dye image stabilizer (Cpd-3') | 0.16 |

-continued

| | |
|---|---|
| Dye image stabilizer (Cpd-4') | 0.02 |
| Dye image stabilizer (Cpd-9') | 0.02 |
| Solvent (Solv-2') | 0.40 |
| Fourth layer (ultraviolet light absorbing layer) | |
| Gelatin | 1.58 |
| Ultraviolet light absorber (UV-1') | 0.47 |
| Color mixing inhibitor (Cpd-5') | 0.05 |
| Solvent (Solv-5') | 0.24 |
| Fifth layer (red-sensitive emulsion layer) | |
| Emulsion C' | 0.23 |
| Gelatin | 1.34 |
| Cyan coupler (ExC) | 0.32 |
| Dye image stabilizer (Cpd-2') | 0.03 |
| Dye image stabilizer (Cpd-4') | 0.02 |
| Dye image stabilizer (Cpd-6') | 0.18 |
| Dye image stabilizer (Cpd-7') | 0.40 |
| Dye image stabilizer (Cpd-8') | 0.05 |
| Solvent (Solv-6') | 0.14 |
| Sixth layer (ultraviolet light absorbing layer) | |
| Gelatin | 0.53 |
| Ultraviolet light absorber (UV-1') | 0.16 |
| Color mixing inhibitor (Cpd-5') | 0.02 |
| Solvent (Solv-5') | 0.08 |
| Seventh layer (protective layer) | |
| Gelatin | 1.33 |
| Acrylic-modified polymer of polyvinyl alcohol (degree of modification: 17%) | 0.17 |
| Liquid paraffin | 0.03 |

The compounds used in the above photographic layers are shown below.

(ExY) Yellow coupler:

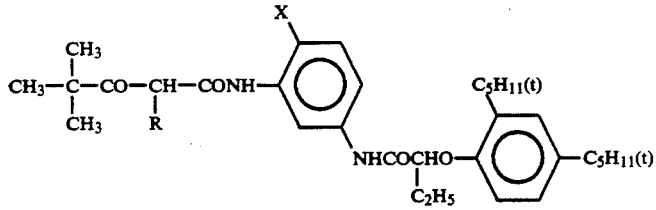

R =

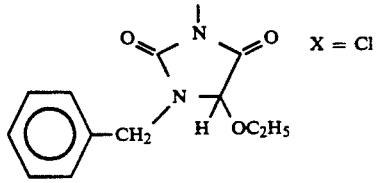

X = Cl and

-continued
R = 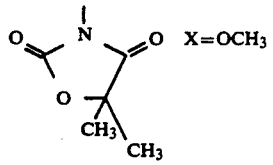
1:1 mixture (by mol)
(ExM) Magenta coupler:
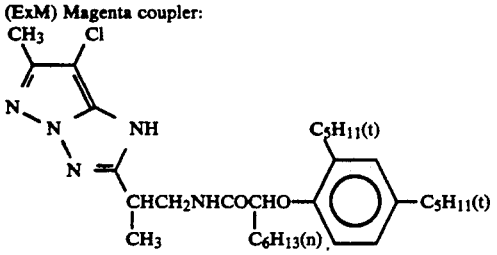
(ExC) Cyan coupler:
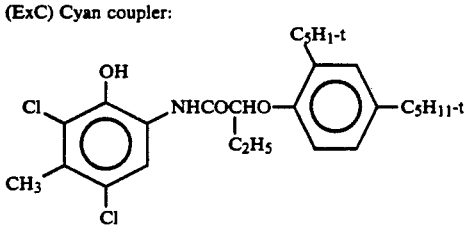
and
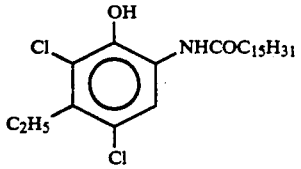
1:1 mixture (by mol)
(Cpd-1') Dye image stabilizer
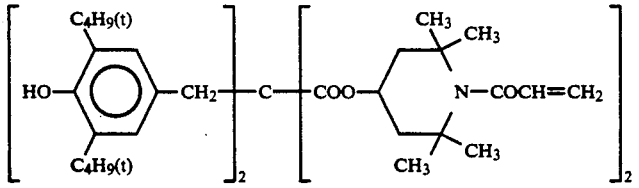
(Cpd-2') Dye image stabilizer
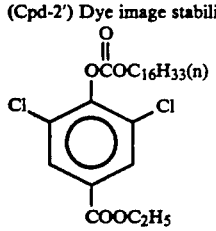
(Cpd-3') Dye image stabilizer
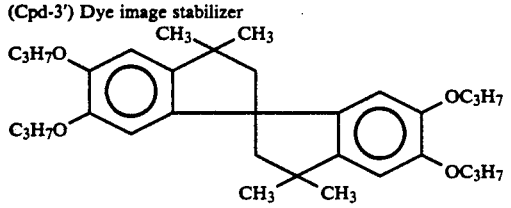

-continued
(Cpd-4') Dye image stabilizer
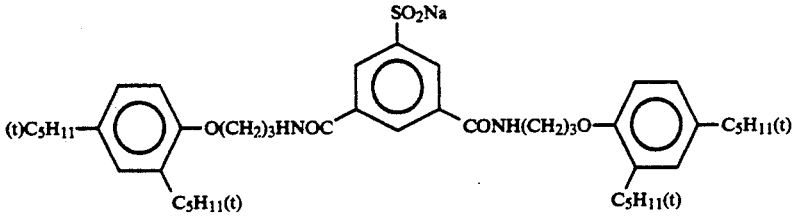
(Cpd-5') Color mixing inhibitor
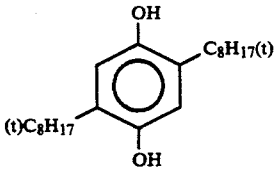
(Cpd-6') Dye image stabilizer
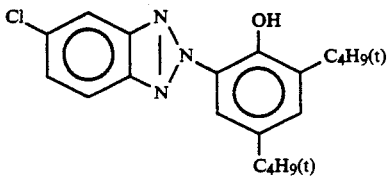
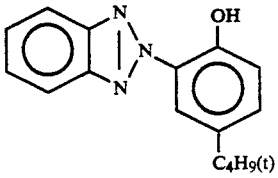
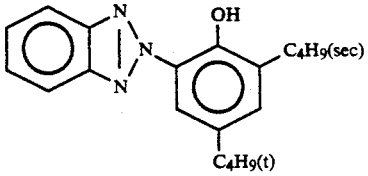
2:4:4 mixture (by weight)
(Cpd-7') Dye image Stabilizer
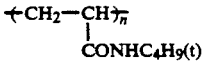
(Average Mw 60,000)
(Cpd-8') Dye image stabilizer
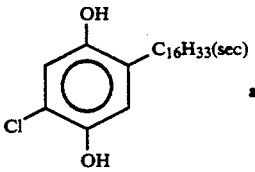
and
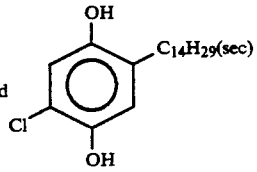
1:1 mixture (by weight)
(Cpd-9') Dye image stabilizer -continued
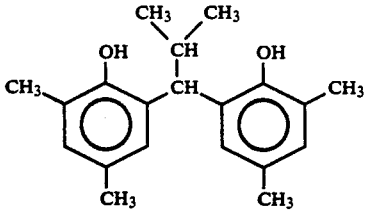
(Cpd-10') Antiseptic agent
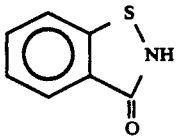
(Cpd-11') Antiseptic agent
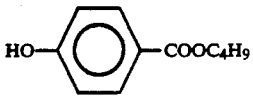
(UV-1') Ultraviolet light absorber
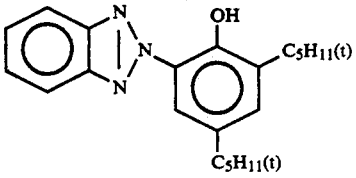
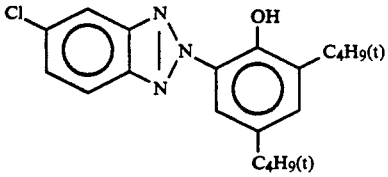
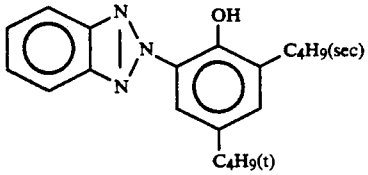
4:2:4 mixture by weight
(Solv-1') Solvent
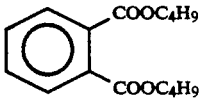
(Solv-2') Solvent
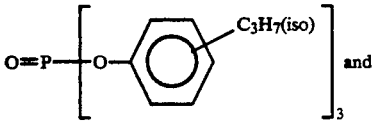
and
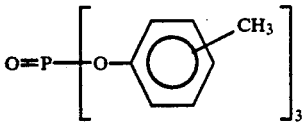
1:1 mixture (by volume)

-continued (Solv-3') Solvent
$O{=}P{+}O{-}C_9H_{19}(iso)]_3$ (Solv-3') Solvent

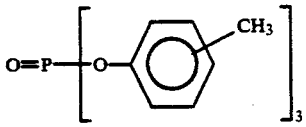

(Solv-5') Solvent $$\begin{array}{l} COOC_8H_{17} \\ | \\ (CH_2)_8 \\ | \\ COOC_8H_7 \end{array}$$

(Solv-6') Solvent

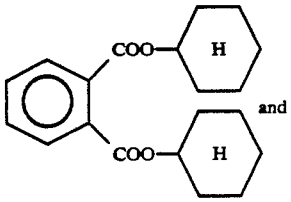

and $$C_8H_{17}\underset{\diagdown\ \ \diagup}{CH\ CH}(CH_2)_7COOC_8H_{17}$$
$$O$$

80:20 mixture of (by volume)

(Solv-7') Solvent $$C_8H_{17}\underset{\diagdown\ \ \diagup}{CH\ CH}(CH_2)_7COOC_8H_{17}$$
$$O$$

The color photographic paper thus prepared was stepwise exposed to a light source having a color temperature of 3800° K. through an optical wedge and processed using an automatic processor. Processing was continued until the accumulated value of each replenisher was more three times the tank volume. The processed result in this case is shown in Table 3.

The amount of the remaining silver at the maximum density portion was measured by a fluorescent X-ray method. The bleach fog was determined as the difference between the G density at the Dmin portion of the foregoing processed sample and the G density of the Dmin [portion of the sample obtained by the processing as described above while using the standard blix solution giving no bleach for in place of the blix solution used. Also, the samples before and after processing were allowed to stand for one week at 80° C. and 70% RH, and the increase of stains with the passage of time was determined.

| Step | Temp. | Time | Amount of Replenisher* | Tank Liquid |
|---|---|---|---|---|
| Color Development | 39° C. | 45 sec. | 70 ml | 20 liters |
| Blix | 35° C. | 45 sec. | 60 ml** | 30 liters |
| Rinsing (1) | 35° C. | 20 sec. | — | 10 liters |
| Rinsing (2) | 35° C. | 20 sec. | — | 10 liters |
| Rinsing (3) | 35° C. | 20 sec. | 360 ml | 10 liters |
| Drying | 80° C. | 60 sec. | | |

*Amount per square meter of the lightsensitive material) (Three tank countercurrent system of rinse (3) to rinse (1))

**In addition to the 60 ml described above, 120 ml per square of the light-sensitive material was introduced from Rinse (1).

The compositions of the processing solutions were as follows.

| | Tank Liquid | Replenisher |
|---|---|---|
| Color Developer | | |
| Water | 700 ml | 700 ml |
| Diethylenetriaminepenta acetic Acid | 0.4 g | 0.4 g |
| N,N,N-Tetrakis(methylene-phosphonic Acid) | 4.0 g | 4.0 g |
| Disodium 1,2-Dihydroxybenz-ene-4,6-disulfonate | 0.5 g | 0.5 g |
| Triethanolamine | 12.0 g | 12.0 g |
| Potassium Chloride | 6.5 g | — |
| Potassium Bromide | 0.03 g | — |
| Potassium Carbonate | 27.0 g | 27.0 g |
| Optical Whitening Agent (Whitex 4B, trade name, made by Sumitomo Chemical Company, Limited) | 1.0 g | 3.0 g |
| Sodium Sulfite | 0.1 g | 0.1 g |
| N,N-Bis(sulfoethyl)-hydroxylamine | 10.0 g | 13.0 g |
| N-Ethyl-N-(β-methanesulfon-amidoethyl)-3-methyl-4-aminoaniline Sulfate | 5.0 g | 11.5 g |
| Water to make | 1 liter | 1 liter |
| pH (25° C.) | 10.10 | 11.10 |
| Blix Solution | | |
| Water | 600 ml | 150 ml |
| Ammonium Thiosulfate (700 g · liter) | 100 ml | 250 ml |
| Ammonium Sulfite | 40 g | 100 g |
| Compound shown in Table 3 | 0.155 mol | 0.383 mol |
| Ferric Sulfate.$9H_2O$ | 0.138 mol | 0.340 mol |
| Ammonium Bromide | 40 g | 75 g |
| Nitric Acid (67%) | 30 g | 65 g |

-continued

| | | |
|---|---|---|
| Water to make | 1 liter | 1 liter |
| pH (25° C.) | 5.8 | 5.6 |

(pH adjusted by acetic acid and aqueous ammonia).

Standard Blix Solution for Evaluation of Bleach Fog

| | |
|---|---|
| Water | 600 ml |
| Ammonium Thiosulfate (70%) | 100 ml |
| Ammonium Sulfite | 40 g |
| Ethylenediaminetetraacetic Acid Iron (III) Ammonium | 50 g |
| Ethylenediaminetetraacetic Acid | 5 g |
| Ammonium Bromide | 40 g |
| Nitric Acid (67%) | 30 g |
| Water to make | 1 liter |
| pH (25° C.) | 5.8 |

The results are shown in Table 3 below.

TABLE 3

| No. | Compound | Amount of Remaining Silver ($\mu g/cm^2$) | Bleach Fog ΔD min (G) | Increase of Stains with the passage of Time ΔD min (G) | Remarks |
|---|---|---|---|---|---|
| 301 | Comparison Compound A | 2.8 | 0.00 | 0.12 | Comparison |
| 302 | Comparison Compound B | 11.6 | 0.03 | 0.04 | " |
| 303 | Comparison Compound C | 8.5 | 0.01 | 0.19 | " |
| 304 | Comparison Compound D | 2.9 | 0.00 | 0.16 | " |
| 305 | Present Compound 1 | 0.9 | 0.00 | 0.03 | Invention |
| 306 | Present Compound 2 | 0.2 | 0.00 | 0.02 | " |
| 307 | Present Compound 6 | 0.3 | 0.00 | 0.02 | " |
| 308 | Present Compound 9 | 0.8 | 0.01 | 0.03 | " |
| 309 | Present Compound 10 | 0.7 | 0.00 | 0.04 | " |
| 310 | Present Compound 12 | 0.5 | 0.01 | 0.05 | " |
| 311 | Present Compound 55 | 0.6 | 0.00 | 0.02 | " |
| 312 | Present Compound 57 | 0.5 | 0.00 | 0.02 | " |

Comparison Compound A: Ethylenediaminetetraacetic Acid
Comparison Compound B: 1,3-Diaminopropanetetraacetic Acid
Comparison Compound C: Nitrilotriacetic Acid
Comparison Compound D: Cyclohexanediaminetetraacetic Acid Form the results shown in Table 3, it can be seen that the blix solution containing the compound in this invention (i) reduce the amount of remaining silver as compared to the blix solutions containing the comparison compounds, (ii) scarcely gives bleach fog or an increase of stains after processing, and (iii) thus shows an excellent performance.

In addition, the blix solution containing Comparison Compound B shows a sufficient bleaching faculty directly after the preparation of the solution but causes a rapid reduction of that faculty by running, and causes severe turbidity in the solution. On the other hand, the blix solution containing the compound in this invention scarcely causes such turbidity and is stable.

EXAMPLE 4

The color photographic paper as in Example 3 was stepwise exposed to a light source of 3200° K. through an optical wedge and processed by the following processing steps. The amount of remaining silver at the maximum density portion was measured by a fluorescent X-ray method. Also, the G density at the minimum density was measured and then after being storing for 8 days under the conditions of 80° C. at 70% RH, its density was measured. The amount of stains which occurred over the passage of time was obtained as the difference thereof.

The processing steps employed in the example were as follows.

| Step | Temperature | Time |
|---|---|---|
| Color Development | 40° C. | 15 sec. |
| Blix | 30 to 35° C. | (1) 20 sec. |
| Rinse (1) | " | (2) 10 sec. |
| Rinse (2) | " | 7 sec. |
| Rinse (3) | " | " |
| Rinse (4) | " | " |
| Drying | 70 to 80° C. | 15 sec. |

(The rinse step was by a four tank countercurrent system from rinse (4) to rinse (1).)

The composition of each processing solution was shown below.

Color developer

| | |
|---|---|
| Water | 700 ml |
| Diethylenetriaminepentaacetic Acid | 0.4 g |
| N,N,N-tris(methylenephosphonic Acid) | 4.0 g |
| 1-Hydroxyethylidene-1,1-diphosphonic Acid | 0.4 g |
| Triethanolamine | 12.0 g |
| Potassium Chloride | 4.9 g |
| Potassium Bromide | 0.015 g |
| Potassium Carbonate | 29 g |
| Optical Whitening Agent (Whitex 4B, trade name, made by Sumitomo Chemical Company, Limited) | 1.0 g |
| Sodium Sulfite | 0.1 g |
| N,N-bis(sulfoethyl)hydroxyamine | 12.0 g |
| N-Ethyl-N-(β-methanesulfonamidoethyl)-3-methyl-4-aminoaniline Sulfate | 10.5 g |
| Water to make | 1 liter |
| pH (25° C.) | |

-continued

| Blix Solution | |
|---|---|
| Water | 400 ml |
| Ammonium Thiosulfate (700 g/liter) | 100 ml |
| Ammonium Sulfite | 15 g |
| *Compound shown in Table 4 | 0.21 mol |
| *Ferric Nitrate.$9H_2O$ | 0.19 mol |
| Ammonium Bromide | 40 g |
| Water to make | 1 liter |
| ph (25° C.) | 6.2 |

(The compound marked by (*) was mixed with 200 ml of water and then added to the solution.)

Rinse Solution

Ion-exchanged water (each of calcium and magnesium was less than 3 ppm) was used. The results are shown in Table 4 below.

TABLE 4

| No. | Metal Chelating Compound | Time (sec) | Amount of Remaining Silver ($\mu g/cm^2$) | Bleach Fog ΔDmin (G) | Increase of Stains with the passage of Time ΔDmin (G) | Remarks |
|---|---|---|---|---|---|---|
| 401 | Comparison | 20 | 5.1 | 0.01 | 0.24 | Comparison |
| | Compound E* | 10 | 9.9 | 0.01 | 0.28 | " |
| 402 | Comparison | 20 | 3.3 | 0.09 | 0.19 | " |
| | Compound F* | 10 | 6.2 | 0.07 | 0.22 | " |
| 403 | Comparison | 20 | 15.3 | 0.03 | 0.31 | " |
| | Compound G* | 10 | 23.7 | 0.02 | 0.42 | " |
| 404 | Compound 1C | 20 | 1.0 | 0.00 | 0.04 | Invention |
| | | 10 | 1.2 | 0.00 | 0.05 | " |
| 405 | Compound 2C | 20 | 0.2 | 0.01 | 0.03 | " |
| | | 10 | 0.4 | 0.02 | 0.04 | " |
| 406 | Compound 6C | 20 | 0.3 | 0.00 | 0.04 | " |
| | | 10 | 0.5 | 0.01 | 0.05 | " |
| 407 | Compound 9C | 20 | 0.8 | 0.00 | 0.04 | " |
| | | 10 | 1.0 | 0.00 | 0.06 | " |
| 408 | Compound 12C | 20 | 0.8 | 0.01 | 0.03 | Invention |
| | | 10 | 0.9 | 0.01 | 0.05 | " |
| 409 | Compound 55C | 20 | 1.0 | 0.01 | 0.05 | " |
| | | 10 | 1.2 | 0.00 | 0.06 | " |
| 410 | Compound 57C | 20 | 0.8 | 0.01 | 0.05 | " |
| | | 10 | 0.9 | 0.00 | 0.06 | " |

*Same as those used in Example 2

As shown in Table 4, the blix solution containing the compound of this invention is excellent in its desilvering property as compared with the bleach solutions containing the comparison compounds and gives less stains over the passage of time.

Example 5

A multilayer color photographic light-sensitive material (Sample 501) having the layers of the compositions shown below on a cellulose triacetate film support having a subbing layer was prepared.

Compositions of Layers

The coated amount was shown by a g/m² unit of silver for a silver halide emulsion and colloidal silver, by a g/m2 unit for couplers, additives, and gelatin, and by a mol number for the sensitizing dye per mol of the silver halide in the same layer. When the compound had several functions, one of them is shown as the representation.

In addition, the following abbreviations are used.

UV: Ultraviolet absorbent; Solv: High-boiling organic solvent; ExF: Dye; ExS: Sensitizing dye; ExC: Cyan coupler; ExM: magenta coupler; ExY: Yellow coupler; and Cpd: Additives.

| Layer 1: Antihalation Layer | |
|---|---|
| Black Colloidal Silver | 0.15 |
| Gelatin | 2.33 |
| ExM-2 | 0.11 |
| UV-1 | $3.0 \times 10^{-2}$ |
| UV-2 | $6.0 \times 10^{-2}$ |
| UV-3 | $7.0 \times 10^{-2}$ |
| Solv-1 | 0.16 |
| Solv-2 | 0.10 |
| ExF-1 | $1.0 \times 10^{-2}$ |
| ExF-2 | $4.0 \times 10^{-2}$ |
| ExF-3 | $5.0 \times 10^{-3}$ |
| Cpd-6 | $1.0 \times 10^{-3}$ |
| **Layer 2: Low-Sensitive Red-Sensitive Layer** | |
| Silver Iodobromide Emulsion (AgI 4.0 mol %; uniform AgI type, sphere-corresponding diameter 0.4 μm, variation coeff. of sphere-corresponding diameters 30%, tabular grains, aspect ratio 3.0) | 0.35 as Ag |
| Silver Iodobromide Emulsion (AgI 6.0 mol %, inside high AgI type of core/shell ratio of 1/2, sphere-corresponding diameter 0.45 μm variation coeff. of sphere-corresponding diameters 23%, tabular grains, aspect ratio 2.0) | 0.18 as Ag |
| Gelatin | 0.77 |
| ExS-1 | $2.4 \times 10^{-4}$ |
| ExS-2 | $1.4 \times 10^{-4}$ |
| ExS-5 | $2.3 \times 10^{-4}$ |
| ExS-7 | $4.1 \times 10^{-6}$ |
| ExC-1 | 0.09 |
| ExC-2 | $4.0 \times 10^{-2}$ |
| ExC-3 | $8.0 \times 10^{-2}$ |
| ExC-5 | 0.08 |
| **layer 3: Intermediate-Sensitive Red-Sensitive Layer** | |
| Silver Iodobromide Emulsion (AgI 6.0 mol %, inside high AgI type of core/shell ratio of 1/2, sphere-corresponding diameter 0.65 μm, variation coeff. of sphere-corresponding diameters 23%, tabular grains, aspect ratio 2.0) | 0.80 as Ag |
| Gelatin | 1.46 |
| ExS-1 | $2.4 \times 10^{-4}$ |
| ExS-2 | $1.4 \times 10^{-4}$ |
| ExS-5 | $2.4 \times 10^{-4}$ |
| ExS-7 | $4.3 \times 10^{-6}$ |
| ExC-1 | 0.19 |
| ExC-2 | $2.0 \times 10^{-2}$ |
| ExC-3 | 0.10 |
| ExC-5 | 0.19 |
| ExC-6 | $2.0 \times 10^{-2}$ |
| ExM-3 | $2.0 \times 10^{-2}$ |
| UV-2 | $5.7 \times 10^{-2}$ |
| UV-3 | $5.7 \times 10^{-2}$ |

-continued

| | |
|---|---|
| Layer 4: High-Sensitive Red-Sensitive Layer | |
| Silver Iodobromide Emulsion (AgI 9.3 mol %, multilayer structure grains of core-intermediate/shell ratio of 3/4/2, AgI contents 24, mol %, 0, and 6 mol % from the inside, sphere-corresponding diameter 0.75 μm, variation coeff. of sphere-corresponding diameters 23%, tabular grains, aspect ratio 2.5) | 1.49 as Ag |
| Gelatin | 1.38 |
| ExS-1 | $2.0 \times 10^{-4}$ |
| ExS-2 | $1.1 \times 10^{-4}$ |
| ExS-5 | $1.9 \times 10^{-4}$ |
| ExS-7 | $1.4 \times 10^{-5}$ |
| ExC-1 | $8.0 \times 10^{-2}$ |
| ExC-4 | $9.0 \times 10^{-2}$ |
| ExC-6 | $2.0 \times 10^{-2}$ |
| Solv-1 | 0.20 |
| Solv-2 | 0.53 |
| Layer 5: Interlayer | |
| Gelatin | 0.62 |
| Cpd-1 | 0.13 |
| Polyethyl Acerylate Latex | $8.0 \times 10^{-2}$ |
| Solv-1 | $8.0 \times 10^{-2}$ |
| Layer 6: Low-Sensitive Green-Sensitive Layer | |
| Silver Iodobromide Emulsion (AgI 4.0 mol %, uniform AgI type, sphere-corresponding diameter 0.33 μm, variation coeff. of sphere-corresponding diameters 37%, tabular grains, aspect ratio 2.0) | 0.19 as Ag |
| Gelatin | 0.44 |
| ExS-3 | $1.5 \times 10^{-4}$ |
| ExS-4 | $4.4 \times 10^{-4}$ |
| ExS-5 | $9.2 \times 10^{-5}$ |
| ExM-1 | 0.17 |
| ExM-3 | $3.0 \times 10^{-2}$ |
| Solv-1 | 0.13 |
| Solv-4 | $1.0 \times 10^{-2}$ |
| Layer 7: Intermediate-Sensitive Green-Sensitive Layer | |
| Silver Iodobromide Emulsion (AgI 4.0 mol %, uniform AgI type, sphere-corresponding diameter 0.55 μm, variation coeff. of sphere-corresponding diameters, tabular grains, aspect ratio 4.0) | 0.24 as Ag |
| Gelatin | 0.54 |
| ExS-3 | $2.1 \times 10^{-4}$ |
| ExS-4 | $6.3 \times 10^{-4}$ |
| ExS-5 | $1.3 \times 10^{-4}$ |
| ExM-1 | 0.15 |
| ExM-3 | $4.0 \times 10^{-2}$ |
| ExY-1 | $3.0 \times 10^{-2}$ |
| Solv-1 | 0.13 |
| Solv-4 | $1.0 \times 10^{-2}$ |
| Layer 8: High-Sensitive Green-Sensitive Layer | |
| Silver Iodobromide Emulsion (AgI 8.8 mol %, multilayer structure grains of silver ratio of 3/4/2, AgI contents 24 mol %, 0, 3 mol % from the inside, sphere-corresponding diameter 0.75 μm, variation coeff. of sphere-corresponding diameters 23%, tabular grains, aspect ratio 1.6) | 0.49 as Ag |
| Gelatin | 0.61 |
| ExS-4 | $4.3 \times 10^{-4}$ |
| ExS-5 | $8.6 \times 10^{-5}$ |
| ExS-8 | $2.8 \times 10^{-5}$ |
| ExM-1 | $8.0 \times 10^{-2}$ |
| ExM-2 | $3.0 \times 10^{-2}$ |
| ExY-1 | $3.0 \times 10^{-2}$ |
| ExC-1 | $1.0 \times 10^{-2}$ |
| ExC-4 | $1.0 \times 10^{-2}$ |
| Solv-1 | 0.23 |
| Solv-2 | $5.0 \times 10^{-2}$ |
| Solv-4 | $1.0 \times 10^{-2}$ |
| Cpd-8 | $1.0 \times 10^{-2}$ |
| Layer 9: Interlayer | |
| Gelatin | 0.56 |
| Cpd-1 | $4.0 \times 10^{-2}$ |
| Polyethyl Acrylate Latex | $5.0 \times 10^{-2}$ |
| Solv-1 | $3.0 \times 10^{-2}$ |
| UV-4 | $3.0 \times 10^{-2}$ |
| UV-5 | $4.0 \times 10^{-2}$ |
| Layer 10: Donor Layer of Interlayer | |

-continued

| | |
|---|---|
| Effect of Red-Sensitive Emulsion Layer | |
| Silver Iodobromide Emulsion (AgI 8.0 mol %; inside high AgI type of core/shell ratio of 1/2, sphere-corresponding diameter 0.65 μm, variation coeff. of sphere-corresponding diameters 25%, tabular grains, aspect ratio 2.0) | 0.67 as Ag |
| Silver Iodobromide Emulsion (AgI 4.0 mol %, uniform AgI type, sphere-corresponding diameter 0.4 μm, variation coeff. of sphere-corresponding diameters 30%, tabular grains aspect ratio 3.0) | 0.20 as Ag |
| Gelatin | 0.87 |
| ExS-3 | $6.7 \times 10^{-4}$ |
| ExM-4 | 0.16 |
| Solv-1 | 0.30 |
| Solv-6 | $3.0 \times 10^{-2}$ |
| Layer 11: Yellow Filter Layer | |
| Yellow Colloidal Silver | $9.0 \times 10^{-2}$ |
| Gelatin | 0.84 |
| Cpd-2 | 0.13 |
| Solv-1 | 0.13 |
| Cpd-1 | $8.0 \times 10^{-2}$ |
| Cpd-6 | $2.0 \times 10^{-3}$ |
| H-1 | 0.25 |
| Layer 12: Low Sensitive Blue-Sensitive Layer | |
| Silver Iodobromide Emulsion (AgI 4.5 mol %, uniform AgI type, sphere-corresponding diameter 0.7 μm, variation coeff. of sphere-corresponding diameters 15%, tabular grains, aspect ratio 7.0) | 0.50 as Ag |
| Silver Iodobromide Emulsion (AgI 3.0 mol %, uniform AgI type, sphere-corresponding diameter 0.3 μm, variation coeff. of sphere-corresponding diameters 30%, tabular grains, aspect ratio 7.0) | 0.30 as Ag |
| Gelatin | 2.18 |
| ExS-6 | $9.0 \times 10^{-4}$ |
| ExC-1 | 0.14 |
| ExY-2 | 0.17 |
| ExY-3 | 1.09 |
| Solv-1 | 0.54 |
| Layer 13: Interlayer | |
| Gelatin | 0.40 |
| ExY-4 | 0.19 |
| Solv-1 | 0.19 |
| Layer 14: High-Sensitive Blue-Sensitive Layer | |
| Silver Iodobromide Emulsion (AgI 10.0 mol %, inside high AgI type, Sphere-corresponding diameter: 1.0 μm, variation coeff. of sphere-corresponding diameters 25%, multilayer twin tabular grains, aspect ratio 2.0) | 0.40 as Ag |
| Gelatin | 0.49 |
| ExS-6 | $2.6 \times 10^{-4}$ |
| ExY-2 | $1.0 \times 10^{-4}$ |
| ExY-3 | 0.20 |
| ExC-1 | $1.0 \times 10^{-2}$ |
| Solv-1 | $9.0 \times 10^{-2}$ |
| Layer 15: 1st Protective Layer | |
| Fine Grain Silver Iodobromide Emulsion (AgI 2.0 mol %, uniform AgI type, sphere-corresponding Diameter 0.07 μm) | 0.12 as Ag |
| Gelatin | 0.63 |
| UV-4 | 0.11 |
| UV-5 | 0.18 |
| Solv-5 | $2.0 \times 10^{-2}$ |
| Cpd-5 | 0.10 |
| Polyethyl acrylate latex | $9.0 \times 10^{-2}$ |
| layer 16: 2nd Protective Layer | |
| Fine Grain Silver Iodobromide Emulsion (AgI 0.2 mol %, uniform AgI type, sphere-corresponding diameter 0.07 μm) | 0.36 as Ag |
| Gelatin | 0.85 |
| B-1 (diameter: 1.5 μm) | $8.0 \times 10^{-2}$ |
| B-2 (diameter: 1.5 μm) | $8.0 \times 10^{-2}$ |
| B-3 | $2.0 \times 10^{-2}$ |
| W-4 | $2.0 \times 10^{-2}$ |
| H-1 | 0.18 |

The sample thus prepared further contained 1,2-benzisothiazilin-3-one (200 ppm to gelatin), n-butyl-p-hydroxy benzoate (about 1,000 ppm to gelatin), and 2-phenoxy ethanol (about 10,000 ppm to gelatin).

Moreover, the sample further contained compounds B-4, B-5, F-1, F-2, F-3, F-4, F-5, F-6, F-7, F-8, F-9, F-10, F-11, and F-12, and an iron salt, a lead salt, a gold salt, a platinum salt, an iridium salt and a rhodium salt.

Each layer further contained surface active agents W-1, W-2, and W-3 as a coating aid and an emulsion-dispersing agent in addition to the foregoing components.

The compounds used for preparing the sample of this Example were as follows:

UV-1

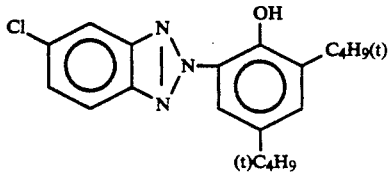

UV-2

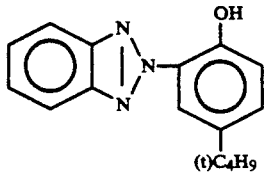

UV-3

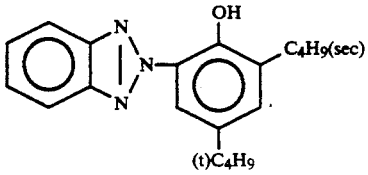

UV-4

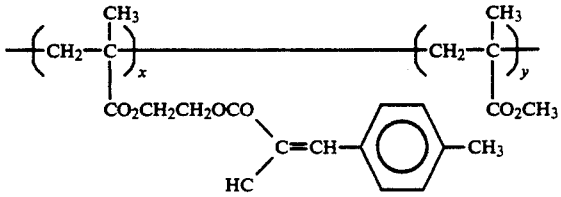

x:y = 70:30 (wt %)

UV-5

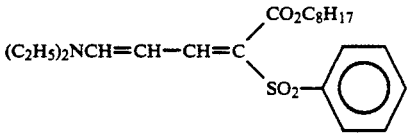

Tricresyl Phosphate Solv-1

Dibutyl Phthalate Solv-2

Solv-4

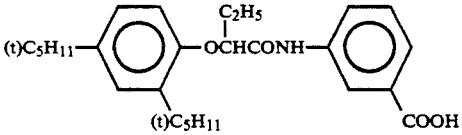

Trihexyl Phosphate Solv-5

Solv-6

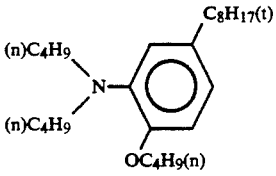

ExF-1

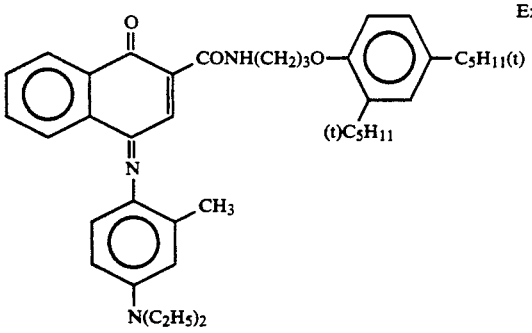

ExF-2

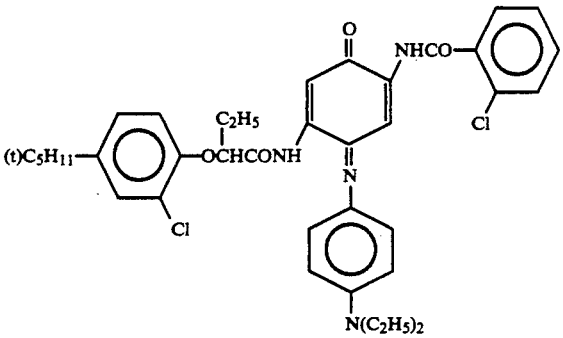

ExF-3

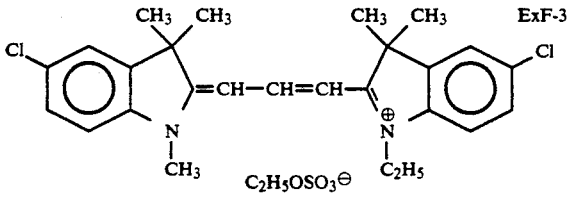

ExC-1

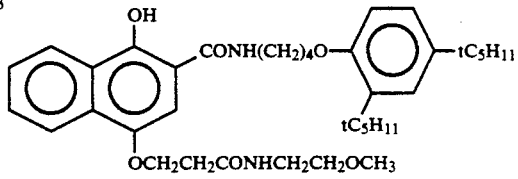

-continued
ExC-2
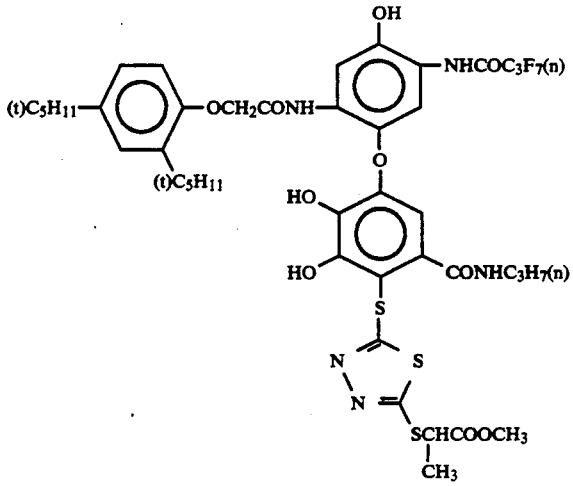
ExC-3
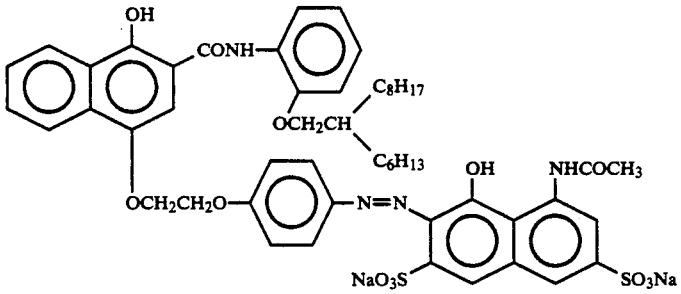
ExC-4
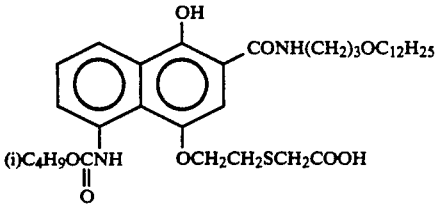
ExC-5
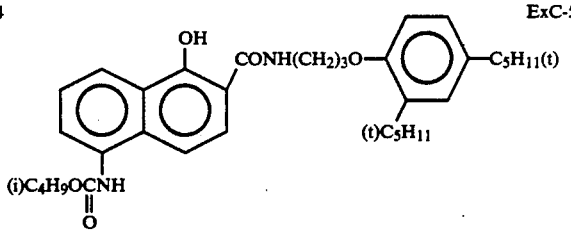
ExC-6
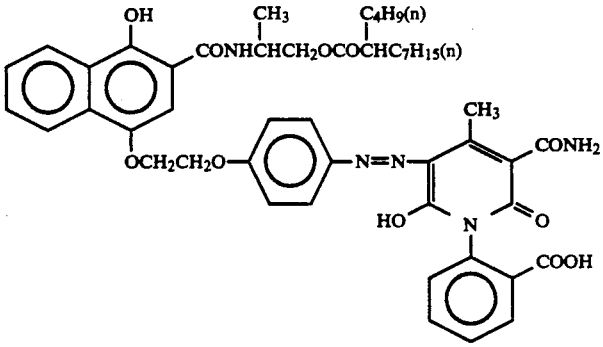

-continued
ExM-1
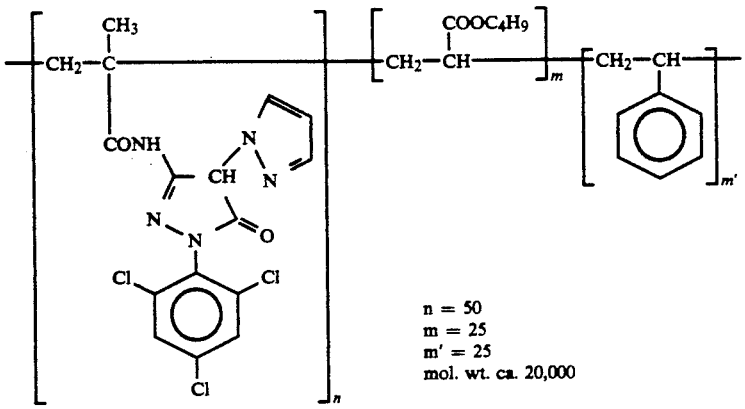
ExM-2
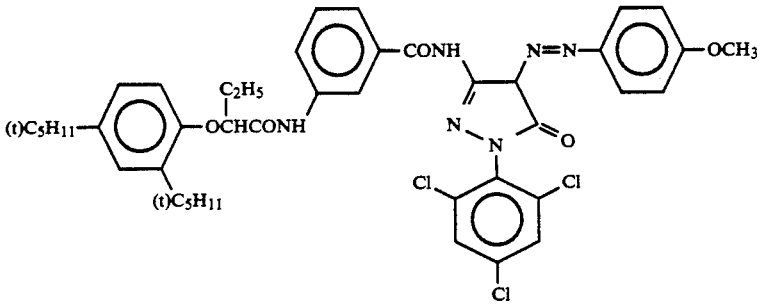
ExM-3
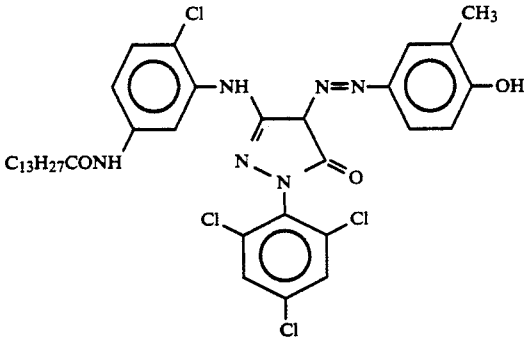
ExM-4
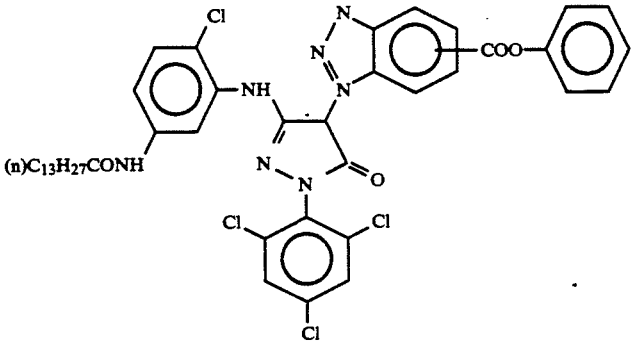

-continued
ExY-1
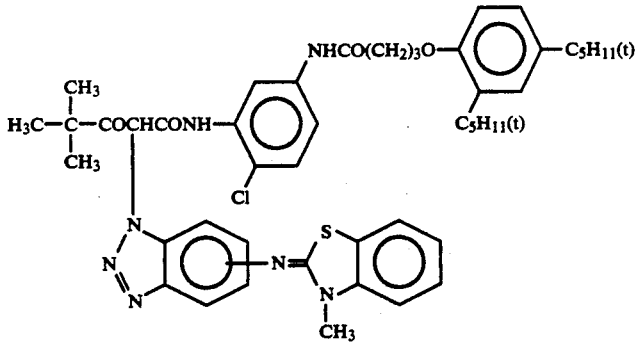
ExY-2
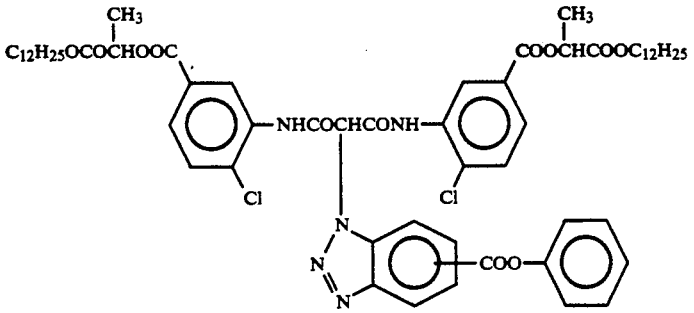
ExY-3
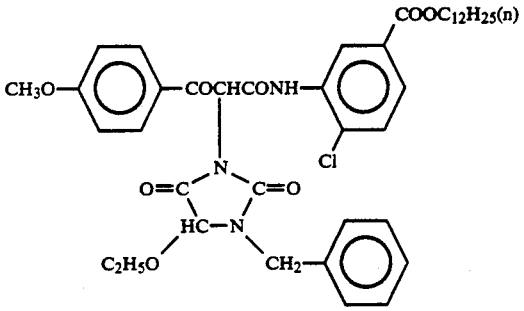
ExY-4
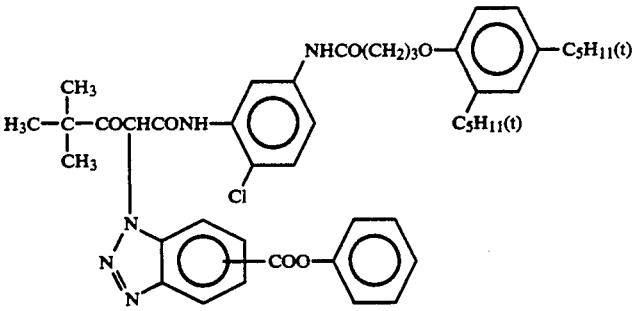
Cpd-1
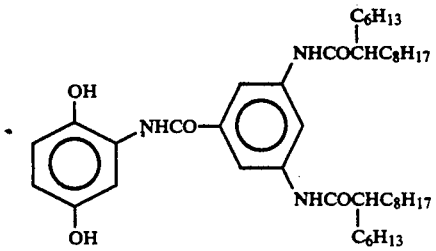

-continued
Cpd-2
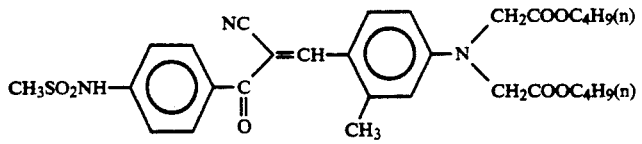
Cpd-5
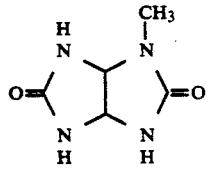
Cpd-6
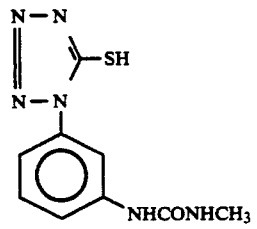
Cpd-8
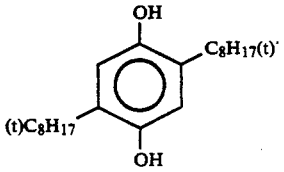
H-1
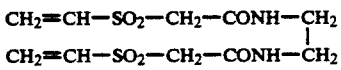
W-1
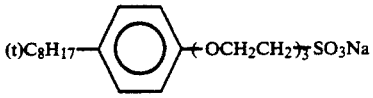
W-2
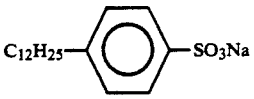
W-3
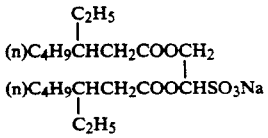
W-4
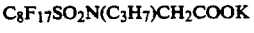
ExS-1
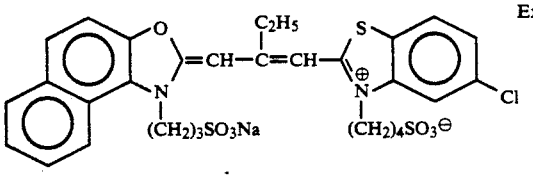
ExS-2
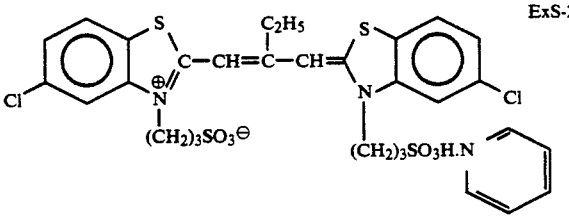
ExS-3
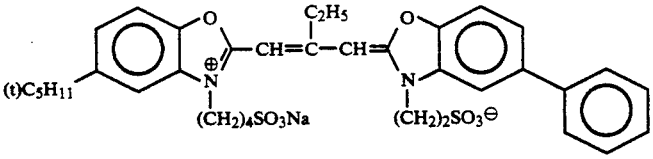
ExS-4
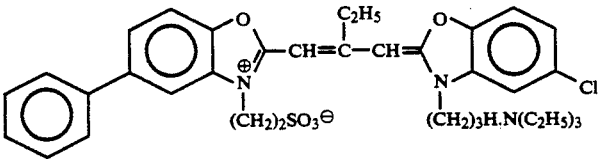
ExS-5
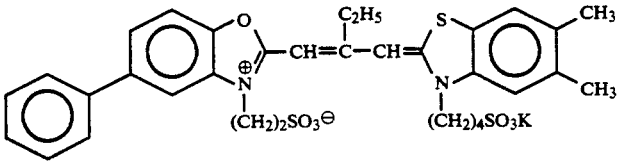

-continued
ExS-6
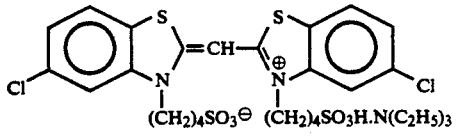
ExS-7
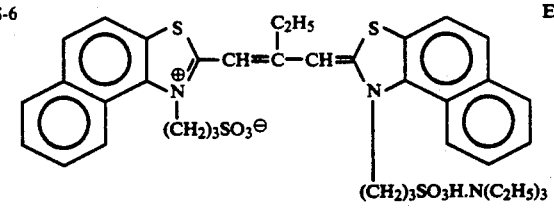
ExS-8
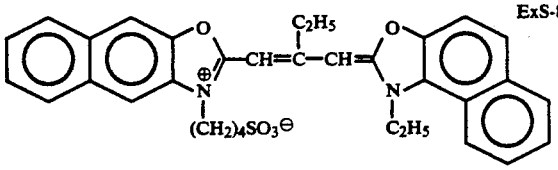
F-1
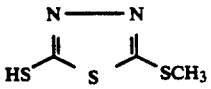
F-2
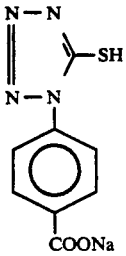
F-3
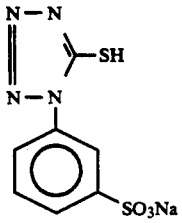
F-4
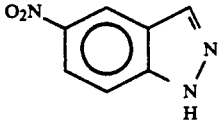
F-5
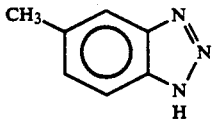
F-6
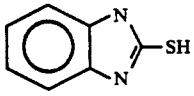
F-7
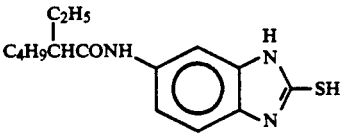
F-8
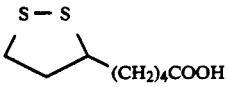
F-9
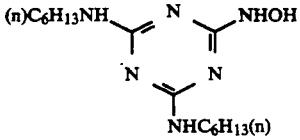
F-10
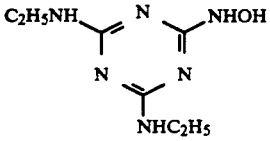
F-11
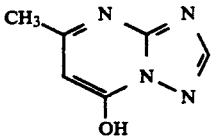
F-12
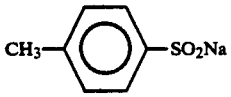
B-1
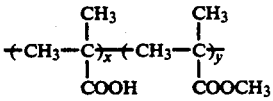
x/y = 10/90
B-2
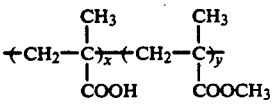
x/y = 40/60
B-3
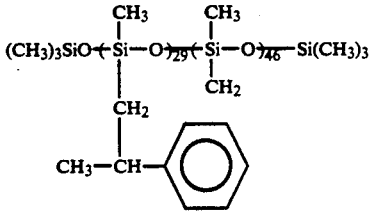

-continued

B-4

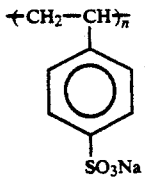

B-5

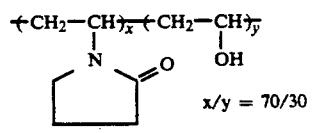

The sample thus prepared was cut into a width of 35 mm, subjected to a wedge exposure of white light (a light source having a color temperature of 4800° K.), and processed by the following processing steps using a cine-type automatic processor. In addition, the sample for evaluating the performance was processed after processing the imagewise exposed sample until the accumulated amount of the replenisher for the color developer had became three times the tank volume.

In this case, the composition of the bleach solution was shown below. Bleaching was carried out by blowing from a conduit having many fine pores each having a diameter of 0.2 mm attached to the bottom of the bleach tank at 200 ml/min for aeration.

| | Processing Steps | | | |
|---|---|---|---|---|
| Step | Process-Time | Process-Temp. | Replen-isher* | Tank Liquid |
| Color development | 3 min. and 15 sec. | 37.8° C. | 23 ml | 10 l |
| Bleach | 25 sec. | 38.0° C. | 5 ml | 5 l |
| Fix | 100 sec. | 38.0° C. | 30 ml | 10 l |
| Wash (1) | 30 sec. | 38.0° C. | — | 5 l |
| Wash (2) | 20 sec. | 38.0° C. | 30 ml | 5 l |
| Stabilization | 20 sec. | 38.0° C. | 20 ml | 5 l |
| Drying | 1 min. | 55° C. | | |

*Amount per 35 mm × 1 meter

Wash Step was by a countercurrent system from (2) to (1).

In addition, the carried amount of the color developer into the bleach step and the carried amount of the fix solution into the wash step, was each 2.0 ml per 35 mm×1 meter of the light-sensitive material.

Also, the crossover time in each step was 5 seconds, and that time was included in the processing time of the pre-step.

The composition of each processing solution is shown below:

| | Tank Liquid | Replenisher |
|---|---|---|
| Color development | | |
| Diethylenetriamine-pentaacetic Acid | 1.0 g | 1.1 g |
| 1-Hydroxyethylidene-1,1-diphosphonic Acid | 3.0 g | 3.2 g |
| Sodium Sulfite | 4.0 g | 4.9 g |
| Potassium Carbonate | 30.0 g | 30.0 g |
| Potassium Bromide | 1.4 g | — |
| Potassium Iodide | 1.5 mg | — |
| Hydroxylamine Sulfate | 2.4 | 3.6 |
| 4-(N-ethyl-N-β-hydroxy-ethylamino)-2-methyl-aniline Sulfate | 4.5 | 6.4 |
| Water to make | 1.0 liter | 1.0 liter |
| pH | 10.05 | 10.10 |
| Bleaching Solution | | |
| Ferric Nitrate | 0.20 mol | 0.30 mol |
| Chelating Compound shown in Table 5 below | 0.31 mol | 0.47 mol |
| Ammonium Bromide | 100 g | 150 g |
| Ammonium Nitrate | 20 g | 30 g |

-continued

| | Tank Liquid | Replenisher |
|---|---|---|
| Acetic Acid | 0.72 mol | 1.09 mol |
| Water to make | 1.0 l | 1.0 l |
| pH | 4.0 | 3.8 |

In addition, the term "chelating compound" indicates a compound constituting a ferric chelating compound as a bleaching agent with the metal salt (ferric nitrate) in the solution.

| Fix Solution | Tank liquid = replenisher |
|---|---|
| Ethylenediaminetetraacetic Acid Ferric Ammonium Salt | 1.7 g |
| Ammonium Sulfite | 14.0 g |
| Aqueous Ammonium Thiosulfate Solution (700 g/liter) | 260.0 ml |
| Water to make | 1.0 l |
| pH | 7.0 |
| Wash Water | Tank liquid = replenisher |

Tap water was passed through a mixed bed column filled with an H-type strong acidic cation exchange resin (Amberlite IR-120B) and an OH-type strong basic anion exchange resin (Amberlite IRA-400) to reduce the concentration of calcium and magnesium ions below 3 mg/liter and then 20 mg/liter of sodium dichloroisocyanurate and 150 mg/liter of sodium sulfate were added thereto.

The pH of the solution was in the range of from 6.5 to 7.5.

| Stabilization Solution | Tank liquid = replenisher |
|---|---|
| Formalin (37%) | 1.2 mg |
| Surface Active Agent [$C_{10}H_{21}$—O-(-$CH_2CH_2O$-)-$_{10}$H] | 0.4 g |
| Ethylene Glycol | 1.0 |
| Water to make | 1.0 liter |
| pH | 5.0 to 7.0 |

On each photographic light-sensitive material thus processed, the amount of remaining silver at the maximum colored density portion was measured by a fluorescent X-ray analysis. The results are shown in Table 5 below.

Also, the density of each sample thus processed was measured, From the characteristic curve, colored density $D_R$ value in the maximum colored density portion measured by red light (R light) was obtained.

Then, the following standard bleach solution giving no inferior recoloring was used. Each sample was processed in the same manner as above, except that the bleach time was changed to 600 seconds, the processing temperature was changed to 38° C., and the amount of the replenisher was changed to 25 ml per 35 mm×1 meter.

| Standard Bleach Solution | Tank Liquid | Replenisher |
|---|---|---|
| Ethylenediaminetetraacetic Acid ferric Sodium.$3H_2O$ | 100.0 g | 120.0 g |
| Ethylenediaminetetraacetic Acid Disodium Salt | 10.0 g | 11.0 g |
| Ammonium Bromide | 140 g | 140 g |
| Ammonium Nitrate | 30.0 g | 35.0 g |
| Aqueous Ammonia (27%) | 6.5 ml | 4.0 ml |
| Water to make | 1.0 l | 1.0 l |
| pH | 6.0 | 5.7 |

On the sample processed using the aforesaid standard bleach solution, the density was similarly measured and from the characteristic curve, the $D_R$ value was read.

The $\Delta D_R$ between the $D_R$ value obtained by using the standard bleach solution and the $D_R$ value obtained above was determined. In the case of the photographic light-sensitive material used in the example of this invention, the $D_R$ value obtained by processing the Standard bleach solution was 2.1.

Inferior recoloring ($\Delta D_R$)=($D_R$ of standard bleach Solution)−($D_R$ of each sample)

Using the foregoing samples, the change of the gradation upon storing the sample after processing was obtained from the change of the gradation before and after storage by storing the sample under the following condition.

In addition, the gradation ($\gamma_G$) is shown by the difference between the colored density ($D_{G1}$) measured by a green light (G light) of portion exposed by the exposure amount of 1/10 of the exposure amount giving the maximum colored density measured by G light from the characteristic curve and the colored density ($D_{G2}$) at a portion exposed by the exposure amount of 1/1000 of the exposure amount giving the maximum colored density.

Gradation ($\gamma_G$)=$D_{G1}-D_{G2}$

Stored condition: Dark, 60° C., 70% RH, for 4 weeks.

Gradation change ($\gamma D_R$)=($\gamma_G$ after storage)−($\gamma_G$ before storage)

The results are shown in Table 5.

TABLE 5

| Compound | Amount of Remaining Ag [μg/cm²] | Inferior Recoloring ($\Delta D_R$) | Gradation Change ($\Delta r_G$) |
|---|---|---|---|
| Comparison Compound A* | 60.5 | 0.10 | 0.15 |
| Comparison Compound B* | 13.8 | 0.27 | 0.30 |
| Comparison Compound D* | 30.0 | 0.41 | 0.15 |
| Compound 6 | 11.9 | 0.10 | 0.03 |
| Compound 34 | 10.2 | 0.09 | 0.05 |
| Compound 58 | 9.5 | 0.06 | 0.02 |

*Same as those in Example 1

From the results shown in Table 5, it can be seen that the invention shows excellent effects in the amount of remaining silver, inferior recoloring, and the gradation change upon storing the color images after processing, as compared to the comparison examples.

EXAMPLE 6

Sample 501 in Example 5 was processed as in Example 5 while changing the bleaching time in the processing steps. The same measurement as in Example 1 was carried out on inferior recoloring. In this case, the bleach solution (tank liquid) contained 0.72 mol of acetic acid. The results are shown in Table 6.

TABLE 6

| Compound | Inferior Recoloring ($\Delta D_R$) Bleaching Time (sec.) 20 | 30 | 50 | 100 |
|---|---|---|---|---|
| Comparison compound B | 0.30 | 0.25 | 0.10 | 0.03 |
| Compound 58 | 0.08 | 0.05 | 0.02 | 0.02 |

From the results shown in Table 6, it can be seen that the invention shows the excellent effect about inferior recoloring in quick bleach processing as compared to the comparison examples.

EXAMPLE 7

A multilayer color photographic light-sensitive material (Sample 701) was prepared having the layers of the following compositions on a cellulose triacetate film support having a subbing layer.

Composition of the Layers

The coated amount is shown by a g/m² unit of silver on a silver halide emulsion and colloidal silver, by a g/m² for couplers, additives and gelatin, and by a mol number for a sensitizing dye per mol of the silver halide in the same layer.

| | |
|---|---|
| Layer 1: Antihalation Layer | |
| Black Colloidal silver | 0.20 as Ag |
| Gelatin | 2.20 |
| UV-1 | 0.11 |
| UV-2 | 0.20 |
| Cpd-1 | $4.0 \times 10^{-2}$ |
| Cpd-2 | $1.9 \times 10^{-2}$ |
| Solv-1 | 0.30 |
| Solv-2 | $1.2 \times 10^{-2}$ |
| Layer 2: Interlayer | |
| Fine Grain Silver Iodobromide (AgI 1.0 mol %, sphere-corresponding diameter 0.07 μm) | 0.15 as Ag |
| Gelatin | 1.00 |
| ExC-4 | $6.0 \times 10^{-2}$ |
| Cpd-3 | $2.0 \times 10^{-2}$ |
| Layer 3: 1st Red-Sensitive Emulsion Layer | |
| Silver Iodobromide Emulsion (AgI 5.0 mol %, surface high AgI type, sphere-corresponding diameter 0.9 μm, variation coeff. of sphere-corresponding diameter 21%, Tabular grains, aspect ratio 7.5) | 0.42 as Ag |
| Silver Iodobromide Emulsion (AgI 4.0 mol %, inside high AgI type, sphere-corresponding diameter 0.4 μm, variation coeff. of sphere-corresponding diameters 18%, tetradecahedral grains) | 0.40 as Ag |
| Gelatin | 1.90 |
| ExS-1 | $4.5 \times 10^{-4}$ mol |
| ExS-2 | $1.5 \times 10^{-4}$ mol |
| ExS-3 | $4.0 \times 10^{-5}$ mol |
| ExC-1 | 0.65 |
| ExC-3 | $1.0 \times 10^{-2}$ |

-continued

| | |
|---|---|
| ExC-4 | $2.3 \times 10^{-2}$ |
| Solv-1 | 0.32 |
| Layer 4: 2nd Red-Sensitive Emulsion Layer | |
| Silver Iodobromide Emulsion (AgI 8.5 mol %, inside high AgI type, sphere-corresponding diameter 1.0 μm, variation coeff. of sphere-corresponding diameters 25%, tabular grains, aspect ratio 3.0) | 0.85 as Ag |
| Gelatin | 0.91 |
| ExS-1 | $3.0 \times 10^{-4}$ mol |
| ExS-2 | $1.0 \times 10^{-4}$ mol |
| ExS-3 | $3.0 \times 10^{-5}$ mol |
| ExC-1 | 0.13 |
| ExC-2 | $6.2 \times 10^{-2}$ |
| ExC-4 | $4.0 \times 10^{-2}$ |
| ExC-6 | $3.0 \times 10^{-2}$ |
| Solv-1 | 0.10 |
| Layer 5: 3rd Red-Sensitive Emulsion Layer | |
| Silver Iodobromide Emulsion (AgI 11.3 mol %, inside high AgI type, sphere-corresponding diameter 1.4 μm, variation coeff. of sphere-corresponding diameters fluctuation in grain diameter 28%, tabular grains, aspect ratio 6.0) | 1.50 as Ag |
| Gelatin | 1.20 |
| ExS-1 | $2.0 \times 10^{-4}$ mol |
| ExS-2 | $6.0 \times 10^{-5}$ mol |
| ExS-3 | $2.0 \times 10^{-5}$ mol |
| ExC-2 | $8.5 \times 10^{-2}$ |
| ExC-5 | $7.3 \times 10^{-2}$ |
| ExC-6 | $1.0 \times 10^{-2}$ |
| Solv-1 | 0.12 |
| Solv-2 | 0.12 |
| Layer 6: Interlayer | |
| Gelatin | 1.00 |
| Cpd-4 | $8.0 \times 10^{-2}$ |
| Solv-1 | $8.0 \times 10^{-2}$ |
| Layer 7: 1st Green-Sensitive Emulsion Layer | |
| Silver Iodobromide Emulsion (AgI 5.0 mol %, high AgI type, sphere-corresponding diameter 0.9 μm, variation coeff. of sphere-corresponding diameters 21%, tabular grains, aspect ratio 7.0) | 0.28 as Ag |
| Silver Iodobromide Emulsion (AgI 4.0 mol %, inside high AgI type, sphere-corresponding diameter 0.4 μm, variation coeff. of sphere-corresponding diameters 18%, tetradecahedral grains) | 0.16 as Ag |
| Gelatin | 1.20 |
| ExS-4 | $5.0 \times 10^{-4}$ mol |
| ExS-5 | $2.0 \times 10^{-4}$ mol |
| ExS-6 | $1.0 \times 10^{-4}$ mol |
| ExM-1 | 0.50 |
| ExM-2 | 0.10 |
| ExM-5 | $3.5 \times 10^{-2}$ |
| Solv-1 | 0.20 |
| Solv-3 | $3.0 \times 10^{-2}$ |
| Layer 8: 2nd Green-Sensitive Emulsion Layer | |
| Silver Iodobromide Emulsion (AgI 8.5 mol %, inside high AgI type, sphere-corresponding diameter 1.0 μm, variation coeff. of sphere-corresponding diameters 25%, tabular grains, aspect ratio 3.0) | 0.57 as Ag |
| Gelatin | 0.45 |
| ExS-4 | $3.5 \times 10^{-4}$ mol |
| ExS-5 | $1.4 \times 10^{-4}$ mol |
| ExS-6 | $7.0 \times 10^{-5}$ mol |
| ExM-1 | 0.12 |
| ExM-2 | $7.1 \times 10^{-3}$ |
| ExM-3 | $3.5 \times 10^{-2}$ |
| Solv-1 | 0.15 |
| Solv-3 | $1.0 \times 10^{-2}$ |
| Layer 9: Interlayer | |
| Gelatin | 0.50 |

-continued

| | |
|---|---|
| Solv-1 | $2.0 \times 10^{-2}$ |
| Layer 10: 3rd Green-Sensitive Emulsion Layer | |
| Silver Iodobromide Emulsion (AgI 11.3 mol %, inside high AgI type, sphere-corresponding diameter 1.4 μm, variation coeff. of sphere-corresponding diameters 28%, tabular grains, aspect ratio 6.0) | 1.30 as Ag |
| Gelatin | 1.20 |
| ExS-4 | $2.0 \times 10^{-4}$ mol |
| ExS-5 | $8.0 \times 10^{-5}$ mol |
| ExS-6 | $8.0 \times 10^{-5}$ mol |
| ExM-4 | $5.8 \times 10^{-2}$ |
| ExM-6 | $5.0 \times 10^{-3}$ |
| ExC-2 | $4.5 \times 10^{-3}$ |
| Cpd-5 | $1.0 \times 10^{-2}$ |
| Solv-3 | 0.25 |
| Layer 11: Yellow Filter Layer | |
| Gelatin | 0.50 |
| Cpd-6 | $5.2 \times 10^{-2}$ |
| Solv-1 | 0.12 |
| Layer 12: Interlayer | |
| Gelatin | 0.45 |
| Cpd-3 | 0.10 |
| Layer 13: 1st Blue-Sensitive Layer | |
| Silver Iodobromide Emulsion (AgI 2 mol %, uniform AgI type, sphere-corresponding diameter 0.55 μm, variation coeff. of sphere-corresponding diameters 25%, tabular grains, aspect ratio 7.0) | 0.20 as Ag |
| Gelatin | 1.00 |
| ExS-7 | $3.0 \times 10^{-4}$ mol |
| ExY-1 | 0.60 |
| ExY-2 | $2.3 \times 10^{-2}$ |
| Solv-1 | 0.15 |
| Layer 14: 2nd Blue-Sensitive Emulsion Layer | |
| Silver Iodobromide Emulsion (AgI 19.0 mol %, inside high AgI type, sphere-corresponding diameter 1.0 μm, variation coeff. of sphere-corresponding diameters 16%, octahedral grains) | 0.19 as Ag |
| Gelatin | 0.35 |
| ExS-7 | $2.0 \times 10^{-4}$ mol |
| ExY-1 | 0.22 |
| Solv-1 | $7.0 \times 10^{-2}$ |
| Layer 15: Interlayer | |
| Fine Grain Silver Iodobromide (AgI 2 mol %, uniform AgI type, sphere-corresponding diameter 0.13 μm) | 0.20 as Ag |
| Gelatin | 0.36 |
| Layer 16: 3rd Blue-Sensitive Emulsion Layer | |
| Silver Iodobromide Emulsion (AgI 14.0 mol %, inside high Agi type, sphere-corresponding diameter 1.7 μm, variation coeff. of sphere-corresponding diameters 28%, tabular grains, aspect ratio 5.0) | 1.55 as Ag |
| Gelatin | 1.00 |
| ExS-8 | $1.5 \times 10^{-4}$ |
| ExY-1 | 0.21 |
| Solv-1 | $7.0 \times 10^{-2}$ |
| Layer 17: 1st Protective Layer | |
| Gelatin | 1.80 |
| UV-1 | 0.13 |
| UV-2 | 0.21 |
| Solv-1 | $1.0 \times 10^{-2}$ |
| Solv-2 | $1.0 \times 10^{-2}$ |
| Layer 18: 2nd Protective Layer | |
| Fine Grain Silver Chloride (sphere-corresponding diameter 0.07 μm) | 0.36 as Ag |
| Gelatin | 0.70 |
| B-1 (diameter: 1.5 μm) | $2.0 \times 10^{-2}$ |
| B-2 (diameter: 1.5 μm) | 0.15 |
| B-3 | $3.0 \times 10^{-2}$ |
| W-1 | $2.0 \times 10^{-2}$ |

-continued

| | |
|---|---|
| H-1 | 0.35 |
| Cpd-7 | 1.00 |

The sampler further contained 1,2-benzisothiazolinone (200 ppm to gelatin), n-butyl-p-hydroxy benzoate (about 1,000 ppm to gelatin), and 2-phenoxy ehtanol (about 10,000 ppm to gelatin).

Moreover, the sample further contained compounds B-4, B-5, W-2, W-3, F-1, F-2, F-3, F-4, F-5, F-6, F-7, F-8, F-9, F-10, F-11, F-12, and F-13, and iron salt, a lead salt, a gold salt, a platinum salt, an iridium salt, and rhodium salt.

The compounds used in preparation of the sample of this Example are shown below.

UV-1

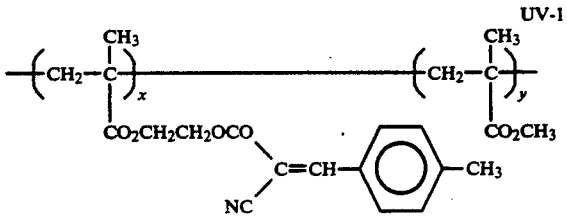

x/y = 7/3 (by weight)

UV-2

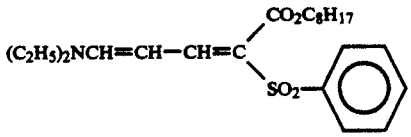

ExC-1

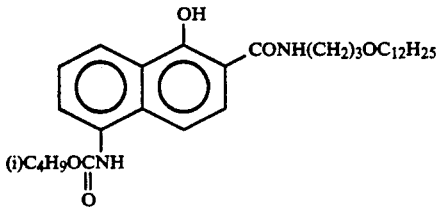

ExC-2

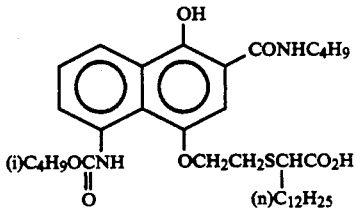

ExC-3

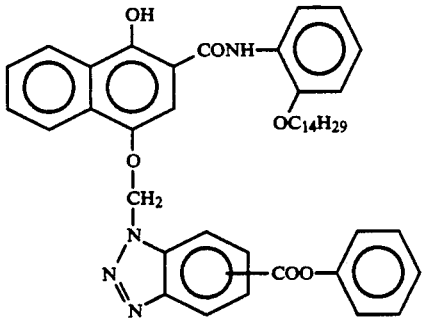

ExC-4

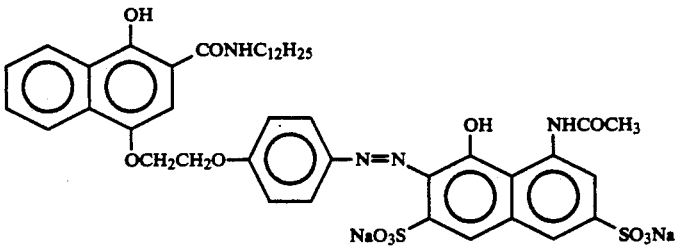

ExC-5

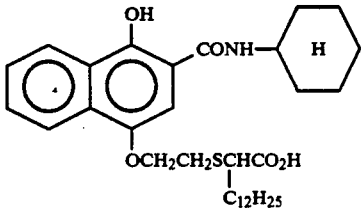

-continued
ExC-6
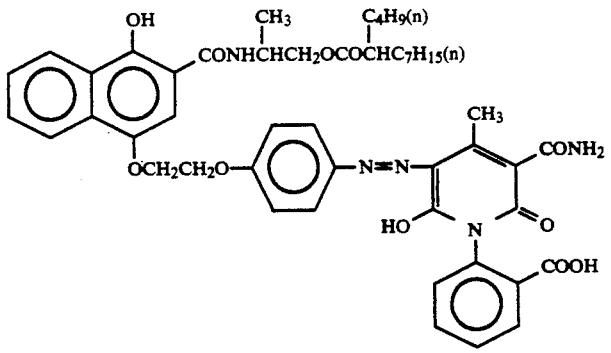
ExM-1
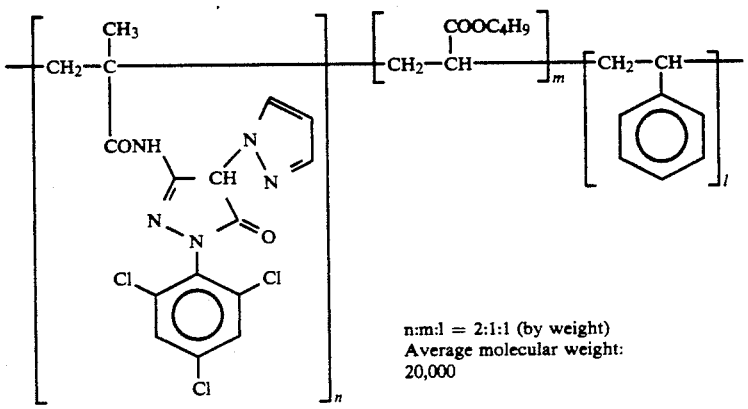
ExM-2
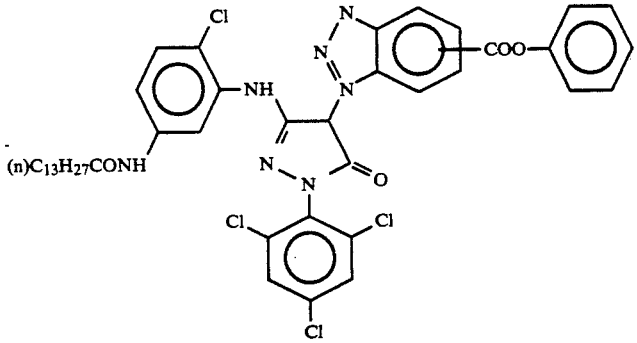
ExM-3
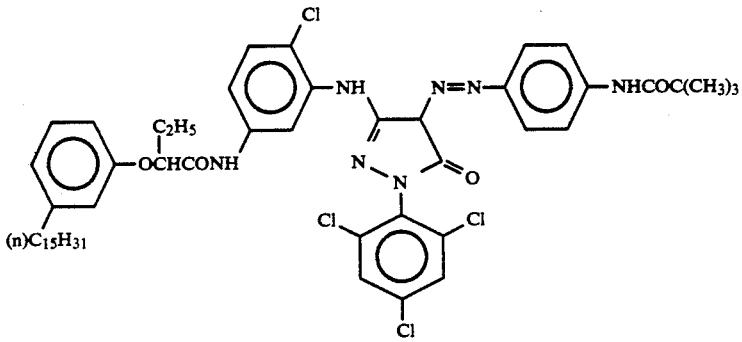

-continued
ExM-4
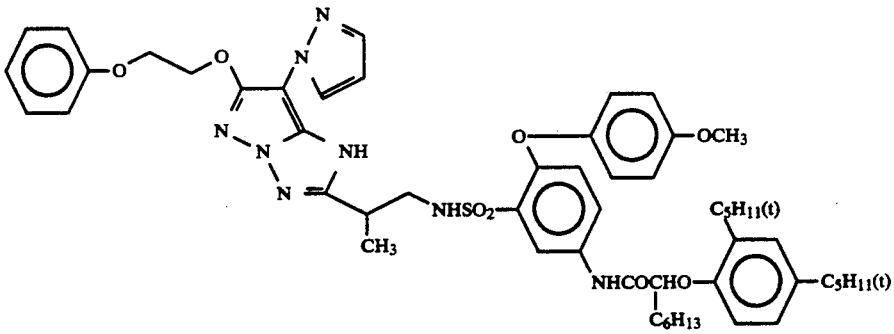
ExM-5
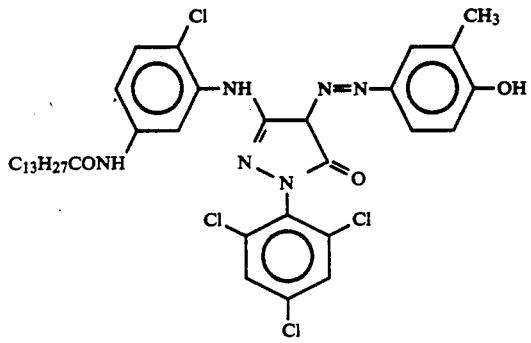
ExM-6
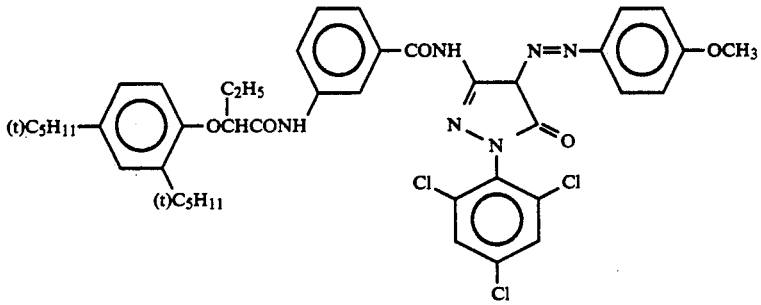
ExY-1
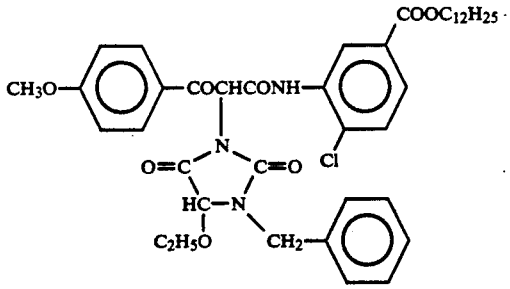
ExY-2
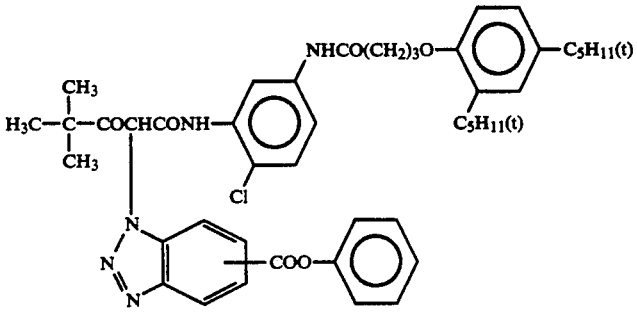

-continued
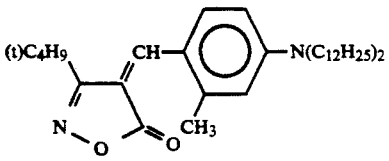
Cpd-1
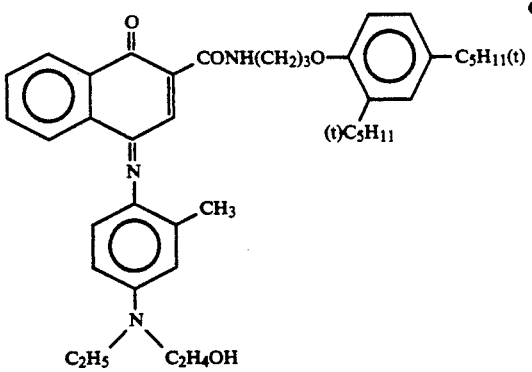
Cpd-2
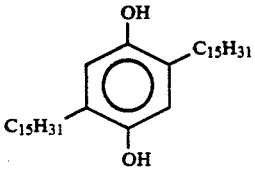
Cpd-3
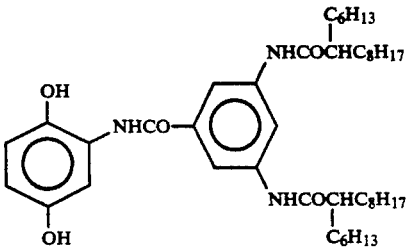
Cpd-4
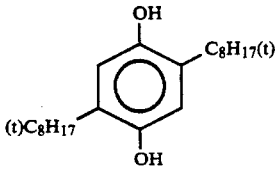
Cpd-5
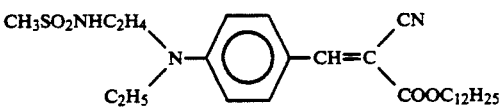
Cpd-6
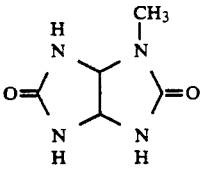
Cpd-7
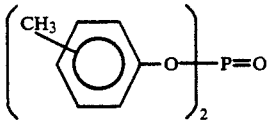
Solv-1
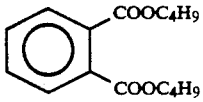
Solv-2
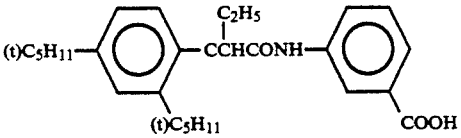
Solv-3
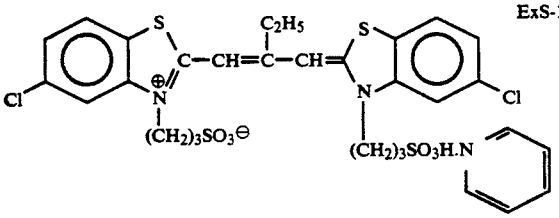
ExS-1
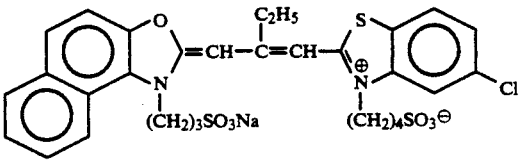
ExS-2
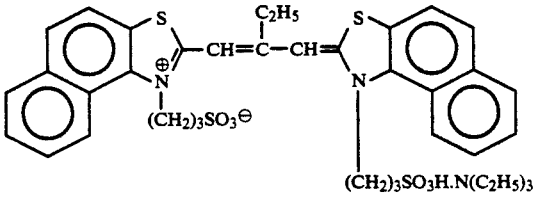
ExS-3

-continued
ExS-4
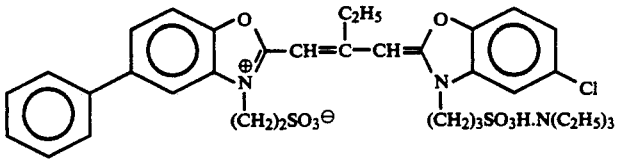
ExS-5
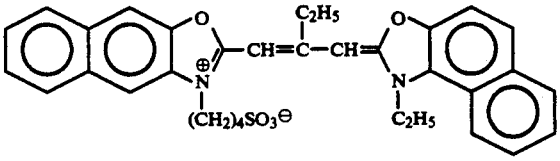
ExS-6
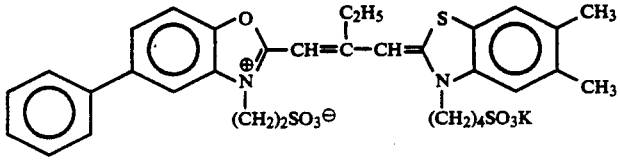
ExS-7
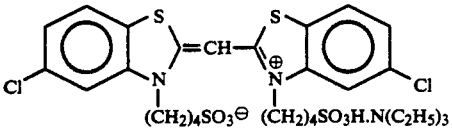
ExS-8
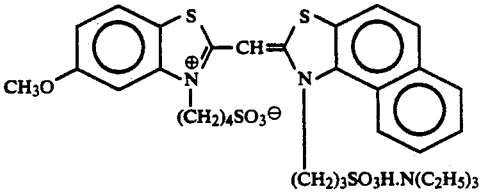
B-1
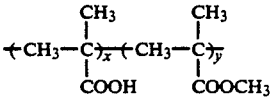
x/y = 10/90
B-2
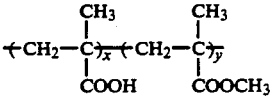
x/y = 40/60
B-3
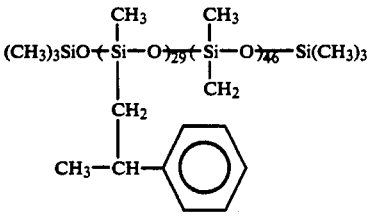
B-4
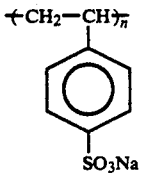
B-5
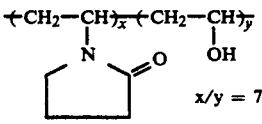
x/y = 70/30
W-1
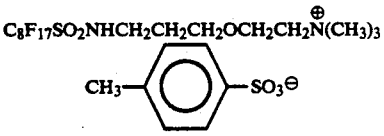
W-2
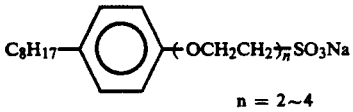
n = 2~4
W-3
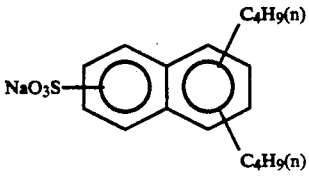
H-1
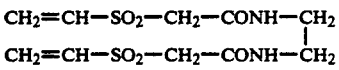
F-1
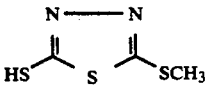

-continued

F-2

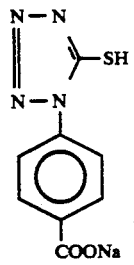

F-3

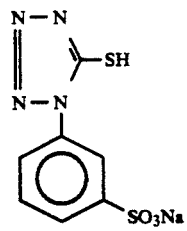

F-4

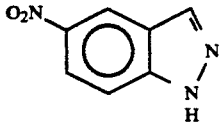

F-5

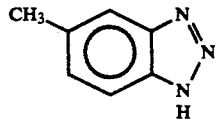

F-6

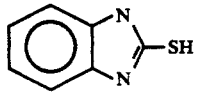

F-7

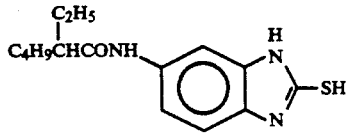

F-8

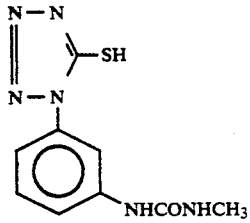

F-9

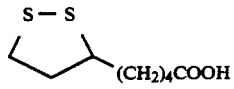

F-10

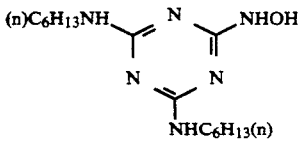

F-11

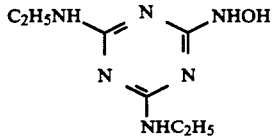

F-12

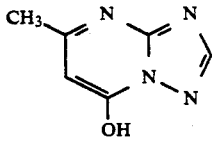

F-13

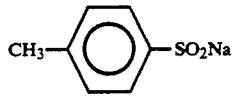

The sample prepared was cut, exposed, and processed as in Example 4. The processing steps were same as in Example 4. Also, the compositions of the processing solutions, other than the bleach solution, were same as those in Example 4. In this case, however, the bleach processing time was 40 seconds.

The composition of the bleach solution used in the example (Example 7) is shown below.

| Bleaching Solution | Tank Liquid | Replenisher |
|---|---|---|
| Ferric Nitrate | 0.20 mol | 0.30 mol |
| Chelating Compound 58 | 0.31 mol | 0.47 mol |
| Ammonium Bromide | 100 g | 150 g |
| Ammonium Nitrate | 20 g | 30 g |
| Organic Acid shown in Table 7 | 0.10/0.30 mol | 0.14/0.42 mol |
| Water to make | 1 l | 1 l |
| pH | 4.2 | 4.60 |

On each sample thus processed, the gradation change ($\Delta\gamma_G$) was determined by the same measurement as in Example 5 and the results obtained are shown in Table 7 below.

TABLE 7

| Organic acid | | |
|---|---|---|
| Compound | Density (mol/l) | Gradation change ($\Delta\gamma_C$) |
| Acetic acid | 0.1 | 0.02 |
| | 0.3 | 0.02 |
| Glycolic acid | 0.1 | 0.04 |
| | 0.3 | 0.03 |
| Lactic acid | 0.1 | 0.05 |
| | 0.3 | 0.03 |
| n-Butyric acid | 0.1 | 0.07 |
| | 0.3 | 0.06 |
| Malonic acid | 0.1 | 0.09 |
| | 0.3 | 0.08 |
| Malic acid | 0.1 | 0.08 |
| | 0.3 | 0.06 |
| Citric acid | 0.1 | 0.10 |
| | 0.3 | 0.09 |
| Aspartic acid | 0.1 | 0.09 |
| | 0.3 | 0.10 |
| Phthalic acid | 0.1 | 0.11 |

TABLE 7-continued

| Organic acid | | |
|---|---|---|
| Compound | Density (mol/l) | Gradation change ($\Delta\gamma C$) |
| | 0.3 | 0.10 |

From the results shown in Table 7, it can be seen that the invention shows an excellent effect on the gradation change upon the storage of color images after processing.

Example 8

Sample 101 in the example described in JP-A-2-44345 was cut, exposed and processed as in Example 5 above. In regard to the processing steps, the same processing steps as in Example 5 were used, except that the bleaching time was changed to 30 seconds and the ratio (C/R) of the carried amount (C) of the color developer into the bleach step to the replenished amount (R) to the bleach solution was changed as shown in Table 8. Also, the compositions of processing solutions other than the bleach solution were same as those in Example 5.

The composition of the bleach solution used in the example is shown below:

| Bleaching Solution | Tank Liquid | Replenisher |
|---|---|---|
| Ferric Nitrate | 0.20 mol | 0.30 mol |
| Chelate Compound shown in Table 8 | 0.31 mol | 0.47 mol |
| Ammonium Bromide | 100 g | 150 g |
| Ammonium Nitrate | 20 g | 30 g |
| Glycolic Acid | 0.5 mol | 0.75 mol |
| Water to make | 1.0 l | 1.0 l |
| pH | 3.5 | 3.3 |

On each photographic light-sensitive material thus processed, the amount of remaining silver was measured by the same method as in Example 5, and the results are shown in Table 8.

TABLE 8

| | Amount of Remaining Silver ($\mu g/cm^2$) C/R | | | |
|---|---|---|---|---|
| Compound | 0.1 | 0.2 | 0.4 | 0.6 |
| comparison Compound A* | 46.0 | 46.8 | 49.8 | 53.5 |
| Compound B* | 9.7 | 9.9 | 11.3 | 14.2 |
| Compound C* | 25.8 | 26.1 | 27.4 | 31.7 |
| compound 6 | 8.9 | 9.4 | 9.8 | 10.0 |
| compound 34 | 8.5 | 8.4 | 8.6 | 8.9 |
| compound 58 | 7.1 | 7.3 | 7.3 | 7.5 |

*Same as those in Example 1

From the results of Table 8, it can be seen that the invention is also excellent in desilvering property in the case of carrying out the processing process wherein the amount of the replenisher for the bleach solution was reduced.

As described above, by using the processing solution having bleaching faculty containing the metal chelating compound in this invention, quick processing, which is excellent in its desilvering property, can be practiced without forming bleach fog and with less formation of stains after processing.

Also, by processing the processing solution containing an organic acid, quick processing which is excellent in its desilvering property can be practiced with less inferior recoloring and with less gradation change after processing.

While the invention has been described in detail and with reference to specific embodiments thereof, it will be apparent to one skilled in the art that various changes and modifications can be made therein without departing from the spirit and scope thereof.

What is claimed is:

1. A method for processing an image-wise exposed silver halide color photographic material in which said material is color-developed and then processed in a processing solution which has a bleaching ability and which contains as a bleaching agent a metal chelating compound formed by a compound represented by formula (II) or (III) and a salt of a metal belonging to Group Ib, IIb, IIIb, IVb, Vb, VIb, VIIb, or VIII of the Periodic Table:

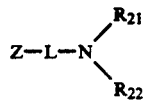

(II)

wherein Z represents a heterocyclic group; L represents a straight chain, branched, or cyclic alkylene group having from 1 to 10 carbon atoms, an alkylene group having from 2 to 10 carbon atoms, an alkinylene group having from 2 to 10 carbon atoms,

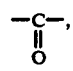

or —$SO_2$—; and $R_{21}$ and $R_{22}$ each represents —$L_1$—$COOM^1$or —$L_1$—Za wherein $M^1$ represents a hydrogen atom or a cation, Za has the same meaning as Z; and $L_1$ represents a divalent linkage group represented by formula ($L_1$).

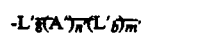

($L_1$)

wherein $L'_a$ and $L'_b$ each represents an alkylene group; A' represents —O—, —S—, —COO—,

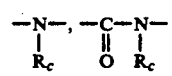

(wherein $R_c$ represents a hydrogen atom, an alkyl group, an aryl group, or a hydroxy group), or

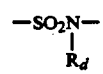

(wherein $R_d$ represents a hydrogen atom, an alkyl group, or an aryl group) m' and n' each represents 0 or 1, and the mark (**) represents a bonding position to the $COOM^1$ or Za;

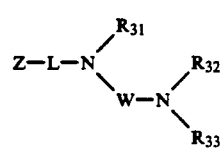

(III)

wherein Z and L have the same meaning as in formula (II); $R_{31}$, $R_{32}$, and $R_{33}$each represents a hydrogen atom, an aliphatic group, or a heterocyclic group; and W is a divalent linkage group represented by formula ($W_1$) or ($W_2$):

$$-[W^1-D]_s-W^2- \qquad (W_1)$$

wherein $W^1$ and $W^2$each represents an alkylene group having from 2 to 8 carbon atoms, an arylene group having from 6 to 18 carbon atoms, or a cyclohexylene group; D represents —O—, —S—, or $-\underset{\underset{R_w}{|}}{N}-$ (wherein $R_w$ represents a hydrogen atom, a hydrocarbon group, $-L_A-COOM^5$, $-L_A-PO_3M^6M^7$, $-L_A-OH$, or $-L_A-SO_3M^8$(wherein $L_A$represents an alkylene group having from 1 to 8 carbon atoms or an arylene group having from 6 to 10 carbon atoms; and $M^5$, $M^6$, $M^7$, and $M^8$ each represents a hydrogen atom or a cation)); and s represents 0 or an integer of from 1 to 3;

$$-(L_B)_l W^3-(L_C)_{l'} \qquad (W_2)$$

wherein $L_B$ and $L_C$ each represents an alkylene group having from 1to 8 carbon atoms, $W^3$ represents an arylene group having from 6 to 18 carbon atoms, a cyclohexylene group or a divalent heterocyclic group having a nitrogen atom in its ring, and l and l' each represents 0 or 1, excluding the instance in which l and l' are simultaneously 0.

2. The method of processing an image-wise exposed silver halide color photographic material of claim 1, wherein L is a methylene group or an ethylene group.

3. The method of processing an image-wise exposed silver halide color photographic material of claim 1, wherein m' and n' in formula ($L_1$) are 0.

4. The method of processing an image-wise exposed silver halide color photographic material of claim 1, wherein $L_1$ is a methylene group or an ethylene group.

5. The method of processing an image-wise exposed silver halide color photographic material of claim 1, wherein W in formula (III) is a divalent linkage group represented by formula ($W_1$).

6. The method of processing an image-wise exposed silver halide color photographic material of claim 5, wherein $W^1$ and $W^2$ each represents an alkylene group.

7. The method of processing an image-wise exposed silver halide color photographic material of claim 5, wherein D in formula ($W_1$) is —NH—.

8. The method of processing an image-wise exposed silver halide coor photographic material of claim 5, wherein s in formula ($W_1$) is 0.

9. The method of processing an image-wise exposed silver halide color photographic material of claim 1, wherein Z is represented by formula (Za)

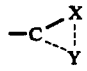

(Za)

wherein X represents a nitrogen atom, a sulfur atom or an oxygen atom, Y represents a non-metallic atom group to form a 5- or 6-membered heterocyclic aromatic ring, $R_Z$represents a substituent, and m represents 0 or an integer of 1 to 4.

10. The method of processing an image-wise exposed silver halide color photographic material of claim 9, wherein $R_z$is an alkyl group having 1 to 3 carbon atoms or a nitro group.

11. The method as in claim 1, wherein the metal ion of the metal salt is Fe(III), Mn(III), Co(III), Rh(II), Rh(III), Au(III), Au(II), Cu(II), or Ce(IV).

12. The method as in claim 1, wherein Z represents a 3- to 10-membered saturated or unsaturated heterocyclic group containing at least one nitrogen, oxygen or sulfur atom.

13. The method as in claim 1, wherein said metal chelating compound is contained in an amount of from 0.05 to 1 mol per liter of the processing composition.

14. The method as in claim 1, wherein said processing composition is a bleach solution or a blix solution.

15. The method as in claim 1, wherein the processing composition further contains an organic acid.

16. The method as in claim 15, wherein said organic acid has pKa of from 1.5 to 6.5.

17. The method as in claim 15, wherein said organic acid has a carbonyl group and has pKa of from 2.0 to 5.5.

18. The method as in claim 15, wherein said organic acid is contained in an amount of at least organic acid is contained in an amount of at least 0.05 mol per liter of the processing composition.

19. The method as in claim 12, wherein Z represents a 5- or 6-membered aromatic heterocyclic group.

* * * * *